US010010999B2

(12) United States Patent
Raghavan et al.

(10) Patent No.: US 10,010,999 B2
(45) Date of Patent: Jul. 3, 2018

(54) CONTROL VALVES FOR WATERJET SYSTEMS AND RELATED DEVICES, SYSTEMS, AND METHODS

(71) Applicant: OMAX Corporation, Kent, WA (US)

(72) Inventors: Chidambaram Raghavan, Seattle, WA (US); John H. Olsen, Vashon, WA (US); Douglas Kelley, Issaquah, WA (US); Olivier L. Tremoulet, Jr., Edmonds, WA (US); Rick Marks, Olympia, WA (US); Andre Kashierski, Covington, WA (US)

(73) Assignee: OMAX Corporation, Kent, WA (US)

( * ) Notice: Subject to any disclaimer, the term of this patent is extended or adjusted under 35 U.S.C. 154(b) by 419 days.

(21) Appl. No.: 14/745,061

(22) Filed: Jun. 19, 2015

(65) Prior Publication Data

US 2015/0360344 A1 Dec. 17, 2015

Related U.S. Application Data

(63) Continuation of application No. 13/843,317, filed on Mar. 15, 2013, now Pat. No. 9,095,955.
(Continued)

(51) Int. Cl.
*B24C 1/00* (2006.01)
*B24C 5/04* (2006.01)
(Continued)

(52) U.S. Cl.
CPC ..... *B24C 7/0023* (2013.01); *B24C 1/00* (2013.01); *B24C 1/045* (2013.01)

(58) Field of Classification Search
CPC .. B24C 1/00; B24C 1/045; B24C 5/04; B24C 7/0023; B05B 7/12; B05B 9/01; B05B 12/002; F02M 47/00; F02M 61/06
(Continued)

(56) References Cited

U.S. PATENT DOCUMENTS 2,308,347 A * 1/1943 Asselin ..... F16K 31/26 137/218
2,403,751 A 7/1946 Palmer
(Continued)

FOREIGN PATENT DOCUMENTS

CN 101811287 8/2010
CN 102507171 6/2012
(Continued)

OTHER PUBLICATIONS

Hasish, M., "Waterjet Machine Tool of the Future," 9th American Waterjet Conference, Aug. 23-26, 1997, Dearborn, Michigan, Paper No. 58, 15 pages.
(Continued)

*Primary Examiner* — Eileen Morgan
(74) *Attorney, Agent, or Firm* — Perkins Coie LLP

(57) ABSTRACT

Control valves for waterjet systems, control-valve actuators, waterjet systems, methods for operating waterjet systems, and associated devices, systems, and methods are disclosed. A control valve configured in accordance with a particular embodiment includes a first seat having a tapered inner surface, a second seat having a contact surface, and an elongated pin having a shaft portion and an end portion. The pin is movable relative to the first and second seats between a shutoff position and one or more throttling positions. When the pin is at the shutoff position, the end portion of the pin is in contact with the contact surface. When the pin is at the throttling position, the end portion of the pin is spaced apart from the contact surface and the tapered inner surface and the shaft portion of the pin at least partially define a throttling gap.

10 Claims, 25 Drawing Sheets

Related U.S. Application Data

(60) Provisional application No. 61/684,133, filed on Aug. 16, 2012, provisional application No. 61/684,135, filed on Aug. 16, 2012, provisional application No. 61/684,642, filed on Aug. 17, 2012, provisional application No. 61/732,857, filed on Dec. 3, 2012, provisional application No. 61/757,663, filed on Jan. 28, 2013.

(51) Int. Cl.
*B24C 7/00* (2006.01)
*B24C 1/04* (2006.01)

(58) Field of Classification Search
USPC ..... 451/38, 39, 75, 90, 91, 102; 137/882, 137/637.2; 239/124, 526, 584
See application file for complete search history.

(56) References Cited

U.S. PATENT DOCUMENTS 2,558,035 A 6/1951 Bridgman
2,819,835 A 1/1958 Newhall
2,822,789 A * 2/1958 Philips ..... F02M 53/043 137/340
2,951,369 A 9/1960 Newhall
3,095,900 A 7/1963 Newhall
3,106,169 A 10/1963 Prosser et al.
3,148,528 A 9/1964 Reynolds
3,296,855 A 1/1967 Newhall
3,521,853 A 7/1970 Gillis, Jr. et al.
3,705,693 A 12/1972 Franz
3,746,256 A 7/1973 Hall et al.
3,750,961 A 8/1973 Franz
3,756,106 A 9/1973 Chadwick et al.
3,785,707 A 1/1974 Mitsuoka
3,789,741 A 2/1974 Hallberg
3,997,111 A 12/1976 Thomas et al.
3,999,384 A * 12/1976 Mohaupt ..... B05B 12/06 60/327
4,009,860 A 3/1977 Lingnau
4,026,322 A 5/1977 Thomas
4,042,178 A 8/1977 Veltrup et al.
4,162,763 A * 7/1979 Higgins ..... B05B 1/10 175/424
4,192,343 A 3/1980 Grahac
4,237,913 A 12/1980 Maasberg
4,256,139 A 3/1981 Huperz et al.
4,313,570 A 2/1982 Olsen
4,371,001 A 2/1983 Olsen
4,392,784 A 7/1983 Hanafi
4,435,902 A 3/1984 Mercer et al.
4,456,440 A 6/1984 Korner
4,573,886 A 3/1986 Maasberg et al.
4,594,924 A 6/1986 Windisch
4,634,353 A 1/1987 Huperz
4,648,215 A 3/1987 Hashish et al.
4,665,944 A 5/1987 Wallace et al.
4,776,769 A 10/1988 Hilaris
4,798,094 A 1/1989 Newhall et al.
4,818,194 A 4/1989 Saurwein
4,821,467 A 4/1989 Woodson et al.
4,852,800 A 8/1989 Murdock
4,893,753 A 1/1990 Munoz et al.
4,934,111 A 6/1990 Hashish et al.
4,955,164 A 9/1990 Hashish et al.
4,973,026 A 11/1990 Saurwein
5,018,670 A 5/1991 Chalmers
5,037,276 A 8/1991 Tremoulet, Jr.
5,037,277 A 8/1991 Tan
5,117,872 A 6/1992 Yie
5,186,393 A 2/1993 Yie
5,199,642 A * 4/1993 Rankin ..... B05B 1/1609 137/269
5,209,406 A 5/1993 Johnson
5,226,799 A 7/1993 Raghavan et al.
5,253,808 A * 10/1993 Pacht ..... B05B 1/1609 137/625.6
5,297,777 A 3/1994 Yie
5,320,289 A 6/1994 Hashish et al.
5,351,714 A 10/1994 Barnowski
5,380,159 A 1/1995 Olsen et al.
5,469,768 A 11/1995 Schumacher
5,524,821 A 6/1996 Yie et al.
5,557,154 A 9/1996 Erhart
5,564,469 A 10/1996 Tremoulet, Jr. et al.
5,636,789 A * 6/1997 Shook ..... B05B 1/1609 239/124
5,727,773 A 3/1998 Dunnigan
5,730,358 A 3/1998 Raghavan et al.
5,799,688 A 9/1998 Yie
5,848,880 A 12/1998 Helmig
5,904,297 A * 5/1999 Kendrick, Jr. ..... B05B 1/1681 239/124
5,927,329 A 7/1999 Yie
5,970,996 A 10/1999 Markey et al.
5,975,429 A * 11/1999 Jezek ..... B05B 1/1609 137/882
6,077,152 A 6/2000 Warehime
6,126,524 A 10/2000 Shepherd
6,220,529 B1 4/2001 Xu
6,244,927 B1 6/2001 Zeng
6,280,302 B1 8/2001 Hashish et al.
6,283,832 B1 * 9/2001 Shepherd ..... B24C 1/045 451/102
6,379,214 B1 4/2002 Stewart et al.
6,415,820 B1 7/2002 Gluf, Jr.
6,425,805 B1 7/2002 Massa et al.
6,431,465 B1 8/2002 Yie
6,588,724 B2 7/2003 Yie
6,684,133 B2 1/2004 Frye-Hammelmann et al.
6,705,921 B1 3/2004 Shepard
7,033,256 B2 4/2006 Miller
7,083,124 B2 8/2006 Bednorz et al.
7,094,135 B2 * 8/2006 Chisum ..... B24C 1/045 239/339
7,162,943 B1 1/2007 Reitmeyer et al.
7,464,630 B2 12/2008 Knaupp et al.
7,537,019 B2 5/2009 Ting et al.
7,594,614 B2 9/2009 Vijay et al.
7,896,726 B1 * 3/2011 Miller ..... B24C 9/00 451/10
7,938,713 B2 5/2011 Trieb et al.
8,240,634 B2 8/2012 Jarchau et al.
8,308,525 B2 11/2012 Hashish et al.
8,439,726 B2 5/2013 Miller
8,541,710 B2 9/2013 Brandt et al.
8,573,244 B2 11/2013 Taylor
8,651,920 B2 2/2014 Hashish
8,904,912 B2 12/2014 Raghavan et al.
9,095,955 B2 8/2015 Raghavan et al.
2003/0057295 A1 3/2003 Helmig
2003/0106591 A1 6/2003 Saurwein et al.
2003/0106594 A1 6/2003 Saurwein et al.
2003/0107021 A1 6/2003 Saurwein et al.
2004/0108000 A1 6/2004 Raghavan et al.
2005/0173815 A1 * 8/2005 Mueller ..... F02M 3/09 261/64.1
2006/0237672 A1 * 10/2006 Moreno ..... F16K 31/0655 251/129.02
2008/0169581 A1 * 7/2008 Fukushima ..... B23K 26/0093 264/219
2008/0282855 A1 * 11/2008 Kanai ..... B26D 7/01 83/22
2009/0013839 A1 * 1/2009 Kanai ..... B24C 1/00 83/13
2011/0135505 A1 6/2011 Kieninger et al.
2012/0091382 A1 * 4/2012 Yie ..... F16K 31/3835 251/337
2012/0199218 A1 8/2012 Gioberti et al.
2012/0217011 A1 8/2012 Dotson et al.
2012/0238188 A1 9/2012 Miller

(56) References Cited

U.S. PATENT DOCUMENTS

| | | | | |
|---|---|---|---|---|
| 2012/0252325 | A1* | 10/2012 | Schubert | B24C 1/045 451/60 |
| 2012/0252326 | A1* | 10/2012 | Schubert | B24C 1/045 451/60 |
| 2014/0087631 | A1 | 3/2014 | Raghavan et al. | |
| 2015/0053075 | A1* | 2/2015 | Rabhi | F04B 9/113 91/417 R |

FOREIGN PATENT DOCUMENTS

| | | | | |
|---|---|---|---|---|
| DE | 10214251 | | 8/2003 | |
| EP | 2236893 | | 1/2011 | |
| EP | 2236893 | A3 * | 1/2011 | F16L 27/06 |
| JP | 61222677 | | 10/1986 | |
| WO | 94025209 | | 11/1994 | |
| WO | 2013109473 | | 7/2013 | |

OTHER PUBLICATIONS

International Search Report and Written Opinion for PCT/US13/55475 filed Aug. 16, 2013, dated Dec. 6, 2013, 21 pages.

Miller, D.S., "New Abrasive Waterjet Systems to Compete With Lasers," 2005 WJTA American Waterjet Conference, Aug. 21-23, 2005, Houston, Texas, 11 pages.

U.S. Non-Final Office Action for U.S. Appl. No. 13/969,477, filed Aug. 16, 2013, dated Jun. 12, 2014, 45 pages.

* cited by examiner

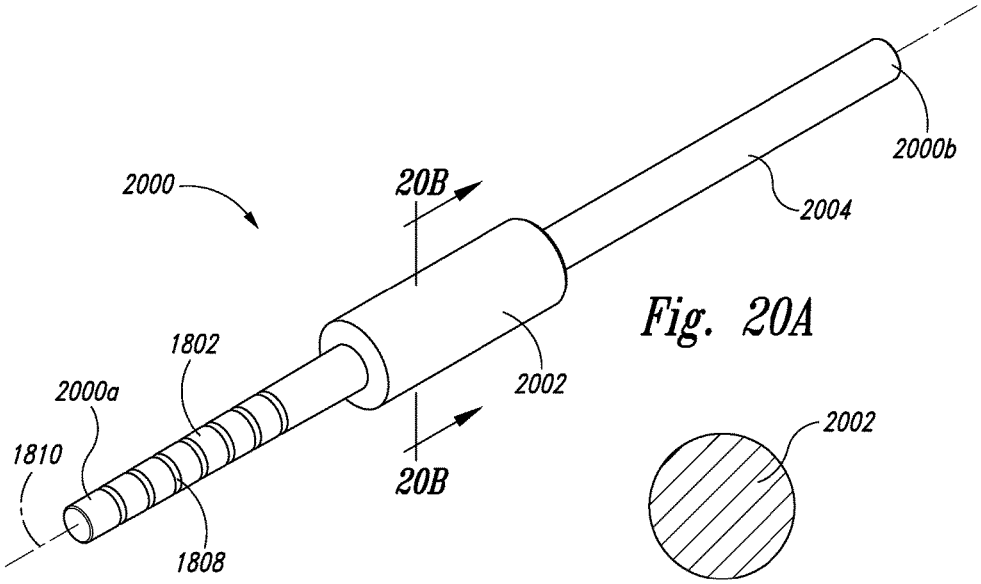
Fig. 20A
Fig. 20B
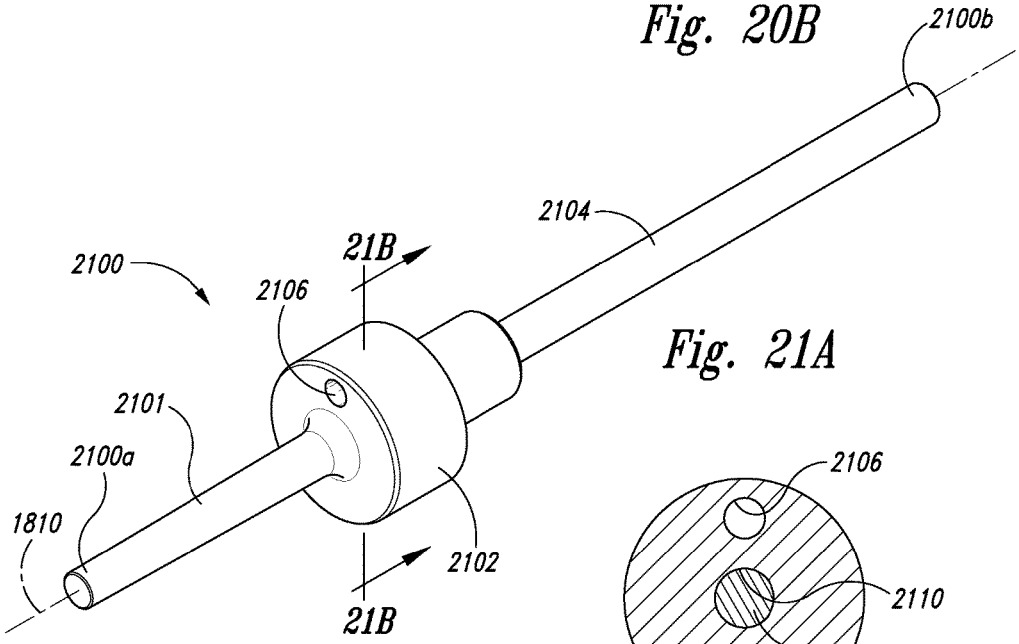
Fig. 21A
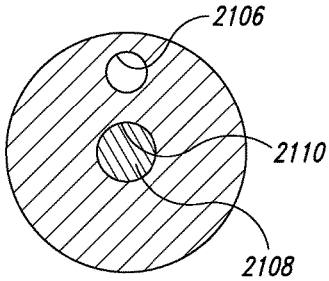
Fig. 21B

CONTROL VALVES FOR WATERJET SYSTEMS AND RELATED DEVICES, SYSTEMS, AND METHODS

CROSS-REFERENCE TO RELATED APPLICATIONS

This application is a Continuation of U.S. application Ser. No. 13/843,317, filed Mar. 15, 2013, now issued as U.S. Pat. No. 9,095,955, which claims the benefit of the following applications:

(a) U.S. Provisional Application No. 61/684,133, filed Aug. 16, 2012;

(b) U.S. Provisional Application No. 61/684,135, filed Aug. 16, 2012;

(c) U.S. Provisional Application No. 61/684,642, filed Aug. 17, 2012;

(d) U.S. Provisional Application No. 61/732,857, filed Dec. 3, 2012; and (e) U.S. Provisional Application No. 61/757,663, filed Jan. 28, 2013.

The foregoing applications are incorporated herein by reference in their entireties. To the extent the foregoing applications and/or any other materials incorporated herein by reference conflict with the present disclosure, the present disclosure controls.

TECHNICAL FIELD

The present technology is generally related to control valves for waterjet systems, control-valve actuators, waterjet systems (e.g., abrasive jet systems), and methods for operating waterjet systems.

BACKGROUND

Waterjet systems (e.g., abrasive jet systems) are used in precision cutting, shaping, carving, reaming, and other material-processing applications. During operation, waterjet systems typically direct a high-velocity jet of fluid (e.g., water) toward a workpiece to rapidly erode portions of the workpiece. Abrasive material can be added to the fluid to increase the rate of erosion. When compared to other material-processing systems (e.g., grinding systems, plasma-cutting systems, etc.) waterjet systems can have significant advantages. For example, waterjet systems often produce relatively fine and clean cuts, typically without heat-affected zones around the cuts. Waterjet systems also tend to be highly versatile with respect to the material type of the workpiece. The range of materials that can be processed using waterjet systems includes very soft materials (e.g., rubber, foam, leather, and paper) as well as very hard materials (e.g., stone, ceramic, and hardened metal). Furthermore, in many cases, waterjet systems are capable of executing demanding material-processing operations while generating little or no dust, smoke, and/or other potentially toxic byproducts.

In a typical waterjet system, a pump pressurizes fluid to a high pressure (e.g., 40,000 psi to 100,000 psi or more). Some of this pressurized fluid is routed through a cutting head that includes an orifice element having an orifice. Passing through the orifice converts static pressure of the fluid into kinetic energy, which causes the fluid to exit the cutting head as a jet at high velocity (e.g., up to 2,500 feet-per-second or more) and impact a workpiece. The orifice element can be a hard jewel (e.g., a synthetic sapphire, ruby, or diamond) held in a suitable mount (e.g., a metal plate). In many cases, a jig supports the workpiece. The jig, the cutting head, or both can be movable under computer and/or robotic control such that complex processing instructions can be executed automatically.

Certain materials, such as composite materials and brittle materials, may be difficult to process using conventional waterjet systems. For example, when a waterjet is directed toward a workpiece made of a composite material, the waterjet may initially form a cavity in the workpiece and hydrostatic pressure from the waterjet may act on sidewalls of the cavity. This can cause weaker parts of the workpiece to preferentially erode. In the case of layered composite materials, for example, hydrostatic pressure from a waterjet may erode binders between layers within the workpiece and thereby cause the layers to separate. As another example, when a waterjet is directed toward a workpiece made of a brittle material (e.g., glass), the load on the workpiece during piercing may cause the workpiece to spall and/or crack. Similarly, spalling, cracking and/or other damage can occur when waterjets are used to form particularly delicate structures in both brittle and non-brittle materials. Other properties of waterjets may be similarly problematic with respect to certain materials and/or operations.

One conventional technique for mitigating collateral damage to a workpiece (e.g., a workpiece made of a composite and/or brittle material) includes piercing the workpiece with a waterjet at a relatively low pressure (e.g., corresponding to a relatively low pressure upstream from an orifice) and then either maintaining the low pressure during the remainder of the processing or ramping the pressure upward after piercing the workpiece. At relatively low waterjet pressures, waterjet processing is often too slow to be an economically viable option for large-scale manufacturing. Furthermore, conventional techniques for ramping waterjet pressures upward (e.g., by ramping fluid pressure upstream from an orifice upward) can also be slow and typically decrease the operational life of at least some components of waterjet systems. For example, a conventional technique for ramping waterjet pressures upward includes controlling a pump and/or a relief valve to increase the pressure of all of the pressurized fluid within a waterjet system. With this technique, a variety of components of the system (e.g., valves, seals, conduits, etc.) are repeatedly exposed to the fluid at both low and high pressures. Over time, this pressure cycling can lead to fatigue-related structural damage to the components, which can cause the components to fail prematurely. Greater numbers of pressure cycles and greater pressure ranges within each cycle tend to exacerbate these negative effects. The costs associated with such wear (e.g., frequent part replacements, other types of maintenance, and system downtime) can make such approaches impractical for certain applications. For example, in material-processing applications that involve repeatedly starting and stopping a waterjet (e.g., to cut spaced-apart openings in a workpiece), ramping system pressures in each instance can cause unacceptable wear to conventional waterjet systems and make use of such systems for these applications cost prohibitive.

BRIEF DESCRIPTION OF THE DRAWINGS

Many aspects of the present disclosure can be better understood with reference to the following drawings. The relative dimensions in the drawings may be to scale with respect to some embodiments. With respect to other embodiments, the drawings may not be to scale. For ease of reference, throughout this disclosure identical reference numbers may be used to identify identical or at least generally similar or analogous components or features.

FIG. 20A is an enlarged isometric perspective view illustrating a relief valve stem configured in accordance with another embodiment of the present technology.

FIG. 20B is a cross-sectional end view taken along line 20B-20B in FIG. 20A.

FIG. 21A is an enlarged isometric perspective view a relief valve stem configured in accordance with another embodiment of the present technology.

FIG. 21B is a cross-sectional end view taken along line 21B-21B in FIG. 21A.

DETAILED DESCRIPTION

Figure 1A:
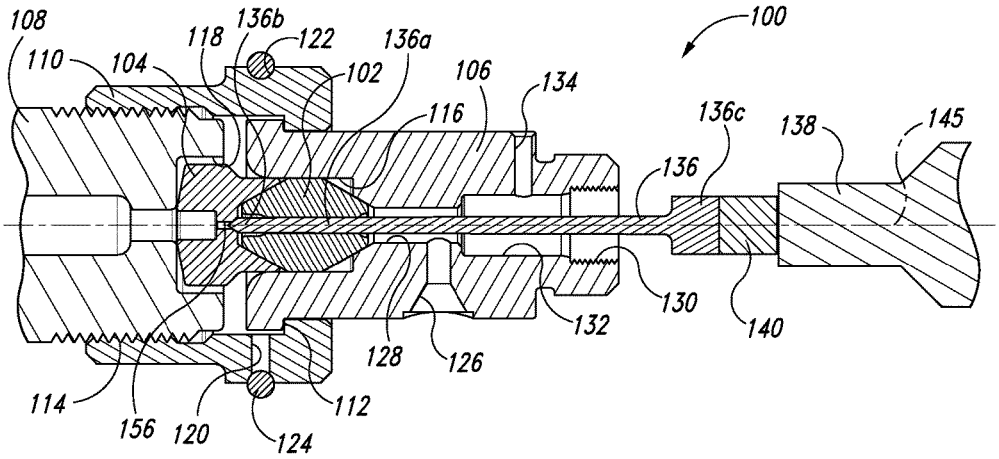
FIG. 1A is a cross-sectional side view illustrating a control valve including a pin at a shutoff position configured in accordance with an embodiment of the present technology.

Specific details of several embodiments of the present technology are disclosed herein with reference to FIGS. 1A-24. Although the embodiments are disclosed herein primarily or entirely with respect to waterjet applications, other applications in addition to those disclosed herein are within the scope of the present technology. For example, control valves configured in accordance with at least some embodiments of the present technology can be useful in various high-pressure fluid-conveyance systems. Furthermore, waterjet systems configured in accordance with embodiments of the present technology can be used with a variety of suitable fluids, such as water, aqueous solutions, hydrocarbons, glycol, and liquid nitrogen, among others. As such, although the term "waterjet" is used herein for ease of reference, unless the context clearly indicates otherwise, the term refers to a jet formed by any suitable fluid, and is not limited exclusively to water or aqueous solutions. It should be noted that other embodiments in addition to those disclosed herein are within the scope of the present technology. For example, embodiments of the present technology can have different configurations, components, and/or procedures than those shown or described herein. Moreover, a person of ordinary skill in the art will understand that embodiments of the present technology can have configurations, components, and/or procedures in addition to those shown or described herein and that these and other embodiments can be without several of the configurations, components, and/or procedures shown or described herein without deviating from the present technology.

As used herein, the term "piercing," unless the context clearly indicates otherwise, refers to an initial striking, penetration, or perforation of a workpiece by a waterjet. As an example, piercing may include removing a portion of a workpiece with a waterjet to a predetermined or non-predetermined depth and in a direction that is at least generally aligned with (e.g., parallel to) a longitudinal axis of the waterjet. As another example, piercing may include forming an opening or hole in an initial outer portion and/or one or more initial outer layers of a workpiece using a waterjet. As yet another example, piercing may include penetrating completely through a workpiece as a preparatory action prior to cutting a feature (e.g., a slot) in the workpiece. The term "cutting," unless the context clearly indicates otherwise, generally refers to removal of at least a portion of a workpiece using a waterjet in a direction that is not at least generally aligned with (e.g., parallel to) a longitudinal axis of the waterjet. However, in some instances, cutting may also include, after an initial piercing, continued material removal from a pierced region (e.g., an opening) using a waterjet in a direction that is at least generally aligned with (e.g., parallel to) a longitudinal axis of the waterjet. The headings provided herein are for convenience only and should not be construed as limiting the subject matter disclosed herein.

Selected Examples of Control Valves

FIG. 1A is a cross-sectional side view illustrating a control valve 100 configured in accordance with an embodiment of the present technology. The control valve 100 can be configured for use at high pressure. For example, in at least some embodiments, the control valve 100 has a pressure rating or is otherwise configured to use at pressures greater than about 20,000 psi (e.g., within a range from about 20,000 psi to about 120,000 psi), greater than about 40,000 psi (e.g., within a range from about 40,000 psi to about 120,000 psi), greater than about 50,000 psi (e.g., within a range from about 50,000 psi to about 120,000 psi), greater than another suitable threshold, or within another suitable range. In the illustrated embodiment, the control valve 100 includes a first seat 102 and a complementary second seat 104. The control valve 100 can further include an upstream housing 106 extending at least partially around the first seat 102, a downstream housing 108 extending at least partially around the second seat 104, and a collar 110 extending between the upstream housing 106 and the downstream housing 108. A first engagement feature 112 operably positioned between the collar 110 and the upstream housing 106 can be fixed, and a second engagement feature 114 operably positioned between the collar 110 and the downstream housing 108 can be adjustable. For example, the first engagement feature 112 can be a flanged abutment and the second engagement feature 114 can include complementary threads. Alternatively, the first engagement feature 112 can be adjustable and the second engagement feature 114 can be fixed, the first and second engagement features 112, 114 can both be adjustable, or the first and second engagement features 112, 114 can both be fixed. Furthermore, the upstream and downstream housings 106, 108 can be integral with one another or adjustably or fixedly connectable without the collar 110.

The upstream housing 106 can include a first recess 116 shaped to receive at least a portion of the first seat 102. Similarly, the downstream housing 108 can include a second recess 118 shaped to receive at least a portion of the second seat 104. The second engagement feature 114 can be adjusted (e.g., rotated) in a first direction to reduce the distance or gap between the first and second recesses 116, 118 and thereby releasably secure the first and second seats 102, 104 between the upstream and downstream housings 106, 108 (e.g., in an abutting relationship with one another). Similarly, the second engagement feature 114 can be adjusted (e.g., rotated) in a second direction opposite to the first direction to increase the distance or gap between the first and second recesses 116, 118 and ultimately separate the upstream and downstream housings 106, 108 to thereby release the first and second seats 102, 104 from the control valve 100 (e.g., for replacement, inspection, etc.). The collar 110 can include a first weep hole 120 configured to allow any fluid leakage between the upstream and downstream housings 106, 108 to escape from the control valve 100. The collar 110 can further include an annular groove 122 that passes across an outside opening of the first weep hole 120 and accepts an o-ring 124.

In the illustrated embodiment, the upstream housing 106 includes a fluid inlet 126 that opens into a first chamber 128 operably positioned adjacent to and upstream from the first seat 102. The upstream housing 106 can further include a third recess 130 and a fourth recess 132, with the fourth recess 132 operably positioned between the first chamber 128 and the third recess 130. The fourth recess 132 can be configured to house a seal assembly (not shown) (e.g., a high-pressure seal assembly including static and/or dynamic sealing components), and the third recess 130 can be configured to house a retainer screw (not shown) configured to secure the seal assembly within the fourth recess 132. Similar to the collar 110, the upstream housing 106 can include a second weep hole 134 configured to allow any fluid leakage through the seal assembly to escape from the control valve 100. Furthermore, the control valve 100 can include a fluid filter (not shown) (e.g., a screen or mesh made of stainless steel or another suitable material) operably positioned in or at least proximate to the fluid inlet 126 or having another suitable position upstream from the first seat 102. In at least some cases, the control valve 100 can be susceptible to damage from particulates within fluid flowing through the control valve 100. The fluid filter can reduce the possibility of such particulates reaching the first and second seats 102, 104.

The control valve 100 can further include an elongated pin 136 (e.g., a tapered, at least generally cylindrical pin with a circular cross-section), a plunger 138, and a cushion 140 operably positioned between the pin 136 and the plunger 138. The pin 136 can include a shaft portion 136*a* extending through the first chamber 128 and into the first seat 102, an end portion 136*b* at one end of the shaft portion 136*a* operably positioned toward the second seat 104, and a base portion 136*c* at an opposite end of the shaft portion 136*a* operably positioned toward the cushion 140. In FIG. 1A, the pin 136 is at a shutoff position. As discussed in greater detail below, the end portion 136*b* of the pin 136 can interact with the second seat 104 to at least generally shutoff flow of fluid through the control valve 100, and the shaft portion 136*a* of the pin 136 can interact with the first seat 102 to vary the flow rate of the fluid passing through the control valve 100 (e.g., by throttling the fluid). Accordingly, in some embodiments, the end portion 136*b* of the pin 136 and the second seat 104 are configured for enhanced shutoff functionality, and the shaft portion 136*a* of the pin 136 and the first seat 102 are configured for enhanced throttling functionality. In other embodiments (e.g., as discussed below with reference to FIG. 7), the end and shaft portions 136*a*, 136*b* of the pin 136 and the first and second seats 102, 104 can have other purposes. Changing the flow rate of the fluid passing through the control valve 100 can change a pressure of the fluid upstream from an associated waterjet orifice (not shown) and, thus, a velocity of a waterjet exiting the orifice.

In some embodiments, the cushion 140 is configured to compress between the base portion 136*c* of the pin 136 and the plunger 138 when the pin 136 is at the shutoff position and the plunger 138 is at a position of maximum extension. In this way, the cushion 140 can reduce the possibility of the plunger 138 forcing the end portion 136*b* of the pin 136 against the second seat 104 with excessive force, which has the potential to damage the pin 136 and/or the second seat 104. Suitable materials for the cushion 140 can include, for example, ultra-high-molecular-weight polyethylene, polyurethane, and rubber, among others. In other embodiments, the cushion 140 may be absent and the base portion 136*c* of the pin 136 and the plunger 138 may directly abut one another or be connected in another suitable manner. Additional details and examples related to controlling actuation of the pin 136, including controlling force between the end portion 136*b* of the pin 136 and the second seat 104 are provided below.

Figure 1B:
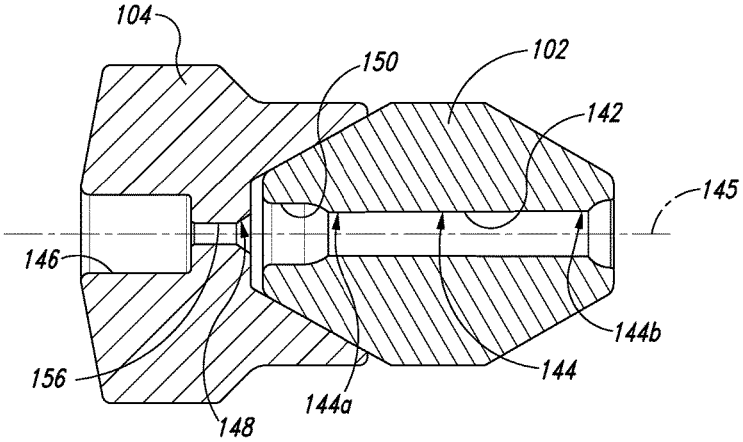
FIG. 1B is an enlarged cross-sectional side view illustrating first and second seats of the control valve shown in FIG. 1A.

FIG. 1B is an enlarged cross-sectional side view illustrating the first and second seats 102, 104 with other portions of the control valve 100 not shown for clarity. The first seat 102 can include a first passage 142 and a tapered inner surface 144 along at least a portion of the first passage 142. For example, the tapered inner surface 144 can have a first end portion 144*a* closest to the contact surface 148 and a second end portion 144*b* opposite to the first end portion 144*a*, and can be tapered inwardly toward a longitudinal axis 145 of the pin 136 from the second end portion 144*b* toward the first end portion 144*a*. Similarly, the second seat 104 can include a second passage 146 and a contact surface 148. The tapered inner surface 144 can have a suitable angle for throttling functionality. In at least some embodiments, the angle of the tapered inner surface 144 can be within a range from about 0.01 degree to about 2 degrees, within a range from about 0.1 degree to about 0.59 degree, within a range from about 0.1 degree to about 0.5 degree, or within another suitable range of angles relative to the longitudinal axis 145 of the pin 136. For example, in at least some embodiments, the tapered inner surface 144 can have an angle of about 0.5 degree relative to the longitudinal axis 145 of the pin 136. The contact surface 148 can have a suitable angle for receiving the end portion 136*b* of the pin 136 and at least generally shutting off fluid flow through the control valve 100. In at least some embodiments, the angle of the contact surface 148 can be within a range from about 15 degrees to about 90 degrees, within a range from about 20 degrees to about 40 degrees, within a range from about 25 degrees to about 35 degrees, or within another suitable range of angles relative to the longitudinal axis 145 of the pin 136. For example, the contact surface 148 can have an angle of about 30 degrees relative to the longitudinal axis 145 of the pin 136.

With reference to FIGS. 1A and 1B together, the tapered inner surface 144 can be spaced apart from the contact surface 148 in a direction parallel to the longitudinal axis 145 of the pin 136. For example, the first seat 102, the second seat 104, or both can at least partially define a second chamber 150 between the first end portion 144*a* of the tapered inner surface 144 and the contact surface 148. The first passage 142 can have a larger cross-sectional area at the second chamber 150 relative to the longitudinal axis 145 of the pin 136 than at the tapered inner surface 144. Spacing the tapered inner surface 144 and the contact surface 148 can be useful, for example, to facilitate manufacturing. For example, the first and second seats 102, 104 can be separately manufactured and then joined (e.g., in an interlocking configuration). In some embodiments, the first and second seats 102, 104 are adjustably connectable such that adjusting a connection between the first and second seats 102, 104 varies the spacing between the tapered inner surface 144 and the contact surface 148. In other embodiments, the first and second seats 102, 104 can be fixedly connected (e.g., by welding). The engagement feature operably positioned between the first and second seats 102, 104 can be at least partially compression fit, include complementary threads, or have another suitable form. In some cases, the first and second seats 102, 104 are detachable from one another and separately replaceable. In other cases, the first and second seats 102, 104 can be non-detachable from one another.

Figure 1C:
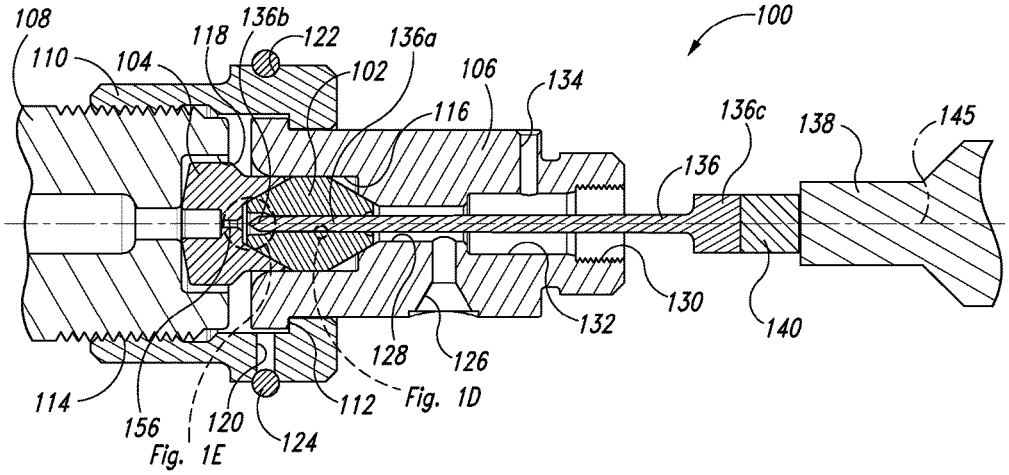
FIG. 1C is a cross-sectional side view illustrating the control valve shown in FIG. 1A with the pin at a given throttling position.
Figure 1D:
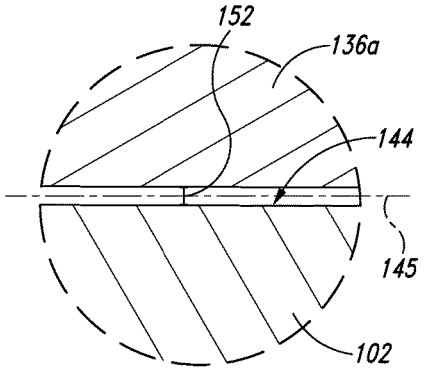
FIGS. 1D and 1E are enlarged views of portions of FIG. 1C.
Figure 1E:
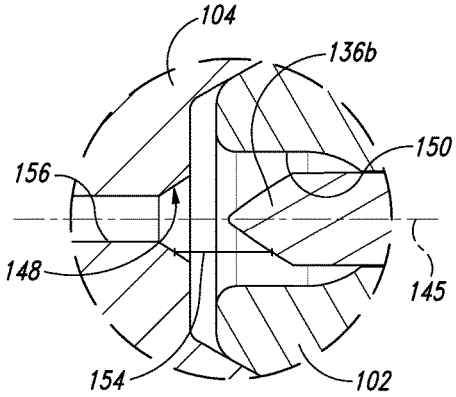

The pin 136 can be movable relative to the first and second seats 102, 104 between the shutoff position and one or more throttling positions in which the end portion 136*b* of the pin 136 is positioned away from the contact surface 148. For example, the pin 136 can be movable between the shutoff position and two or more throttling positions incrementally or infinitely varied within a range of throttling positions. FIG. 1C is a cross-sectional side view illustrating the control valve 100 with the pin 136 at a given throttling position. FIGS. 1D and 1E are enlarged views of portions of FIG. 1C. With reference to FIG. 1D, when the pin 136 is at the throttling position shown, the shaft portion 136*a* of the pin 136 and the tapered inner surface 144 can at least partially define a first gap 152 perpendicular to the longitudinal axis 145 of the pin 136 (e.g., a circumferential gap, an annular clearance, a free passage area, and/or the spacing between the shaft portion 136*a* of the pin 136 and the tapered inner surface 144). With reference to FIG. 1E, when the pin 136 is at the throttling position shown, the end portion 136*b* of the pin 136 and the contact surface 148 can at least partially define a second gap 154 parallel to the longitudinal axis 145 of the pin 136 (e.g., a longitudinal gap, a free passage area, and/or the spacing between the end portion 136*b* of the pin 136 and the contact surface 148). The second seat 104 can include a channel 156 along the second passage 146 adjacent to and downstream from the contact surface 148. The shaft and end portions 136*a*, 136*b* of the pin 136 can have outer surfaces angled to at least generally match the angles of the tapered inner surface 144 and the contact surface 148, respectively. For example, the shaft portion 136*a* of the pin 136 can have a tapered outer surface with an angle relative to the longitudinal axis 145 of the pin 136 about equal to an angle of the tapered inner surface 144 relative to the longitudinal axis 145 of the pin 136.

Moving the pin 136 from one throttling position to another throttling position can proportionally vary the first and second gaps 152, 154. For example, moving the pin 136 from one throttling position to another throttling position (e.g., left-to-right in FIG. 1C) can vary (e.g., increase) the annular cross-sectional area of the first gap 152 in a plane perpendicular to the longitudinal axis 145 of the pin 136. In this way, the first gap 152 can act as a throttling gap. The shapes of the end portion 136*b* of the pin 136, the shaft portion 136*a* of the pin 136, the tapered inner surface 144, and the contact surface 148 can be selected to cause the second gap 154 to be proportionally greater than the first gap 152 when the pin 136 is at a given throttling position. In at least some embodiments, the second gap 154 can be at least about 5 times greater (e.g., within a range from about 5 times to about 100 times greater), at least about 10 times greater (e.g., within a range from about 10 times to about 80 times greater), at least about 20 times greater (e.g., within a range from about 20 times to about 40 times greater), at least another suitable threshold multiple greater, or within another suitable range of multiples greater than the first gap 152 when the pin 136 is at a given throttling position. For example, in one embodiment, the second gap 154 is about 28 times greater than the first gap 152 when the pin 136 is at a given throttling position.

At the high pressures and velocities typically used in waterjet systems, components within waterjet systems can erode rapidly. This erosion can compromise important tolerances or even lead to component failure. Typically, both the speed of a fluid flowing past a solid surface and the surface area of the surface affect its rate of erosion. When the cross-sectional area of a flow passage is restricted for a given pressure, the speed of the fluid increases proportionally with the restriction. With these variables in mind, the shapes of the end portion 136*b* of the pin 136, the shaft portion 136*a* of the pin 136, the tapered inner surface 144, and the contact surface 148 can be selected to enhance the operation and/or lifespan of the control valve 100. For example, in most cases, when the pin 136 is at a given throttling position and the second gap 154 is greater than the first gap 152, the speed of the fluid flowing through the first gap 152 is proportionally greater than the speed of the fluid flowing through the second gap 154. The surface areas of the tapered inner surface 144 and the contact surface 148 can be selected to at least partially compensate for differences in erosion associated with these differences in speed. For example, the surface area of the tapered inner surface 144 can be selected to cause the erosion rate of the tapered inner surface 144 and an erosion rate of the contact surface 148 to be within about 50% of one another, within about 25% of one another, or otherwise at least generally equal. When the erosion rates of the tapered inner surface 144 and the contact surface 148 are at least generally equal, the overall control valve 100 can wear relatively evenly, which can improve the operation of the control valve 100 and/or increase the lifespan of the control valve 100. The surface area of the tapered inner surface 144 can be variable over a wide range by changing the length of the tapered inner surface 144. In general, larger surfaces erode more slowly than smaller surfaces. Thus, the surface area of the tapered inner surface 144 can be selected to be at least about 5 times (e.g., within a range from about 5 times to about 100 times), at least about 10 times (e.g., within a range from about 10 times to about 100 times), at least about 20 times (e.g., within a range from about 20 times to about 100 times), at least another suitable threshold multiple, or within another suitable range of multiples greater than the surface area of the contact surface 148.

With reference to FIG. 1C, the plunger 138 can be controlled by an actuator (not shown) of the control valve 100, and the pin 136 can be secured to the plunger 138 such that the actuator controls movement of the pin 136 (e.g., between a throttling position and the shutoff position and/or between two or more throttling positions) via the plunger 138. The actuator, for example, can have one or more of the features described below with reference to FIGS. 10-14B. In some embodiments, an adapter (not shown) attaches the base portion 136*c* of the pin 136 to the plunger 138 such that the actuator can both push and pull the pin 136 via the plunger 138. In other embodiments, the adapter can be absent and the base portion 136*c* of the pin 136 and the plunger 138 may be connected in another suitable manner. The first gap 152 can be slightly open when the pin 136 is at the shutoff position (e.g., the shaft portion 136*a* of the pin 136 and the tapered inner surface 144 can be slightly spaced apart along their lengths). Alternatively, the first gap 152 can be closed when the pin 136 is at the shutoff position (e.g., the shaft portion 136*a* of the pin 136 and the tapered inner surface 144 can be in contact along at least a portion of their lengths). The second gap 154 can be fully closed when the pin 136 is at the shutoff position shown in FIG. 1A (e.g., the end portion 136*b* of the pin 136 can contact the contact surface 148) and open when the pin 136 is at a given throttling position (e.g., the end portion 136*b* of the pin 136 can be spaced apart from the contact surface 148). When the first gap 152 is slightly open when the pin 136 is at the shutoff position, at least generally all of the force from the plunger 138 can be exerted against the contact surface 148. Even when the first gap 152 is closed when the pin 136 is at the shutoff position, a greater amount of force per surface area can be exerted against the contact surface 148 than against the tapered inner surface 144.

Relatively high compression force between the end portion 136*b* of the pin 136 and the contact surface 148 can be advantageous to facilitate complete or nearly complete sealing against fluid flow through the control valve 100. In at least some embodiments, the actuator and the contact surface 148 can be configured such that a compression force between the end portion 136*b* of the pin 136 and the contact surface 148 is at least about 75,000 psi (e.g., within a range from about 75,000 psi to about 200,000 psi), at least about 100,000 psi (e.g., within a range from about 100,000 psi to about 200,000 psi), at least another suitable threshold force, or within another suitable range of forces when the pin 136 is at the shutoff position. The second seat 104 can be configured to withstand this force. For example, in the illustrated embodiment, the contact surface 148 can be buttressed in a direction parallel to the longitudinal axis 145 of the pin 136 by a wall around the channel 156. The cross-sectional area of the second passage 146 can be smaller along a segment adjacent to and downstream from the contact surface 148 than another segment further downstream from the contact surface 148. The channel 156 can have a cross-sectional area adjacent to the contact surface 148 and perpendicular to the longitudinal axis 145 of the pin 136 less than about 75% (e.g., within a range from about 10% to about 75%), less than about 50% (e.g., within a range from about 10% to about 50%), less than another suitable threshold percentage, or within another suitable range of percentages of a cross-sectional area of the first passage 142 at the first end portion 144*a* of the tapered inner surface 144 and perpendicular to the longitudinal axis 145 of the pin 136.

Figure 2:
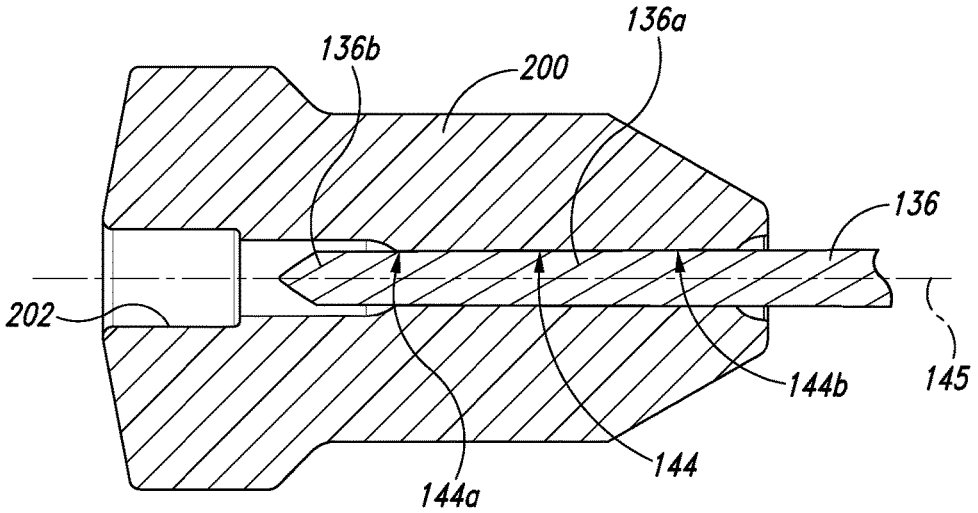
FIG. 2-9 are enlarged cross-sectional side views illustrating control-valve seats and pins configured in accordance with embodiments of the present technology.

FIGS. 2-9 are enlarged cross-sectional side views illustrating control-valve seats and pins configured in accordance with additional embodiments of the present technology. With reference to FIG. 2, a seat 200 can include a passage 202 and the tapered inner surface 144. The seat 200 can be configured for use without a complementary seat having the contact surface 148 (FIG. 1B). In these embodiments, an actuator (not shown) can be configured to press the shaft portion 136*a* of the pin 136 against the tapered inner surface 144 with sufficient force to at least generally shutoff flow of fluid though the passage 202. As discussed above, however, greater force is generally necessary to seal between larger surface areas. Furthermore, the tapers of the inner surface 144 and the shaft portion 136*a* of the pin 136 can make it difficult to achieve a sufficient sealing force without causing the pin 136 to become jammed within the passage 202 (e.g., without causing static friction between the tapered inner surface 144 and the shaft portion 136*a* of the pin 136 to exceed a maximum pulling force of the actuator). Accordingly, in some embodiments, the seat 200 is configured to throttle fluid between the tapered inner surface 144 and the shaft portion 136*a* of the pin 136 without being configured to shutoff flow of fluid though the passage 202. For example, shutting off flow of fluid though the passage 202 may be unnecessary (e.g., as discussed below with reference to FIG. 8).

Figure 3:
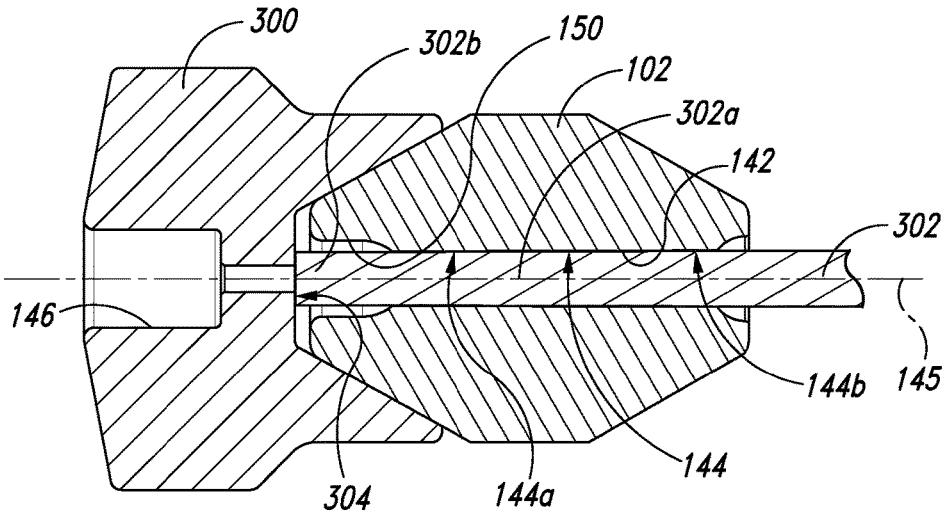
Figure 4:
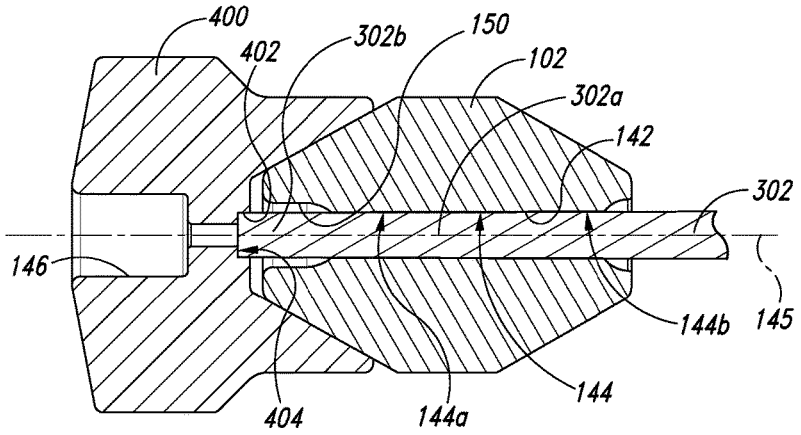

FIG. 3 illustrates the first seat 102, a second seat 300, and a pin 302 having a shaft portion 302*a* and an end portion 302*b*. The second seat 300 can have a contact surface 304 at least generally perpendicular to the longitudinal axis 145 of the pin 302, and the end portion 302*b* of the pin 302 can be flat or otherwise shaped to sealingly engage the contact surface 304. FIG. 4 illustrates the first seat 102, the pin 302, and a second seat 400 including an inset 402 and a contact surface 404 within the inset 402 configured to engage the end portion 302*b* of the pin 302. Seats and pins in other embodiments can have a variety of other suitable forms.

Figure 5:
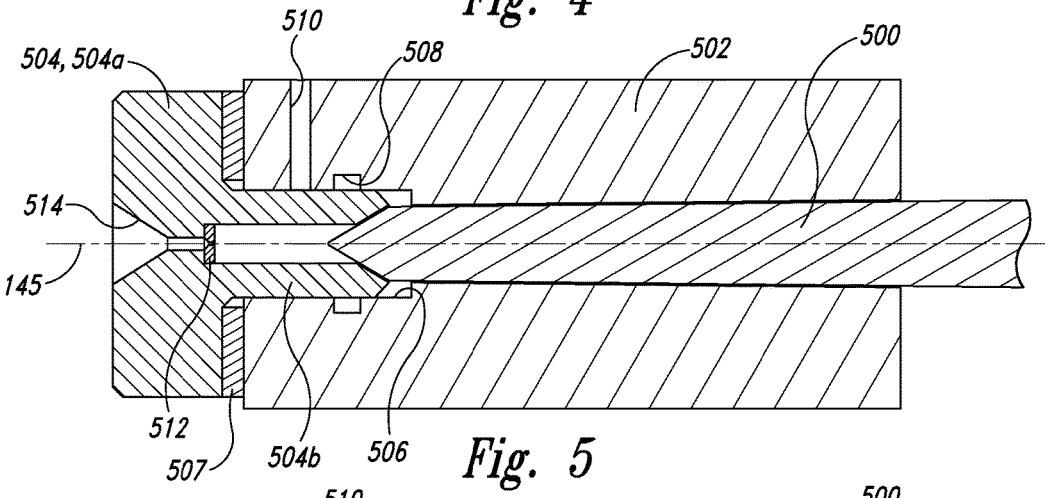
Figure 6:
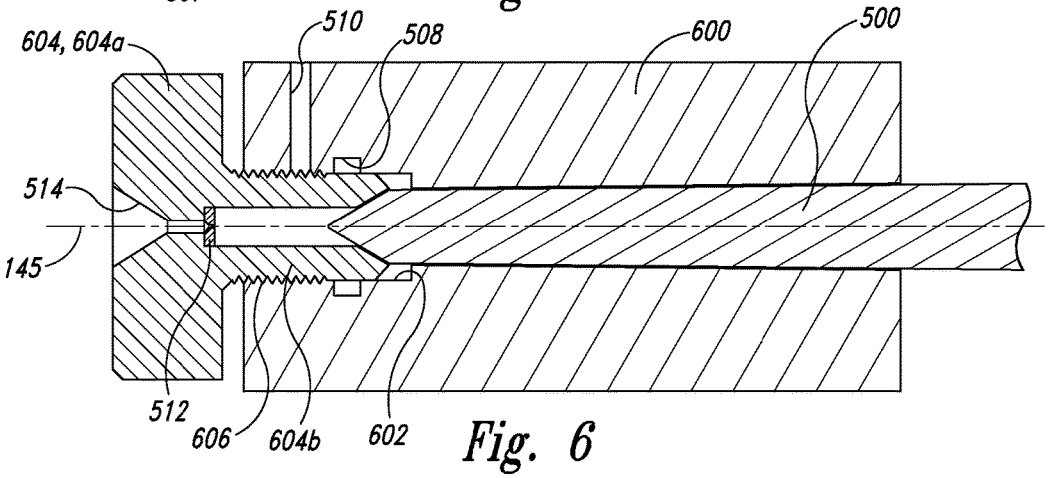

In the control valve 100 shown in FIGS. 1A-1E, the first seat 102 is partially inset within the second seat 104. In other embodiments, the second seat 104 can be partially inset within the first seat 102. For example, FIG. 5 illustrates a pin 500, a first seat 502, and a second seat 504 partially inset within the first seat 502. The second seat 504 can include a base portion 504*a* and a projecting portion 504*b*. The first seat 502 can include an opening 506 configured to receive the projecting portion 504*b* of the second seat 504. A spacer 507 (e.g., one or more shims) can be operably positioned between the first seat 502 and the base portion 504*a* of the second seat 504. The first seat 502 can include an annular recess 508 and a weep hole 510 connected to the opening 506. The annular recess 508 can be configured to receive a high-pressure seal (not shown). The second seat 504 can include an orifice element 512 downstream from the pin 500, and a waterjet outlet 514 downstream from the orifice element 512. FIG. 6 illustrates a first seat 600 including an opening 602 and a second seat 604 including a base portion 604*a* and a projecting portion 604*b*. The projecting portion 604*b* of the second seat 604 can be connected to the first seat 600 at an engagement feature 606 including complementary threads operably positioned within the opening 602. The spacer 507 (FIG. 5) and the engagement feature 606 (FIG. 6) can facilitate adjusting the relative positions of the first seats 502, 600 and the second seats 504, 604, respectively.

Figure 7:
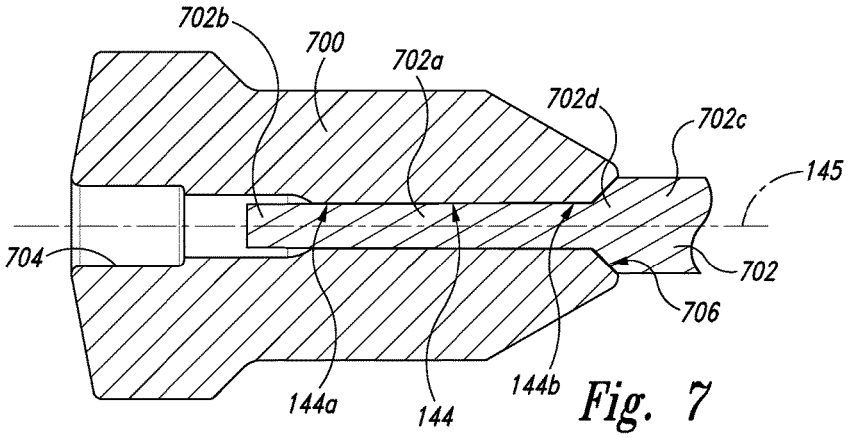

As discussed above with reference to FIGS. 1A-1E, in some embodiments, the contact surface 148 (FIG. 1B) is operably positioned downstream from the tapered inner surface 144 (FIG. 1B). In other embodiments, the contact surface 148 can be operably positioned upstream from the tapered inner surface 144. For example, FIG. 7 illustrates a seat 700 and a pin 702 partially received within a passage 704 of the seat 700. The seat 700 can include a contact surface 706 operably positioned upstream from the tapered inner surface 144. The pin 702 can include a first portion 702*a* operably positioned toward a downstream end portion 702*b*, a second portion 702*c* operably positioned toward an upstream end portion (not shown), and a third portion 702*d* therebetween. The downstream end portion 702*b* can be at least generally flat, conical, or have another suitable shape. The first portion 702*a* can be tapered and can be configured to interact with the tapered inner surface 144 to throttle fluid flow through the passage 704. The third portion 702*d* can be configured to interact with the contact surface 706 to shut off fluid flow through the passage 704.

Figure 8:
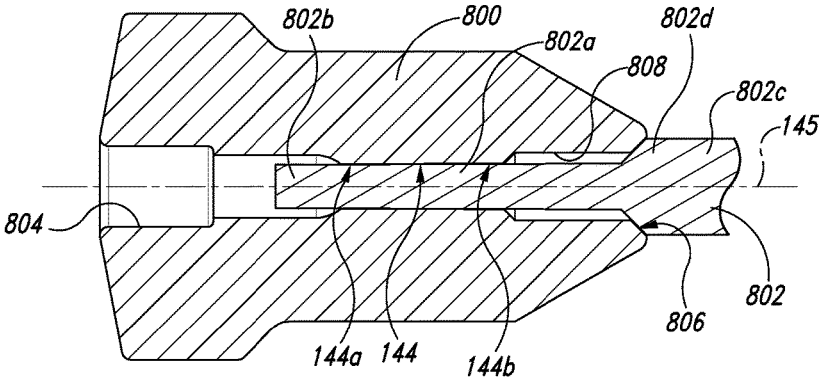

In the illustrated embodiment, the contact surface 706 is adjacent to the second end portion 144*b* of the tapered inner surface 144. In other embodiments, the contact surface 706 can be spaced apart from the second end portion 144*b* of the tapered inner surface 144. For example, FIG. 8 illustrates a seat 800 and a pin 802 partially received within a passage 804 of the seat 800. The seat 800 can include a contact surface 806 upstream from the tapered inner surface 144 and an enlarged opening 808 between the contact surface 806 and the tapered inner surface 144. The pin 802 can include a first portion 802*a* operably positioned toward a downstream end portion 802*b*, a second portion 802*c* operably positioned toward an upstream end portion (not shown), and a third portion 802*d* therebetween. The first portion 802*a* of the pin 802 can be longer than the first portion 702*a* of the pin 702 (FIG. 7) to extend through the enlarged opening 808.

Figure 9:
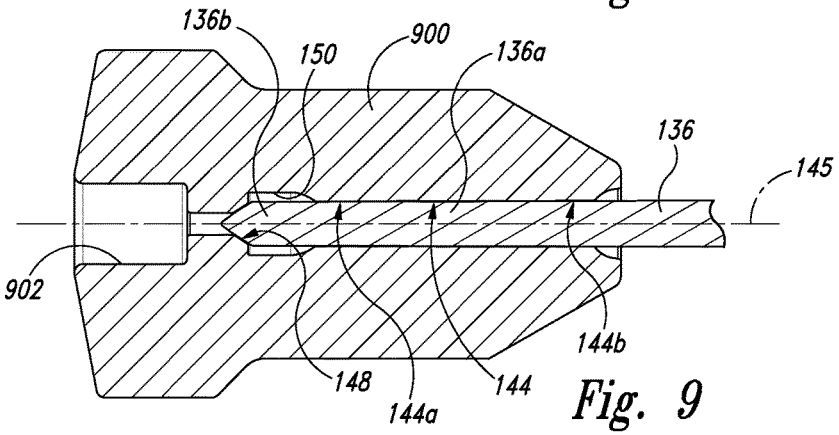

Positioning the contact surface 806 at an upstream end of the passage 804 may facilitate manufacturing the seat 800 as a single piece. Accordingly, in the illustrated embodiment, the seat 800 is at least generally free of seams between the contact surface 806 and the tapered inner surface 144. In other embodiments, the seat 800 can be replaced with an upstream seat including the contact surface 806 and a downstream seat including the tapered inner surface 144 connected in a suitable manner (e.g., as discussed above in the context of connecting the first and second seats 102, 104 shown in FIG. 1B). The first and second seats 102, 104 shown in FIG. 1B may be a single piece without any seams. For example, FIG. 9 illustrates a seat 900 having a passage 902. In the illustrated embodiment, the contact surface 148 and the tapered inner surface 144 are part of a single piece with the contact surface 148 positioned downstream from the tapered inner surface 144.

With reference to FIGS. 1A-1E, although in some cases fluid flows through the control valve 100 from the fluid inlet 126 toward the second passage 146, in other cases fluid can flow through the control valve 100 in the opposite direction. Similarly, with reference to FIGS. 2-9, although in some cases fluid flows past the pins 136, 302, 500, 702 and 802 in the same direction as the direction in which the pins 136, 302, 500, 702 and 802 taper inwardly (i.e., the direction in which the width of the pins 136, 302, 500, 702 and 802 decreases), in other cases, fluid can flow past the pins 136, 302, 500, 702 and 802 in the opposite direction. Accordingly, although some control-valve features and components described above and elsewhere in this disclosure are described with terms such as upstream, downstream, inlet, outlet, and the like, the opposite terms can be attributed to the features and components when flow is reversed. For example, the fluid inlet 126 can be a fluid outlet, the upstream housing 106 can be a downstream housing, and the downstream housing 108 can be an upstream housing. In some embodiments, the control valve 100 includes certain modifications to facilitate reverse flow. For example, the upstream housing 106 can be configured to be coupled to a cutting head (not shown) extending away from the upstream housing 106 toward a waterjet outlet (also not shown) such that fluid at a pressure controlled by the control valve exits the control valve 100 via the fluid inlet 126 and extends through the cutting head toward the waterjet outlet. In some embodiments, flowing fluid past the pins 136, 302, 500, 702 and 802 in the opposite direction as the direction in which the pins 136, 302, 500, 702 and 802 taper inwardly may be advantageous, such as to reduce or eliminate the tendency of pressure fluctuations in the fluid to destabilize positioning of the pins 136, 302, 500, 702 and 802 during use of the control valves. In other embodiments, flowing fluid past the pins 136, 302, 500, 702 and 802 in the same direction as the direction in which the pins 136, 302, 500, 702 and 802 taper inwardly may be advantageous, such as to reduce or eliminate encumbrance upon movement of a waterjet assembly relative to a workpiece.

Selected Examples of Control-Valve Actuators

Control valves configured in accordance with at least some embodiments of the present technology can include actuators (e.g., linear actuators) that precisely and accurately move a pin to one or more positions relative to a seat and at least generally maintain the pin at the position(s). In some cases, the actuators include electromechanical and/or hydraulic actuating mechanisms alone or in combination with pneumatic actuating mechanisms. In other cases, the actuators can be entirely pneumatic, or be configured to operate by one or more other suitable modalities. Suitable electromechanical actuating mechanisms can include, for example, stepper motors, servo motors with position feedback, direct-current motors with position feedback, and piezoelectric actuating mechanisms, among others. In a particular embodiment, a control valve includes an actuator having a Switch and Instrument Motor Model 87H4B available from Haydon Kerk Motion Solutions (Waterbury, Conn.).

Different types of actuating mechanisms can have different advantages when incorporated into control valves in accordance with embodiments of the present technology. For example, electromechanical and hydraulic actuating mechanisms are typically more resistant to moving in response to variable opposing forces than pneumatic actuating mechanisms. Pneumatic actuating mechanisms, however, typically operate more rapidly than hydraulic actuating mechanisms as well as many types of electromechanical actuating mechanisms. Furthermore, relative to electromechanical actuating mechanisms, pneumatic actuating mechanisms typically are better suited for precisely controlling the level of force on a pin. As discussed in further detail below, actuators configured in accordance with at least some embodiments of the present technology can have one or more features that reduce or eliminate one or more disadvantages associated with conventional actuators in the context of actuating the control valves discussed above with reference to FIGS. 1A-9 and/or other control values configured in accordance with embodiments of the present technology.

It can be useful for an actuator to have a combination of different actuating mechanisms. For example, with reference to FIGS. 1A-1E, the actuator (not shown) can move the pin 136 relative to the first and second seats 102, 104 through a range of positions between a shutoff position and a given throttling position. The actuator of the control valve 100 can include a first actuating mechanism (also not shown) (e.g., a hydraulic and/or electromechanical actuating mechanism) configured primarily to move the pin 136 from one throttling position to another throttling position, and a second actuating mechanism (also not shown) (e.g., a pneumatic actuating mechanism) configured to move the pin 136 through the range of throttling positions to and/or from the shutoff position. For example, the first actuating mechanism can be configured to exert a variable force on the pin 136 to at least partially counteract a variable opposing force on the pin 136, thereby maintaining the pin 136 at an at least generally consistent position during throttling. The second actuating mechanism can be configured to exert a more consistent force on the pin 136 than the first actuating mechanism so as to press the end portion 136*b* of the pin 136 against the contact surface 148 with an at least generally consistent force when the pin 136 is at the shutoff position. It can be useful to move the pin 136 through at least some of the throttling positions rapidly (e.g., to reduce erosion on the contact surface 148). Accordingly, the second actuating mechanism can be configured to move the pin 136 at a faster speed than the first actuating mechanism. In some embodiments, the second actuating mechanism can include a snap-acting-diaphragm, such as a metal snap-acting-diaphragm available from Hudson Technologies (Ormond Beach, Fla.). Snap-acting-diaphragms, for example, can facilitate rapid small-stroke actuating without sliding parts. In other embodiments, control valves configured in accordance with the present technology can utilize other types of actuators in other manners.

Figure 10:
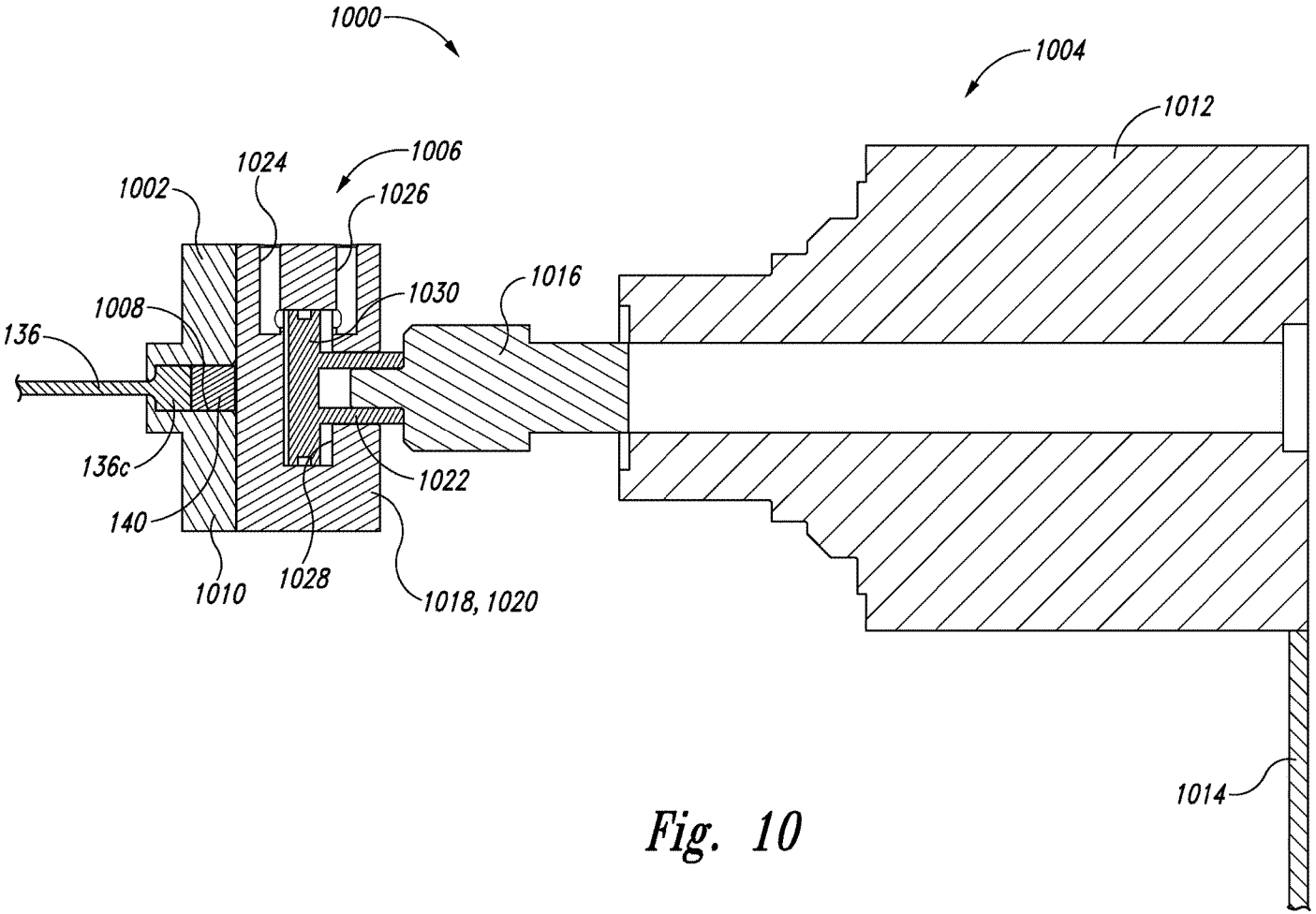
FIGS. 10 and 11 are cross-sectional side views illustrating control-valve actuators configured in accordance with embodiments of the present technology.

FIG. 10 is a cross-sectional side view illustrating a control-valve actuator 1000 configured in accordance with an embodiment of the present technology. The actuator 1000 can include an adapter 1002, a first actuating mechanism 1004, and a second actuating mechanism 1006 operably positioned between the adapter 1002 and the first actuating mechanism 1004. The adapter 1002 can include a central recess 1008 configured to receive both the base portion 136*c* of the pin 136 and the cushion 140. The adapter 1002 can further include a flange 1010 secured (e.g., bolted) to the second actuating mechanism 1006. The first actuating mechanism 1004 can include a stepper motor 1012 (shown without internal detail for clarity), a power cord 1014 (e.g., an electrical cord), and a first plunger 1016. The second actuating mechanism 1006 can include a pneumatic cylinder 1018 having a body 1020 and a second plunger 1022. The body 1020 can include a first fluid port 1024, a second fluid port 1026, and a chamber 1028 operably positioned between the first and second fluid ports 1024, 1026. The second plunger 1022 can include a piston 1030 configured to move back and forth within the chamber 1028. A difference between a pressure on one side of the piston 1030 associated with the first fluid port 1024 relative to a pressure on an opposite side of the piston 1030 associated with the second fluid port 1026 can cause the second plunger 1022 to move relative to the body 1020 so as to approach or achieve pressure equilibrium. In the illustrated embodiment, the first actuating mechanism 1004 is electromechanical and the second actuating mechanism 1006 is pneumatic. In other embodiments, the first actuating mechanism 1004 can be pneumatic and the second actuating mechanism 1006 can be electromechanical. In still other embodiments, the first and second actuating mechanisms 1004, 1006 can be the same type (e.g., electromechanical, hydraulic, pneumatic, etc.) with one or more different characteristics (e.g., force, travel, and/or resistance to static and/or dynamic loads).

Figure 11:
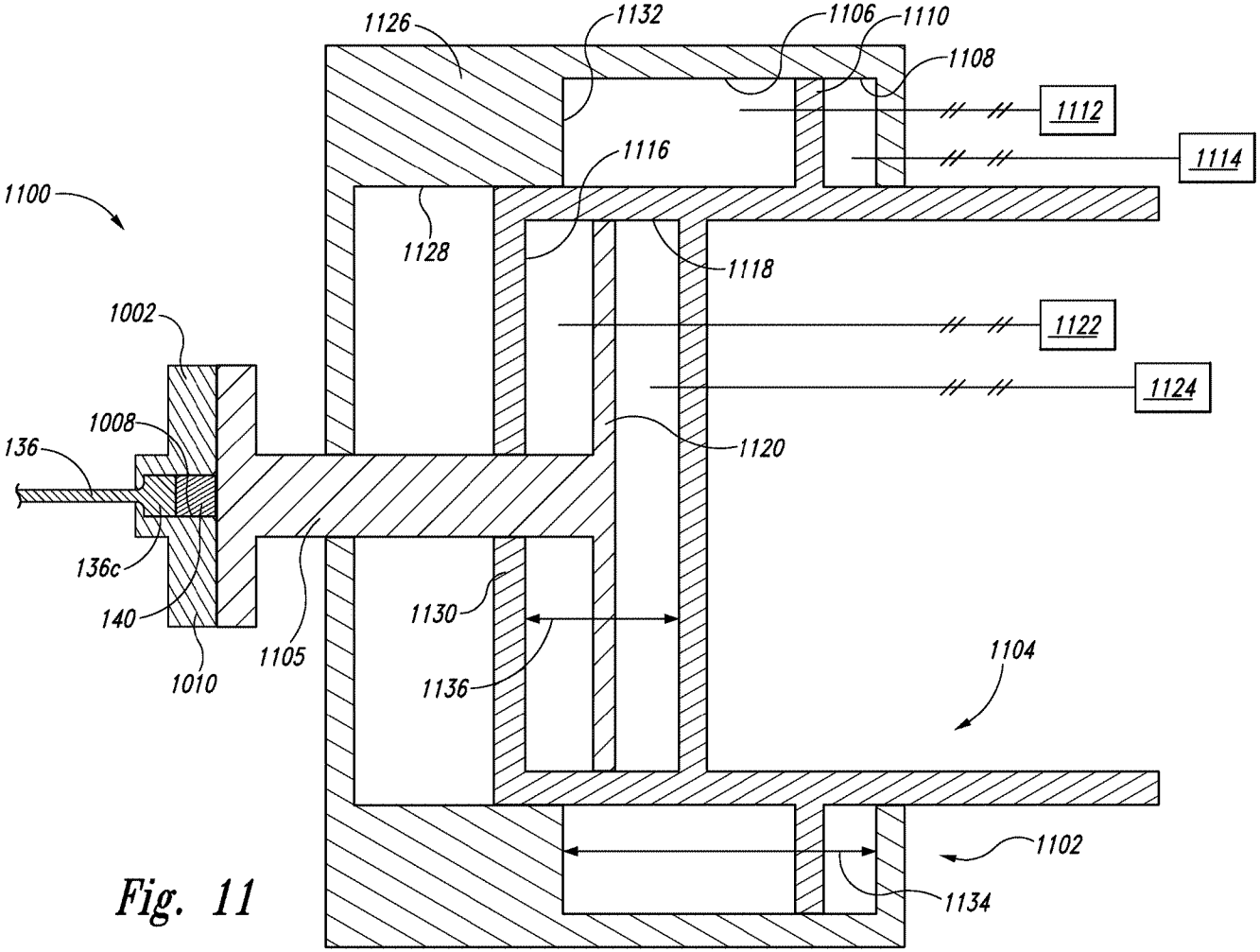

FIG. 11 is a cross-sectional side view illustrating a control-valve actuator 1100 configured in accordance with another embodiment of the present technology. The actuator 1100 can include a first pneumatic actuating mechanism 1102, a second pneumatic actuating mechanism 1104, and a plunger 1105. The first pneumatic actuating mechanism 1102 can include an annular first chamber portion 1106, an annular second chamber portion 1108, and a first piston 1110 operably positioned between the first chamber portion 1106 and the second chamber portion 1108. The first and second chamber portions 1106, 1108 can be operably connected to first and second pneumatic regulators 1112, 1114, respectively, for controlling pneumatic flow into and out of the first and second chamber portions 1106, 1108, respectively. The second pneumatic actuating mechanism 1104 can include a cylindrical third chamber portion 1116, a cylindrical fourth chamber portion 1118, and a second piston 1120 operably positioned between the third and fourth chamber portions 1116, 1118. The third and fourth chamber portions 1116, 1118 can be operably connected to third and fourth pneumatic regulators 1122, 1124, respectively. The plunger 1105 can be operably connected to the second piston 1120.

In at least some embodiments, the second pneumatic actuating mechanism 1104 can be at least partially inset within the first pneumatic actuating mechanism 1102. For example, the actuator 1100 can include an outer housing 1126 having a central channel 1128 (e.g., cylinder), and an inner housing 1130 at least partially defining the third and fourth chamber portions 1116, 1118. The inner housing 1130 can be slidably received within the central channel 1128. The outer housing 1126 can include an annular channel 1132 around the central channel 1128. The annular channel 1132 can at least partially define the first and second chamber portions 1106, 1108. The first piston 1110 can be annular and secured to the inner housing 1130 such that the first piston 1110 and the inner housing 1130 move together. For example, the first and second pneumatic regulators 1112, 1114 can cause a pressure difference on opposite sides of the first piston 1110 that causes the inner housing 1130 and the second piston 1120 (and hence the plunger 1105) to move relative to the outer housing 1126. The third and fourth pneumatic regulators 1122, 1124 can cause a pressure difference on opposite sides of the second piston 1120 that causes the second piston 1120 (and hence the plunger 1105) to move relative to the inner housing 1130 and the outer housing 1126.

The actuator 1100 can be configured to move the pin 136 between a shutoff position, a first throttling position, and at least a second throttling position. For example, the first pneumatic actuating mechanism 1102 can have a fully open position when the pressure in the first chamber portion 1106 is greater than the pressure in the second chamber portion 1108 causing the inner housing 1130 to move from left to right in FIG. 11, and a fully closed position when the pressure in the first chamber portion 1106 is less than the pressure in the second chamber portion 1108 causing the inner housing 1130 to move from right to left in FIG. 11. Similarly, the second pneumatic actuating mechanism 1104 can have a fully open position when the pressure in the third chamber portion 1116 is greater than the pressure in the fourth chamber portion 1118 causing the second piston 1120 to move from left to right in FIG. 11, and a fully closed position when the pressure in the third chamber portion 1116 is less than the pressure in the fourth chamber portion 1118 causing the second piston 1120 to move from right to left in FIG. 11. When the first and second pneumatic actuating mechanisms 1102, 1104 are fully closed or nearly fully closed, the pin 136 can be at or near the shutoff position. When the first pneumatic actuating mechanism 1102 is fully closed or nearly fully closed and the second pneumatic actuating mechanism 1104 is fully open or nearly fully open, the pin 136 can be at or near the first throttling position. When the first and second pneumatic actuating mechanisms 1102, 1104 are fully open or nearly fully open, the pin 136 can be at or near the second throttling position. In some embodiments, the first throttling position is selected to produce a waterjet (e.g., a relatively low-pressure waterjet) suitable for piercing a composite or brittle material (e.g., glass) and the second throttling position is selected to produce a more powerful waterjet suitable for rapidly cutting or otherwise processing a workpiece. In other embodiments, the actuator 1100 can include additional pneumatic or non-pneumatic actuating mechanisms (e.g., nested within the second pneumatic actuating mechanism 1104) configured to move relative to one another in suitable permutations so as to move the pin 136 between more than two throttling positions.

The first pneumatic actuating mechanism 1102 can have a first travel distance 1134 and the second pneumatic actuating mechanism 1104 can have a second travel distance 1136 less than the first travel distance 1134. For example, the first travel distance 1134 can be within a range from about 0.05 inch to about 0.5 inch, within a range from about 0.1 inch to about 0.3 inch, or within another suitable range. In a particular embodiment, the first travel distance 1134 is about 0.2 inch. The second travel distance 1136 can be, for example, within a range from about 0.001 inch to about 0.05 inch, within a range from about 0.005 inch to about 0.015 inch, or within another suitable range. In a particular embodiment, the second travel distance 1136 is about 0.01 inch. The ratio of the first travel distance 1134 to the second travel distance 1136 can be, for example, within a range from about 5:1 to about 50:1, within a range from about 10:1 to about 30:1, or within another suitable range. In a particular embodiment, the ratio of the first travel distance 1134 to the second travel distance 1136 is about 20:1. It can be useful for the first pneumatic actuating mechanism 1102 to be more powerful than the second pneumatic actuating mechanism 1104 for a given pneumatic fluid pressure. For example, the first piston 1110 can have a greater surface area exposed to pneumatic force than the second piston 1120.

With reference to FIGS. 1A, 1B, and 11 together, the force necessary to move the pin 136 typically decreases as the end portion 136*b* of the pin 136 approaches the contact surface 148. Thus, the force necessary to move the pin 136 a final incremental distance before it reaches the shutoff position can be relatively small. After the pin 136 reaches the shutoff position, it can be useful to avoid pressing the end portion 136*b* of the pin 136 against the contact surface 148 with excessive force (e.g., force in excess of a force necessary to achieve a suitable level of sealing) to avoid damaging the end portion 136*b* of the pin 136 and/or the contact surface 148 and/or jamming the pin 136 (e.g., such that the pin 136 becomes stuck due to friction). In at least some embodiments, the second pneumatic actuating mechanism 1104 is configured to apply a level of force selected for achieving a suitable contact force between the end portion 136*b* of the pin 136 and the contact surface 148 when the pin 136 is in the shutoff position. Additionally, the first pneumatic actuating mechanism 1102 can be configured to apply a higher level of force selected to overcome opposing force acting on the pin 136 when the pin 136 is in the first throttling position. In a particular embodiment, for example, the second pneumatic actuating mechanism 1104 is configured to apply about 400 pounds of force. When the second pneumatic actuating mechanism 1104 includes an electric motor, the motor can be configured to automatically slip or stall at a force lower than a force that would damage the end portion 136*b* of the pin 136 and/or the contact surface 148, but still greater than a force necessary to achieve a suitable level of sealing.

Figure 12A:
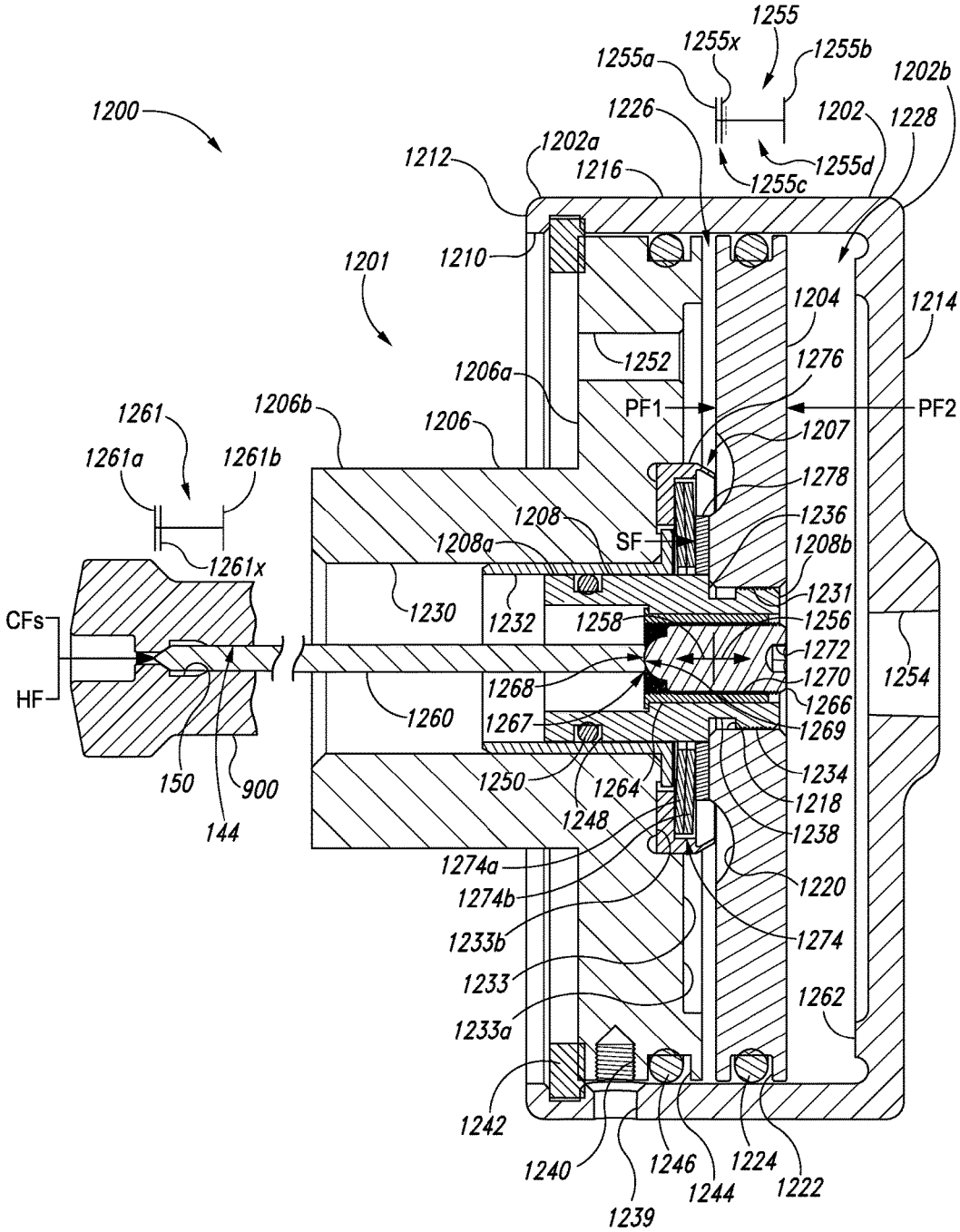
FIGS. 12A, 12B, and 12C are cross-sectional side views illustrating a portion of a control valve including an actuator having a movable member at a first end position, a given intermediate position, and a second end position, respectively, configured in accordance with an embodiment of the present technology.
Figure 12B:
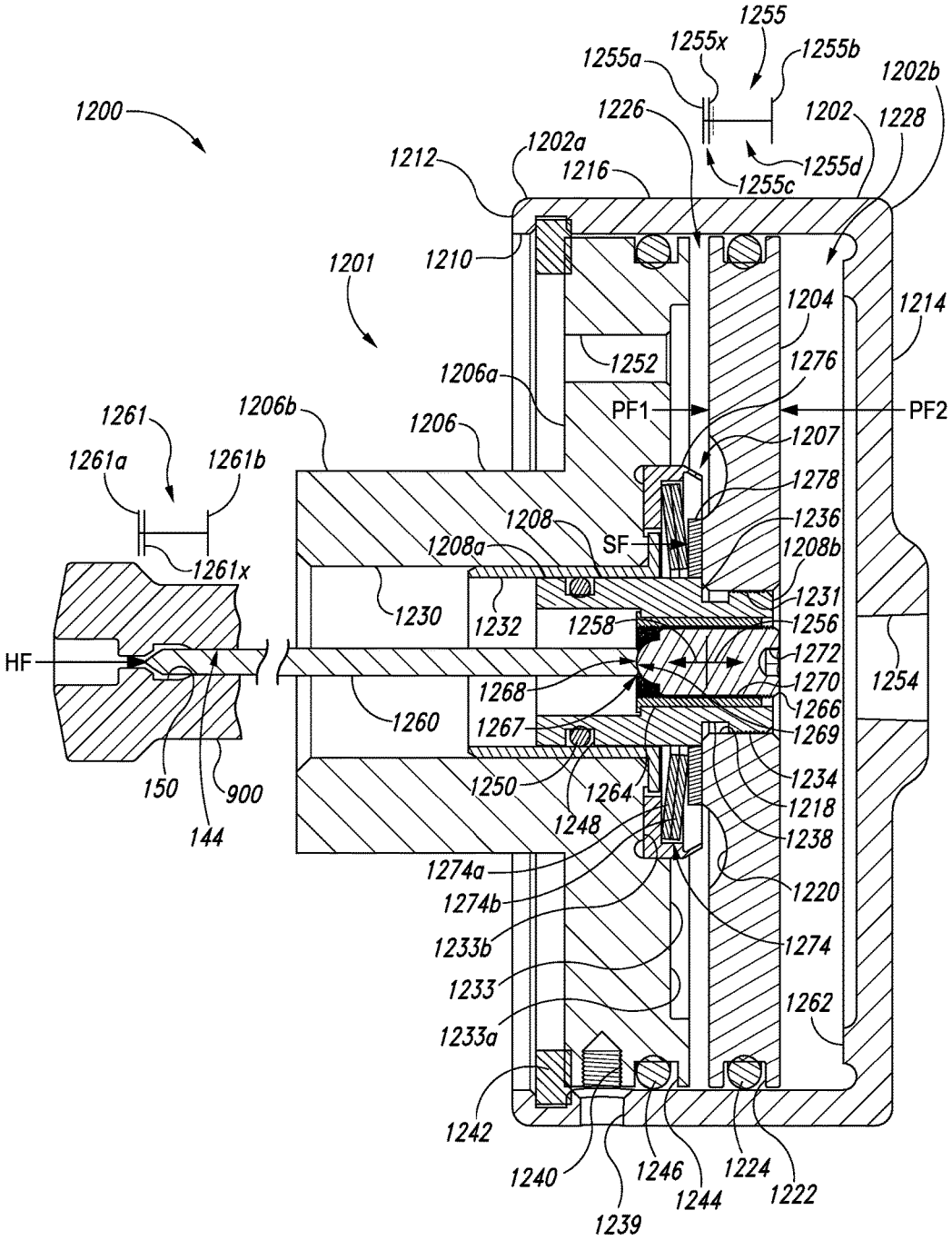
Figure 12C:
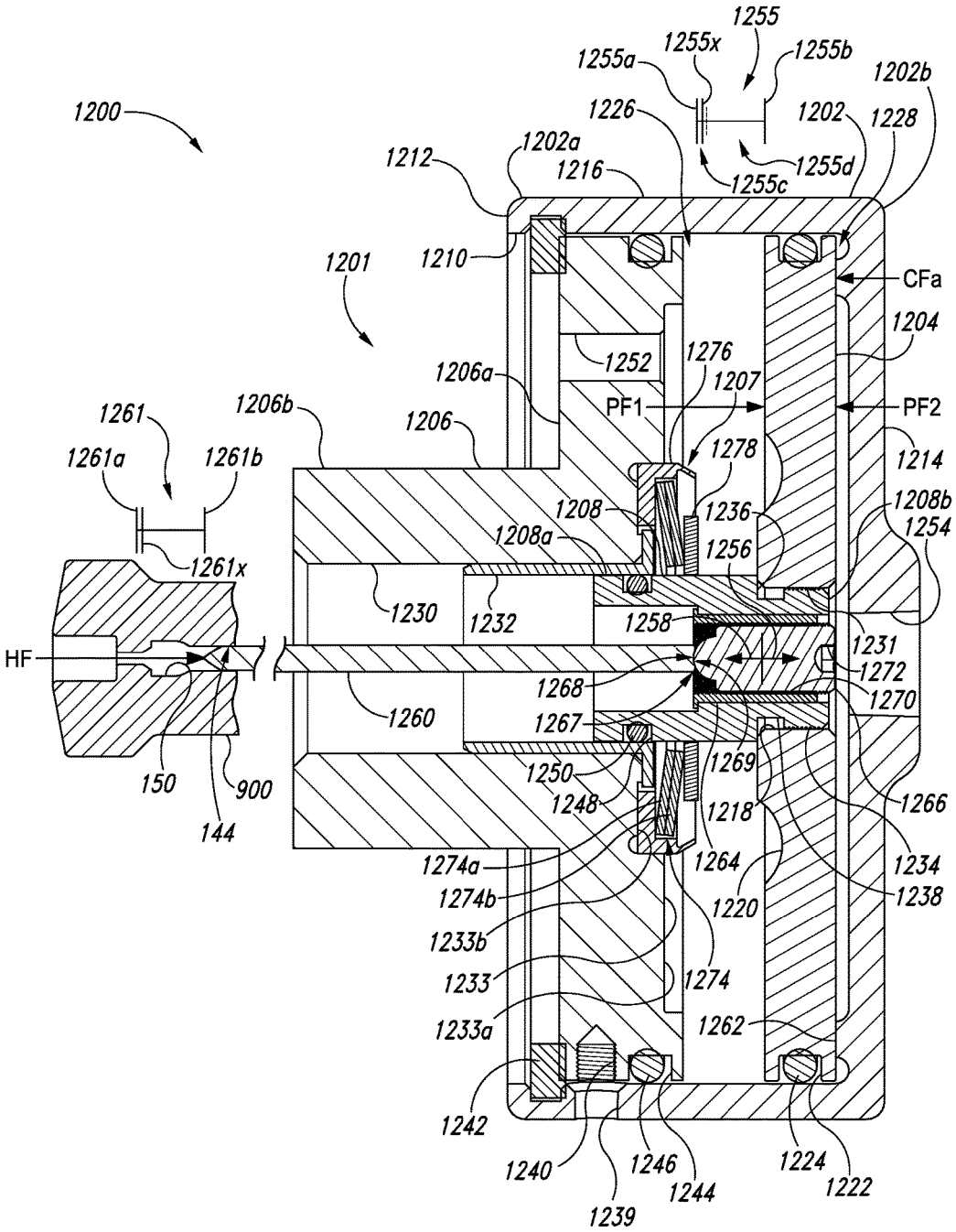

FIGS. 12A, 12B, and 12C are cross-sectional side views illustrating a portion of a control valve 1200 including an actuator 1201 configured in accordance with another embodiment of the present technology. The actuator 1201 can include an actuator housing 1202 having a first end 1202*a* and a second end 1202*b* opposite to the first end 1202*a*. The actuator 1201 can further include a movable member 1204 (e.g., a piston) slidably positioned within the actuator housing 1202 toward the second end 1202*b*, and a plunger guide 1206 operably positioned toward the first end 1202*a*. For example, the plunger guide 1206 can have a first portion 1206*a* secured within the actuator housing 1202 and a second portion 1206*b* extending out of the actuator housing 1202 beyond the first end 1202*a*. The actuator 1201 can further include a spring assembly 1207 secured to the plunger guide 1206, and a plunger 1208 secured to the movable member 1204 and partially slidably inset within the plunger guide 1206. The actuator housing 1202 can be at least generally cylindrical and can include a major opening 1210 at the first end 1202*a*, a lip 1212 around the major opening 1210, a cap 1214 at the second end 1202*b*, and a sidewall 1216 extending between the lip 1212 and the cap 1214. The movable member 1204 can be disk-shaped and can include a central bore 1218 and an annular groove 1220 facing toward the first end 1202*a*. The movable member 1204 can further include a first edge recess 1222 and a first sealing member 1224 (e.g., an o-ring) inset within the first edge recess 1222. The first sealing member 1224 can be configured to slide along an inner surface of the sidewall 1216 to form a movable pneumatic seal. For example, the actuator 1201 can include a first chamber 1226 and a second chamber 1228 at opposite sides of the movable member 1204, and the first sealing member 1224 can be configured to pneumatically separate the first and second chambers 1226, 1228.

The plunger guide 1206 can include a central channel 1230 and can be configured to slidingly receive a first end portion 1208*a* of the plunger 1208 while a second end portion 1208*b* of the plunger 1208 is secured to the movable member 1204 within the central bore 1218. For example, the plunger 1208 at the second end portion 1208*b* and the movable member 1204 at the central bore 1218 can include complementary first threads 1231. In the illustrated embodiment, the first end portion 1208*a* of the plunger 1208 is slidingly received within a smooth bushing 1232 of the plunger guide 1206 inserted into the central channel 1230. The plunger guide 1206 can further include a stepped recess 1233 extending around the central channel 1230 and facing toward the second end 1202*b*. The stepped recess 1233 can have a first portion 1233*a* spaced apart from the central channel 1230 and a concentric second portion 1233*b* positioned between the first portion 1233*a* and a perimeter of the central channel 1230. The second portion 1233*b* can be more deeply inset into the plunger guide 1206 than the first portion 1233*a*, and can be configured to receive the spring assembly 1207. The second end portion 1208*b* of the plunger 1208 can be part of a stepped-down segment 1234 of the plunger 1208, and the plunger 1208 can further include a ledge 1236 adjacent to the stepped-down segment 1234 as well as a circumferential groove 1238 operably positioned between the ledge 1236 and the first threads 1231. The movable member 1204 can be configured to contact the ledge 1236 around a perimeter of the central bore 1218 when the stepped-down segment 1234 is fully secured to the movable member 1204.

The actuator 1201 can be assembled, for example, by inserting the movable member 1204 (e.g., with the plunger 1208 secured to the movable member 1204) into the actuator housing 1202 via the major opening 1210 and subsequently inserting the plunger guide 1206 into the actuator housing 1202 via the major opening 1210. Screws (not shown) (e.g., set screws) can be individually inserted through holes 1239 in the sidewall 1216 and into threaded recesses 1240 (one shown) distributed around the circumference of the first portion 1206*a* of the plunger guide 1206 to secure the plunger guide 1206 in position. The actuator 1201 can further include a retaining ring 1242 (e.g., a flexible gasket, a radially expandable clamp, or another suitable component) operably positioned between the lip 1212 and the first portion 1206*a* of the plunger guide 1206. The retaining ring 1242 can reduce vibration of the plunger guide 1206 during use or have another suitable purpose. The plunger guide 1206 can include a second edge recess 1244 and a second sealing member 1246 (e.g., an o-ring) operably positioned within the second edge recess 1244. Similarly, the plunger 1208 can include a third edge recess 1248 and a third sealing member 1250 (e.g., an o-ring) operably positioned within the third edge recess 1248. The second sealing member 1246 can be configured to engage the sidewall 1216 to form a fixed pneumatic seal, and the third sealing member 1250 can be configured to slide along an inner surface of the channel 1230 to form a movable pneumatic seal. In conjunction with the first sealing member 1224, the second and third sealing members 1246, 1250 can be configured to pneumatically seal the first chamber 1226.

The actuator 1201 can further include a first pneumatic inlet 1252 and a second pneumatic inlet 1254 operably connected to the first and second chambers 1226, 1228, respectively. In some embodiments, the actuator 1201 is configured to be controlled by changing the pressure of gas (e.g., air) within the first chamber 1226 while the pressure of gas (e.g., air) within the second chamber 1228 remains at least generally constant. In other embodiments, the actuator 1201 can be configured to be controlled by changing the pressure of gas within the second chamber 1228 while the pressure of gas within the first chamber 1226 remains at least generally constant, by changing the pressures of gases within both the first and second chambers 1226, 1228, or by another suitable procedure. Furthermore, one or both of the first and second chambers 1226, 1228 can be replaced with non-pneumatic mechanisms. For example, the first chamber 1226 can be replaced with a hydraulic mechanism and/or the second chamber 1228 can be replaced with a hydraulic mechanism or a mechanical spring, as discussed in greater detail below.

The movable member 1204 can be configured to move back and forth within the actuator housing 1202 from a first end position 1255*a* to a second end position 1255*b* and through a range of travel 1255 (indicated by a horizontal line in FIGS. 12A-12C) between the first and second end positions 1255*a*, 1255*b*. FIGS. 12A, 12B, and 12C illustrate the movable member 1204 at the first end position 1255*a*, a given intermediate position 1255*x* within the range of travel 1255, and the second end position 1255*b*, respectively. A change in an equilibrium between a first pneumatic force (PF1) acting against the movable member 1204 from gas within the first chamber 1226 and a second pneumatic force (PF2) acting against the movable member 1204 from gas within the second chamber 1228 can cause the movable member 1204 to move in a first direction 1256 or a second direction 1258 at least generally opposite to the first direction 1256. For example, the first and second pneumatic forces (PF1, PF2) can at least partially counteract one another such that increasing the first pneumatic force (PF1) relative to the second pneumatic force (PF2) tends to move the movable member 1204 in the first direction 1256 toward the second end position 1255*b* (FIG. 12C), and decreasing the first pneumatic force (PF1) relative to the second pneumatic force (PF2) tends to move the movable member 1204 in the second direction 1258 toward the first end position 1255*a* (FIG. 12A).

The actuator 1201 can be configured to change the spacing between the seat 900, or another suitable seat configured in accordance with an embodiment of the present technology, and an elongated pin 1260 of the control valve 1200. For example, the actuator 1201 can be configured to change the spacing between a minimum spacing 1261*a* and a maximum spacing 1261*b* and through a range of spacing 1261 (indicated by a horizontal line in FIGS. 12A-12C) between the minimum and maximum spacings 1261*a*, 1261*b*. In some embodiments, at the minimum spacing 1261*a*, the pin 1260 is at a shutoff position (e.g., at which the movable member 1204 is at the first end position 1255*a* illustrated in FIG. 12A) and in contact with the seat 900. The actuator 1201 can be configured to move the pin 1260 relative to the seat 900 in the first direction 1256 from the shutoff position toward a throttling position (e.g., at which the movable member 1204 is at the given intermediate position 1255*x* illustrated in FIG. 12B) and in the second direction 1258 from the throttling position toward the shut-off position. Furthermore, the actuator 1201 can be configured to move the pin 1260 relative to the seat 900 in the first direction 1256 from the throttling position toward a fully-open position (e.g., at which the movable member 1204 is at the second end position 1255*b* illustrated in FIG. 12C) and in the second direction 1258 from the fully-open position toward the throttling position. In other embodiments, at the minimum spacing 1261*a*, the pin 1260 can be spaced apart from the seat 900 and the actuator 1201 can be configured to change the spacing without causing the pin 1260 to contact the seat 900.

With reference to FIGS. 12A-12C, when the pin 1260 is in contact with the seat 900 at the minimum spacing 1261*a*, the seat 900 can exert a seat contact force (CFs) (FIG. 12A) against the movable member 1204 in the first direction 1256 via the pin 1260. Similarly, at the maximum spacing 1261*b*, the actuator housing 1202 can exert a housing contact force (CFh) (FIG. 12C) against the movable member 1204 in the second direction 1258. For example, the actuator housing 1202 can include a stopper 1262 (e.g., a single annular spacer or two or more spaced-apart pillars) configured to contact the movable member 1204 at the maximum spacing 1261*b*. Unlike force from a stepper motor or another type of positive-displacement mechanism, the second pneumatic force (PF2) from gas within the second chamber 1228 can remain at least generally constant when the pin 1260 moves into contact with the seat 900 and/or while the movable member 1204 moves within the range of travel 1255. Thus, at the minimum spacing 1261*a* between the seat 900 and the pin 1260, the actuator 1201 can be configured to repeatably exert an at least generally consistent force against the seat 900 via the pin 1260, thereby causing the corresponding seat contact force (CFs) to also be at least generally consistent. In this way, the actuator 1201 can reliably apply the seat contact force (CFs) to the seat 900 at a level sufficient to at least generally prevent flow of fluid though the control valve 1200, but still low enough to reduce or eliminate excessive wear on the seat 900 and/or the pin 1260 and/or jamming of the pin 1260.

In some embodiments, the actuator 1201 includes a non-pneumatic mechanism in place of or in addition to the second chamber 1228. For example, the actuator 1201 can include a hydraulic mechanism configured to exert a consistent or variable hydraulic force or a mechanical spring configured to exert a consistent or variable spring force against the movable member 1204 in the second direction 1258 in place of or in addition to the second pneumatic force (PF2). Like pneumatic force, hydraulic and spring forces can remain at least generally constant when corresponding displacement is abruptly obstructed (e.g., when the pin 1260 contacts the seat 900). As discussed above, however, pneumatic actuating mechanisms typically operate more rapidly than hydraulic actuating mechanisms and can have other advantages when used in waterjet systems. Relative to pneumatic force, spring force from a mechanical spring can be more difficult to adjust and can complicate design or operation of the actuator 1201 by changing relative to displacement of the movable member 1204.

The plunger 1208 can include an adjustment bushing 1264 and a plug 1266 operably positioned within the adjustment bushing 1264. A position of a contact interface 1267 between the plunger 1208 and the pin 1260 can be adjustable relative to a position of the movable member 1204 along an adjustment axis (not shown) parallel to the first and second directions 1256, 1258. For example, the plug 1266 can have a convex end portion 1268 that abuts a complementary concave end portion 1269 of the pin 1260 at the contact interface 1267. The position of the plug 1266 can be adjustable relative to the adjustment bushing 1264 along the adjustment axis. The adjustment bushing 1264 and the plug 1266 can include complementary second threads 1270, and the plug 1266 can be rotatable relative to the adjustment bushing 1264 to adjust the position of the contact interface 1267. The plug 1266 can include a socket 1272 (e.g., a hexagonal socket) shaped to receive a wrench or other suitable tool to facilitate this adjustment. Adjusting the position of the contact interface 1267 can be useful, for example, to at least partially compensate for manufacturing irregularities in the pin 1260 or to otherwise facilitate calibration of the control valve 1200 after initial installation or replacement of the pin 1260 and/or the seat 900. In at least some cases, controlling the position of the contact interface 1267 along the adjustment axis using the second threads 1270 can be more precise than a manufacturing tolerance of the length of the pin 1260. In a particular embodiment, the diameter of the plug 1266 is about 0.25 inch. The density of the second threads 1270 along the adjustment axis can be, for example, greater than about 20 threads-per-inch (e.g., from about 20 threads-per-inch to about 200 threads-per-inch), greater than about 40 threads-per-inch (e.g., from about 40 threads-per-inch to about 200 threads-per-inch), greater than about 60 threads-per-inch (e.g., from about 60 threads-per-inch to about 200 threads-per-inch), greater than another suitable threshold, or within another suitable range. For example, the density of the second threads 1270 along the adjustment axis can be about 80 threads-per-inch.

The spring assembly 1207 can include a resilient member 1274 configured to exert a spring force (SF) that at least partially counteracts the second pneumatic force (PF2). For example, the resilient member 1274 can be configured to exert the spring force (SF) against the movable member 1204 when the movable member 1204 is within a first portion 1255*c* (to the left of a dashed vertical line intersecting the range of travel 1255 in FIGS. 12A-12C) of the range of travel 1255 and not to exert the spring force (SF) against the movable member 1204 when the movable member 1204 is within a second portion 1255*d* (to the right of the dashed vertical line intersecting the range of travel 1255 in FIGS. 12A-12C) of the range of travel 1255. The first portion 1255*c* can be closer to the first end position 1255*a* than the second portion 1255*d* and shorter than the second portion 1255*d*. In some at least some embodiments, the spring force (SF) can be within a range from about 100 pounds to about 450 pounds, within a range from about 150 pounds to about 400 pounds, or within another suitable range of forces when the movable member 1204 is at the first end position 1255*a*. When the control valve 1200 is deployed within a waterjet system, a hydraulic force (HF) from fluid within or otherwise at the control valve 1200 (e.g., within the spacing between the seat 900 and the pin 1260) can act against the movable member 1204 in the first direction 1256. Force acting against the movable member 1204 in the first direction 1256 can tend to increase the spacing between the seat 900 and the pin 1260 and thereby open the control valve 1200, while force acting against the movable member 1204 in the second direction 1258 can tend to decrease the spacing and thereby close the control valve 1200. As discussed above, counteracting the hydraulic force (HF) with a pneumatic force can be useful to cause the seat contact force (CFs) to be at least generally consistent.

Although useful to cause the seat contact force (CFs) to be at least generally consistent, counteracting the hydraulic force (HF) with a pneumatic force can also be problematic with respect to maintaining a consistent spacing between the seat 900 and the pin 1260. For example, in waterjet applications, after a particular intermediate spacing (e.g., corresponding to a desired pressure of fluid downstream from the seat 900) is achieved, it is typically desirable to at least generally maintain the spacing for a period of time during a cutting operation. The spacing and/or the hydraulic force (HF), however, typically fluctuate to some degree during this time due to vibration (e.g., associated with operation of a pump upstream from the control valve 1200) and/or other factors. Depending on the relationship between the hydraulic force (HF) and the spacing, this fluctuation can tend to destabilize the spacing when the hydraulic force (HF) is counteracted with pneumatic force. The actuator 1201 can be configured to use the resilient member 1274 to partially or completely overcome this problem.

In some embodiments, the resilient member 1274 is operably positioned within the first chamber 1226 (e.g., the resilient member 1274 can be a compression spring operably positioned within the first chamber 1226). In other embodiments, the resilient member 1274 can have another suitable location. For example, the resilient member 1274 can be operably positioned within the second chamber 1228 (e.g., the resilient member 1274 can be an expansion spring operably positioned within the second chamber 1228). The resilient member 1274 can also have a variety of suitable forms. With reference to FIGS. 12A-12C, the resilient member 1274 can include one or more Belleville springs. For example, in some embodiments, the spring assembly 1207 includes a first Belleville spring 1274*a* and a second Belleville spring 1274*b* stacked in series. In other embodiments, the spring assembly 1207 can include one Belleville spring, more than two Belleville springs, or two or more Belleville springs having a different arrangement (e.g., arranged at least partially in parallel). The spring assembly 1207 can further include a cup washer 1276 and a flat washer 1278, with the cup washer 1276 contacting one side of the resilient member 1274 facing toward the plunger guide 1206 and the flat washer 1278 contacting an opposite side of the resilient member 1274. A portion of the cup washer 1276 facing toward the movable member 1204 can extend into the annular groove 1220 when the movable member 1204 is at the first end position 1255*a*.

Belleville springs can be well suited for use in the actuator 1201 due to their relatively compact size, their desirable spring characteristics, and/or due to other factors. In some at least some embodiments, the first and second Belleville springs 1274*a*, 1274*b* individually can have a maximum deflection within a range from about 0.01 inch to about 0.05 inch, within a range from about 0.02 inch to about 0.04 inch, or within another suitable range. In a particular embodiment, the first and second Belleville springs 1274*a*, 1274*b* individually have a maximum deflection of about 0.03 inch. Instead of or in addition to Belleville springs, other embodiments can include other suitable types of mechanical springs (e.g., coil springs and machined springs, among others). For example, the first and second Belleville springs 1274*a*, 1274*b* can be replaced with one or more rings of coil springs partially inset within the plunger guide 1206. Furthermore, the first and second Belleville springs 1274*a*, 1274*b* and/or other suitable resilient members can be secured to a side of the movable member 1204 facing toward the plunger guide 1206 rather than to a side of the plunger guide 1206 facing toward the movable member 1204.

Figure 13A:
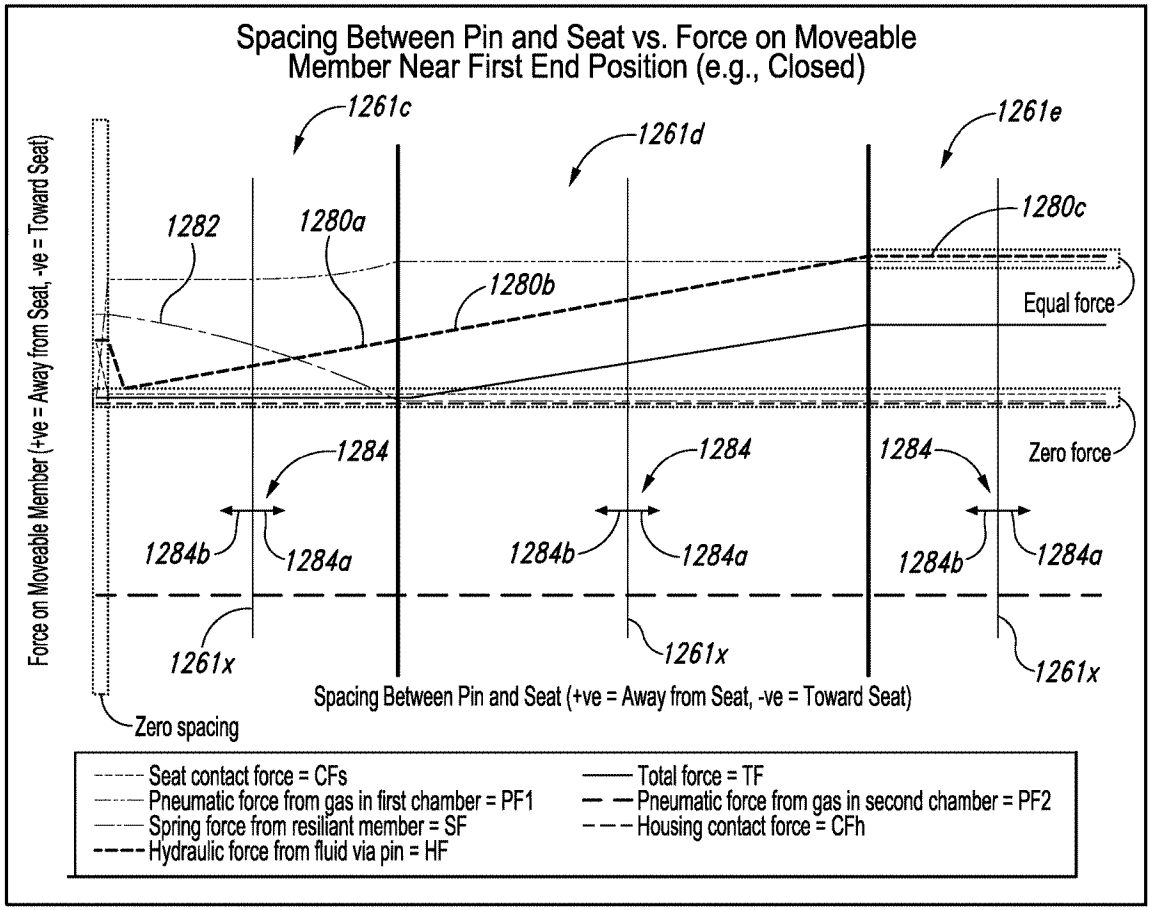
FIGS. 13A and 13B are plots of spacing between a pin and a seat of the control valve shown in FIGS. 12A-12C (x-axis) versus force on the movable member (y-axis) when the movable member is near the first end position and the second end position, respectively.
Figure 13B:
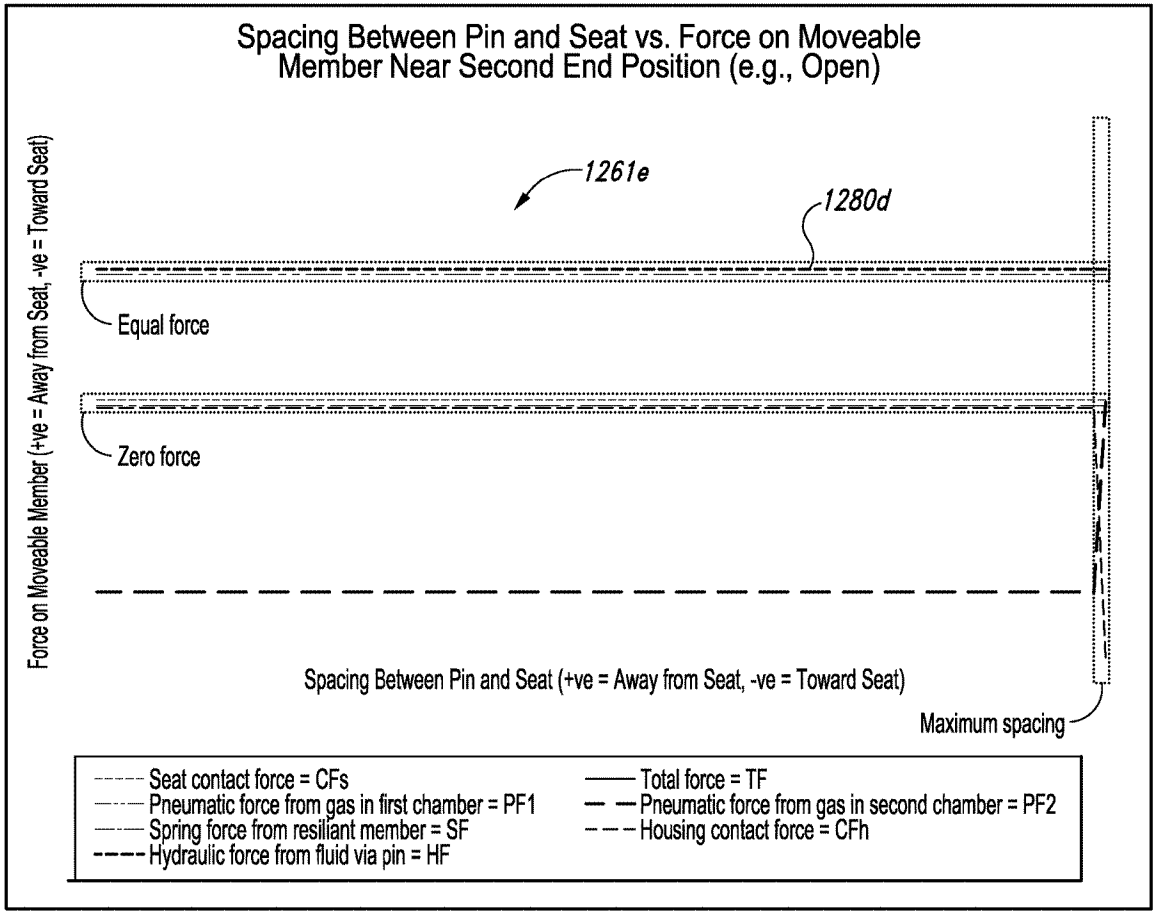

FIGS. 13A and 13B are plots of spacing between the pin 1260 and the seat 900 (x-axis) versus force on the movable member 1204 (y-axis). More specifically, FIG. 13A illustrates the relationships between these variables when the movable member 1204 is near the first end position 1255*a* (FIG. 12A) and FIG. 13B illustrates the relationships between these variables when the movable member 1204 is near the second end position 1255*b* (FIG. 12C). In FIGS. 13A and 13B, positive force values tend to increase the spacing between the pin 1260 and the seat 900, and negative force values tend to decrease the spacing between the pin 1260 and the seat 900. The x-axis at zero force on the movable member 1204 is enlarged in FIGS. 13A and 13B to facilitate illustration (e.g., to avoid depicting overlapping lines). Similarly, the y-axis at the minimum spacing 1261*a* in FIG. 13A and the y-axis at the maximum spacing 1261*b* in FIG. 13B are enlarged to facilitate illustration (e.g., to better illustrate sudden changes in the forces at these spacings). In should be understood that FIGS. 13A and 13B reflect expected relationships between various forces on the movable member 1204 during one example of operation of the control valve 1200 within a waterjet system. These forces (including their relationships) can change depending on the configuration of the control valve 1200, the operation of the waterjet system, and other factors.

At a first portion 1261*c* (FIG. 13A), a second portion 1261*d* (FIG. 13A), and a third portion 1261*e* (FIGS. 13A and 13B) of the range of spacing 1261 successively positioned further from the minimum spacing 1261*a*, the hydraulic force (HF) can vary along a first hydraulic force gradient 1280*a*, a second hydraulic force gradient 1280*b*, and a third hydraulic force gradient 1280*c*, respectively. At the first portion 1261*c*, the spring force (SF) can vary along a spring force gradient 1282. In at least some cases, increasing the spacing increases the hydraulic force (HF) and decreasing the spacing decreases the hydraulic force (HF) along the first and second hydraulic force gradients 1280*a*, 1280*b*, while changing the spacing has little or no effect on the hydraulic force (HF) along the third hydraulic force gradient 1280*c*. The spring force (SF) can decrease as the movable member 1204 moves in the first direction 1256 and increase as the movable member 1204 moves in the second direction 1258 along the spring force gradient 1282.

At given intermediate spacings 1261*x* (indicated by vertical lines in FIG. 13A) within the first, second, and third portions 1261*c*-1261*e* individually, spontaneous fluctuations 1284 (indicated by horizontal lines in FIG. 13A) in the spacing can occur. The fluctuations 1284 can be relatively small (e.g., less than about 0.001 inch) and can be positive fluctuations 1284*a* (i.e., increases in the spacing) or negative fluctuations 1284*b* (i.e., decreases in the spacing), both of which are indicated by arrows in FIG. 13A. In at least some cases, fluctuations 1284 within the first and second portions 1261*c*, 1261*d* may tend to be destabilizing. For example, a fluctuation 1284 within the first or second portions 1261*c*, 1261*d* can trigger a change in the hydraulic force (HF) that tends to reinforce the fluctuation 1284, thereby causing the movable member 1204 to accelerate in the first or second direction 1256, 1258 as well as causing a corresponding uncontrolled increase or decrease in the spacing. Within the first and second portions 1261*c*, 1261*d*, positive fluctuations 1284*a* can be reinforced by corresponding increases in the hydraulic force (HF) and negative fluctuations 1284*b* can be reinforced by corresponding decreases in the hydraulic force (HF). In many waterjet and other applications, sustained operation at spacings within at least the first portion 1261*c* can be desirable (e.g., to achieve certain pressures downstream from the seat 900).

The resilient member 1274 discussed above with reference to FIGS. 12A-12C can be configured to increase the stability of the spacing between the pin 1260 and the seat 900 by at least partially counteracting changes in the hydraulic force (HF). For example, within the first portion 1261*c*, the spring force gradient 1282 can at least partially reverse the destabilizing effect of the first hydraulic force gradient 1280*a*. At the given intermediate spacing 1261*x* within the first portion 1261*c*, a positive fluctuation 1284*a* can cause a decrease in the spring force (SF) (e.g., by decreasing compression of the resilient member 1274) about equal to or greater in magnitude than a corresponding increase in the hydraulic force (HF), and a negative fluctuation 1284*b* can cause an increase in the spring force (SF) (e.g., by increasing compression of the resilient member 1274) about equal to or greater in magnitude than a corresponding decrease in the hydraulic force (HF). By incorporating the resilient member 1274, therefore, the control valve 1200 can be capable of stable operation at spacings within the first portion 1261*c*. Within the second portion 1261*d*, the spring force (SF) can be zero (e.g., due to the resilient member 1274 being disengaged from the movable member 1204). Accordingly, stable operation of the control valve 1200 at spacings within the second portion 1261*d* may be difficult or impossible. The division between the first and second portions 1261*c*, 1261*d* can depend on the configuration of the actuator 1201. For example, the division between the first and second portions 1255*c*, 1255*d* of the range of travel 1255 can be modified (e.g., by shrinking, enlarging, and/or changing the location of the resilient member 1274) to modify the division between the first and second portions 1261*c*, 1261*d* of the range of spacing 1261.

At the leftmost portion of the plot in FIG. 13A, the pin 1260 can be in contact with the seat 900. At this state, the hydraulic force (HF) can be positive (e.g., due to fluid within the second chamber 150 reaching pressure equilibrium with fluid upstream from the seat 900 and exerting force on an exposed annular portion of the pin 1260 within the second chamber 150) and the first pneumatic force (PF1) can be zero. The negative second pneumatic force (PF2) can be equally counteracted by the sum of the positive spring force (SF), the positive hydraulic force (HF), and the positive seat contact force (CFs) such that the total force (TF) is zero and the movable member 1204 is stationary. The second pneumatic force (PF2) can have a magnitude in the second direction 1258 greater than a sum of the magnitudes of the hydraulic force (HF), the spring force (SF), and the first pneumatic force (PF1) in the first direction 1256 at the minimum spacing 1261*a* by a margin sufficient to cause a seat contact force (CFs) that at least generally prevents fluid from flowing through the control valve 1200.

Achieving a second pneumatic force (PF2) of sufficient magnitude to at least generally prevent fluid from flowing through the control valve 1200 can be challenging. For example, when standard pneumatic pressures are used (e.g., 90 psi) within the second chamber 1228, it can be difficult to achieve a second pneumatic force (PF2) of sufficient magnitude without making the actuator 1201 unduly large. The actuator 1201 can be operably connected to a cutting head (not shown) within a movable waterjet assembly. In at least some cases, decreasing the size of the actuator 1201 can enhance the maneuverability of the waterjet assembly relative to a workpiece (also not shown), a robotic arm (also not shown), and/or other objects coupled to or otherwise proximate to the waterjet assembly. For example, when the cutting head is tiltable, decreasing the size of the actuator 1201 can increase the tiltable range of the cutting head. Furthermore, using pressures greater than standard pneumatic pressures can significantly increase the cost and complexity of the actuator 1201. The resilient member 1274 can have one or more properties that reduce or eliminate this problem. For example, the resilient member 1274 can have an at least generally linear spring characteristic rather than a progressive spring characteristic (i.e., the rate of increase in the spring force (SF) can be at least generally constant within the first portion 1255*c* of the range of travel 1255 rather than increasing as the movable member 1204 approaches the first end position 1255*a*). Alternatively, the resilient member 1274 can have a degressive spring characteristic (i.e., the rate of increase in the spring force (SF) can decrease within the first portion 1255*c* as the movable member 1204 approaches the first end position 1255*a*). Belleville springs, for example, often have degressive spring characteristics.

With reference to FIG. 13A, beginning at the minimum spacing 1261*a*, the first pneumatic force (PF1) can be increased from a first level to a second level to cause the spacing to change from the minimum spacing 1261*a* to a suitable initial spacing greater than the minimum spacing 1261*a*. For example, a pneumatic input to the actuator 1201 can be increased via the first pneumatic inlet 1252 from a first pressure to a second pressure. With the second pneumatic force (PF2) remaining constant, the first pressure can be selected to cause the seat contact force (CFs) described above that at least generally prevents fluid from flowing through the control valve 1200. For example, the first pressure can be about atmospheric pressure or another suitable pressure (e.g., a pressure less than about 20 psi) that causes the first pneumatic force (PF1) to be zero or sufficiently low to achieve the desired seat contact force (CFs). The second pressure can be selected to cause a particular initial steady-state pressure of fluid downstream from the seat 900. For example, the first pneumatic force (PF1) can be increased to a value greater than the value of the seat contact force (CFs) such that the total force (TF) becomes positive, the movable member 1204 moves in the first direction 1256, and the spacing between the pin 1260 and the seat 900 increases. Almost immediately after the spacing begins to increase, fluid within the second chamber 150 can flow downstream causing the hydraulic force (HF) to drop (e.g., to about zero). Subsequently, as the spacing increases and the flow rate of fluid moving between the pin 1260 and the tapered inner surface 144 increases, the pressure of fluid within the second chamber 150 can increase, thereby causing the hydraulic force (HF) to increase.

In some embodiments, the first pneumatic force (PF1) is initially stepped-up (e.g., by rapidly increasing the pneumatic input to the actuator 1201 to the second pressure) such that the total force (TF) becomes positive and the movable member 1204 accelerates in the first direction 1256 until the spacing stabilizes at a suitable level corresponding to a selected initial steady-state pressure of fluid downstream from the seat 900. In other embodiments, the pneumatic input to the actuator 1201 can be increased from the first pressure to the second pressure at a rate of change selected to cause a gradual increase in the pressure of fluid downstream from the seat 900 toward the initial steady-state pressure. The achievable initial steady-state pressure can be infinitely or nearly infinitely variable. Furthermore, the pneumatic input to the actuator 1201 can be changed at a rate selected to cause a suitable rate of ramp-up or ramp-down to or from the initial steady-state pressure. Furthermore, the pneumatic input to the actuator 1201 can be continuously ramped up and/or down in a stable manner without ever achieving a steady-state pressure of fluid downstream from the seat 900.

When the first pneumatic force (PF1) is increased to a level sufficient to cause the spacing to enter the second portion 1261*d*, the movable member 1204 can be released from the spring force (SF), which can cause the total force (TF) to become positive, and the movable member 1204 to accelerate in the first direction 1256 while the spacing increases through the second portion 1261*d* and approaches the third portion 1261*e*. Although stable operation within the third portion 1261*e* may be possible, in some cases, variation of the spacing within the third portion 1261*e* may have little or no meaningful effect on the pressure of fluid downstream from the seat 900. Thus, the positive total force (TF) acting against the movable member 1204 in the first direction 1256 can be maintained when the spacing reaches the third portion 1261*e* so as to cause the movable member 1204 to continue accelerating in the first direction 1256 while the spacing increases toward the maximum spacing 1261*b*. To cause the spacing to move toward the maximum spacing 1261*b* more rapidly, the magnitude of the second pneumatic force (PF2) in the second direction 1258 can be decreased (e.g., to zero) while the first pneumatic force (PF1) is maintained or increased. This can increase the total force (TF) in the first direction 1256 and thereby increase the acceleration of the movable member 1204 in the first direction 1256. For example, rather than increasing the pressure of gas within the first chamber 1226 to increase the first pneumatic force (PF1) in the first direction 1256, the pressure of gas within the second chamber 1228 can be decreased (e.g., to atmospheric pressure) to decrease the magnitude of the second pneumatic force (PF2) in the second direction 1258.

In some cases, the second pneumatic force (PF2) is maintained when the movable member 1204 is at the second end position 1255*b* and the magnitude of the housing contact force (CFh) in the second direction 1258 is equal the positive difference between the magnitude of the second pneumatic force (PF2) in the second direction 1258 and the sum of the first pneumatic force (PF1) and the hydraulic force (HF). In other cases, the second pneumatic force (PF2) can be zero when the movable member 1204 is at the second end position 1255*b* and the magnitude of the housing contact force (CFh) in the second direction 1258 can be equal to the sum of the first pneumatic force (PF1) and the hydraulic force (HF). In still other cases, the first pneumatic force (PF1) can be decreased to zero after decreasing the magnitude of the second pneumatic force (PF2) in the second direction 1258 such that the magnitude of the housing contact force (CFh) in the second direction 1258 is equal to the hydraulic force (HF) only.

Although FIGS. 13A and 13B are described above primarily in the context of increasing the spacing from the minimum spacing 1261*a*, the concepts can also be applicable to decreasing the spacing from the maximum spacing 1261*b* as well as to other changes within the range of spacing 1261. When decreasing the spacing, the first and second hydraulic force gradients 1280*a*, 1280*b* can be less steep than when increasing the spacing (e.g., due to a delay between moving the pin 1260 toward the seat 900 and the fluid within the second chamber 150 reaching pressure equilibrium with fluid upstream from the seat 900). Thus, the counteracting effect of the spring force gradient 1282 may be greater when decreasing the spacing than when increasing the spacing. Control systems for use with the control valve 1200 (e.g., as discussed in further detail below) can be configured to account for this phenomenon.

Furthermore, although FIGS. 13A and 13B are described above primarily in the context of maintaining the second pneumatic force (PF2) (e.g., by maintaining the pressure of gas within the second chamber 1228) and varying the first pneumatic force (PF1) (e.g., by varying the pressure of gas within the first chamber 1226) to achieve intermediate spacings 1261*x*, other suitable manners of achieving intermediate spacings 1261*x* are also possible. For example, both the first and second pneumatic forces (PF1, PF2) can be varied to achieve intermediate spacings 1261*x*. Alternatively, the first pneumatic force (PF1) can be maintained (e.g., by maintaining the pressure of gas within the first chamber 1226 at atmospheric pressure or another suitable level) while the second pneumatic force (PF2) is varied (e.g., by varying the pressure of gas within the second chamber 1228) to achieve intermediate spacings 1261*x*. This can reduce or eliminate the need for the first pneumatic inlet 1252 and accompanying couplers, regulators, and pneumatic conduits (not shown), which can be unduly bulky. As discussed above, decreasing the size of the actuator 1201 can be advantageous (e.g., when the actuator 1201 is part of a movable waterjet assembly including a tiltable cutting head (not shown)).

When the actuator 1201 is configured to achieve intermediate spacings 1261*x* by varying the pressure of gas within the second chamber 1228, the second pneumatic inlet 1254 can be connected to a high-precision and/or high-accuracy pneumatic regulator (as discussed in further detail below). To increase the spacing from the minimum spacing 1261*a* to a suitable intermediate spacing 1261*x*, the pressure of gas within the second chamber 1228 can be decreased precisely (e.g., to a precise level and/or at a precise rate). To increase the spacing to the maximum spacing 1261*b*, the pressure of gas within the second chamber 1228 can be rapidly decreased to atmospheric pressure (e.g., dumped). In at least some cases, when the actuator 1201 is configured to achieve intermediate spacings 1261*x* by varying the pressure of gas within the second chamber 1228, the control valve does not achieve the maximum spacing 1261*b* as rapidly as when the actuator 1201 is configured to achieve intermediate spacings 1261*x* by varying the pressure of gas within the first chamber 1226 (e.g., because the total force (TF) acting against the movable member 1204 in the first direction 1256 is lower when the first pneumatic force (PF1) is lower). Thus, in these cases, it can be useful for the actuator 1201 to be configured to achieve intermediate spacings 1261*x* by varying the pressure of gas within the second chamber 1228 when compactness is more important than opening speed, and for the actuator 1201 to be configured to achieve intermediate spacings 1261*x* by varying the pressure of gas within the first chamber 1226 when opening speed is more important than compactness.

Figures 14A, 14B:
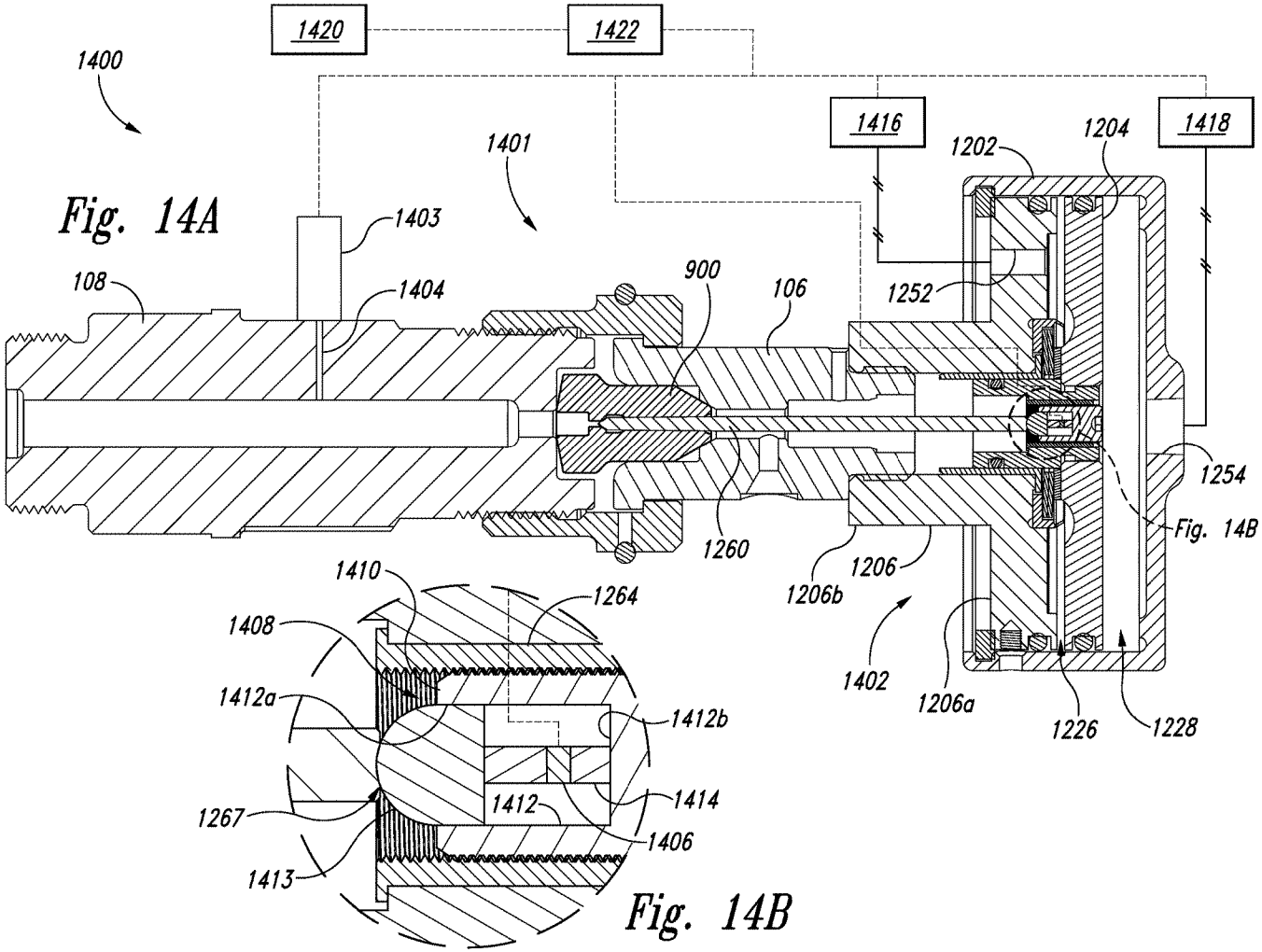
FIG. 14A is a partially schematic cross-sectional side view illustrating a portion of a waterjet system including a control valve as well as a controller configured to operate the control valve, and associated components configured in accordance with an embodiment of the present technology.
FIG. 14B is an enlarged view of a portion of FIG. 14A.

FIG. 14A is a partially schematic cross-sectional side view illustrating a portion of a waterjet system 1400 including a control valve 1401 having an actuator 1402 configured in accordance with another embodiment of the present technology. FIG. 14B is an enlarged view of a portion of FIG. 14A. For clarity of illustration, some reference numbers in FIG. 14A have been omitted. The waterjet system 1400 can include the upstream and downstream housings 106, 108 discussed above with reference to FIGS. 1A-1E. The second portion 1206*b* of the plunger guide 1206 can be operably coupled to the upstream housing 106, and the waterjet system 1400 can further include a pressure sensor 1403 configured to detect a pressure of fluid downstream from the seat 900. In some embodiments, the pressure sensor 1403 includes a pressure transducer directly hydraulically connected to fluid downstream from the seat 900 via a lateral bore 1404 in the downstream housing 108. In other embodiments, the pressure sensor 1403 can include a pressure transducer mounted elsewhere (e.g., at least proximate to the actuator housing 1202) and a conduit extending between the pressure transducer and the lateral bore 1404. This configuration can facilitate continuous or frequent measurement of the pressure of fluid downstream from the seat 900 during operation of the waterjet system 1400 with less potential for obstructing movement of the control valve 1401 relative to a workpiece (not shown) during use than the configuration shown in FIG. 14A.

After stabilizing at an initial spacing and a corresponding initial steady-state pressure of fluid downstream from the seat 900, the initial spacing can be maintained (e.g., while a first portion of a waterjet cutting operation is performed). The spacing can then be changed to achieve another suitable steady-state pressure of fluid downstream from the seat 900, which can then be maintained for another period (e.g., while a second portion of a waterjet cutting operation is performed). Such variation can also be continuous rather than incremental. For example, the waterjet system 1400 can be configured to vary the spacing and the corresponding pressure of fluid downstream from the seat 900 continuously according to a suitable control algorithm. With reference to FIG. 14B, the waterjet system 1400 can further include a load cell 1406 configured to detect the hydraulic force (HF) and/or the seat contact force (CFs). The load cell 1406, for example, can include a button-style load cell within a plug 1408 configured to be operably positioned within the adjustment bushing 1264. The plug 1408 can include a body 1410 having a blind bore 1412 with a first end 1412*a* opening toward the contact interface 1267 and a second end 1412*b* at a solid surface within the plug 1408. The plug 1408 can further include a rounded head 1413 and a shaft 1414 extending between the rounded head 1413 and the solid surface at the second end 1412*b*. The load cell 1406 can be operably positioned at an intermediate point along the length of the shaft 1414 such that force at the contact interface 1267 travels to the load cell 1406 via the rounded head 1413 and a portion of the shaft 1414 positioned between the load cell 1406 and a side of the rounded head 1413 opposite to a side at the contact interface 1267. The load cell 1406 can also be of another suitable type (e.g., hydraulic) and/or have another suitable position within the waterjet system 1400.

The waterjet system 1400 can further include a first pneumatic regulator 1416 and a second pneumatic regulator 1418 operably connected to the first and second pneumatic inlets 1252, 1254, respectively. The first pneumatic regulator 1416 and/or the second pneumatic regulator 1418 can be high-precision and/or high-accuracy pneumatic regulators. For example, the first pneumatic regulator 1416 and/or the second pneumatic regulator 1418 can be configured to precisely and/or accurately produce pressures of gas within the first chamber 1226 and/or the second chamber 1228, respectively, with variation or deviation less than about 0.5 psi (e.g., within a range from about 0.001 psi to about 0.5 psi), less than about 0.01 psi (e.g., within a range from about 0.001 psi to about 0.01 psi), less than another suitable threshold, or within another suitable range. In a particular embodiment, the first pneumatic regulator 1416 and/or the second pneumatic regulator 1418 includes a direct-acting poppet-style regulator, such as a Series ED02 Electro-Pneumatic Pressure Control Valve (e.g., Part Number R414002413) available from Bosch Rexroth AG (Charlotte, N.C.). When the control valve 1401 is configured to achieve intermediate spacings 1261*x* by varying the pressure of gas within the first chamber 1226, the second pneumatic regulator 1418 can be a relief valve configured to be either fully open or fully closed.

The waterjet system 1400 can further include a user interface 1420 (e.g., a touch screen) and a controller 1422 operably connected to the user interface 1420, the pressure sensor 1403, the load cell 1406, and the first and second pneumatic regulators 1416, 1418. The controller 1422 can be configured to use feedback to control and/or monitor operation of the control valve 1401, such as to cause the control valve 1401 to execute instructions entered manually by a user at the user interface 1420 and/or to correct excursions during operation of the control valve 1401. The controller 1422 can include a processor (not shown) and memory (also not shown) and can be programmed with instructions (e.g., non-transitory instructions) that, when executed, cause a change a pneumatic input to the actuator 1402 (e.g., via the first pneumatic regulator 1416) based at least in part on the pressure of fluid downstream from the seat 900 detected by the pressure sensor 1403 and/or the hydraulic force detected by the load cell 1406. The controller 1422 can be connected to a fluid-pressurizing device (e.g., a pump) (not shown) configured to pressurize fluid upstream from the control valve 1401. The controller 1422 can be programmed with instructions (e.g., non-transitory instructions) that, when executed, cause a change a pneumatic input to the actuator 1402 (e.g., via the first pneumatic regulator 1416) based at least in part on one or more operating parameters of the fluid-pressurizing device (e.g., rpm, electrical load, and output flow rate, among others). Feedback from the pressure sensor 1403, the load cell 1406, and the fluid-pressurizing device can be redundant and, in at least some cases, the waterjet system 1400 can be configured to utilize fewer (e.g., one or two) of these or other types of feedback. Furthermore, the control valve 1401 can be configured to default to closed positions so as not to open unexpectedly in the event of a pneumatic failure or other disruption. For example, the first pneumatic regulator 1416 can default to a closed position and the second pneumatic regulator 1418 can default to an open position.

The waterjet system 1400 can be configured to be calibrated before use instead of or in addition to utilizing feedback. For example, calibration can be used to ascertain a pressure of gas within the first chamber 1226 that causes a desired pressure (e.g., 10,000 psi) of fluid downstream from the seat 900 when the pressure upstream from the control valve 1401 is at desired system pressure (e.g., 60,000 psi). After calibration, the first pneumatic regulator 1416 can be used to maintain the ascertained pressure of gas within the first chamber 1226 so as to cause the desired pressure of fluid downstream from the seat 900 as needed. One example of a suitable calibration method includes first adjusting the output flow rate of the fluid-pressurizing device (e.g., according to a correlation by which the output flow rate is linearly proportional to the rpm of the fluid-pressurizing device) while the control valve 1401 is fully opened until the desired pressure of fluid downstream from the seat 900 is achieved. With the control valve 1401 fully opened, the pressure of fluid upstream from the control valve 1401 can be about the same as the pressure of fluid downstream from the seat 900. Next, without changing the output flow rate of the fluid-pressurizing device, the pressure of gas within the first chamber 1226 can be increased gradually using the first pneumatic regulator 1416 to close the control valve 1401 while the pressure of fluid upstream from the control valve 1401 is monitored. In at least some cases, when the pressure of fluid upstream from the control valve 1401 reaches the desired system pressure, the corresponding pressure of gas within the first chamber 1226 may be the pressure that causes the desired pressure of fluid downstream from the seat 900 when the pressure of fluid upstream from the control valve 1401 is at the desired system pressure so long as the pressure of gas within the second chamber 1228 is consistent during calibration and subsequent use. The pressure of gas within the second chamber 1228 can be maintained at about 85 psi, about 90 psi, or at another suitable level. Calibrating the waterjet system 1400 in this manner can be useful, for example, to correct for variability in the erosion of the pin 1260 and the seat 900 and/or dimensional variability in replaced components, among other factors.

Figure 15A:
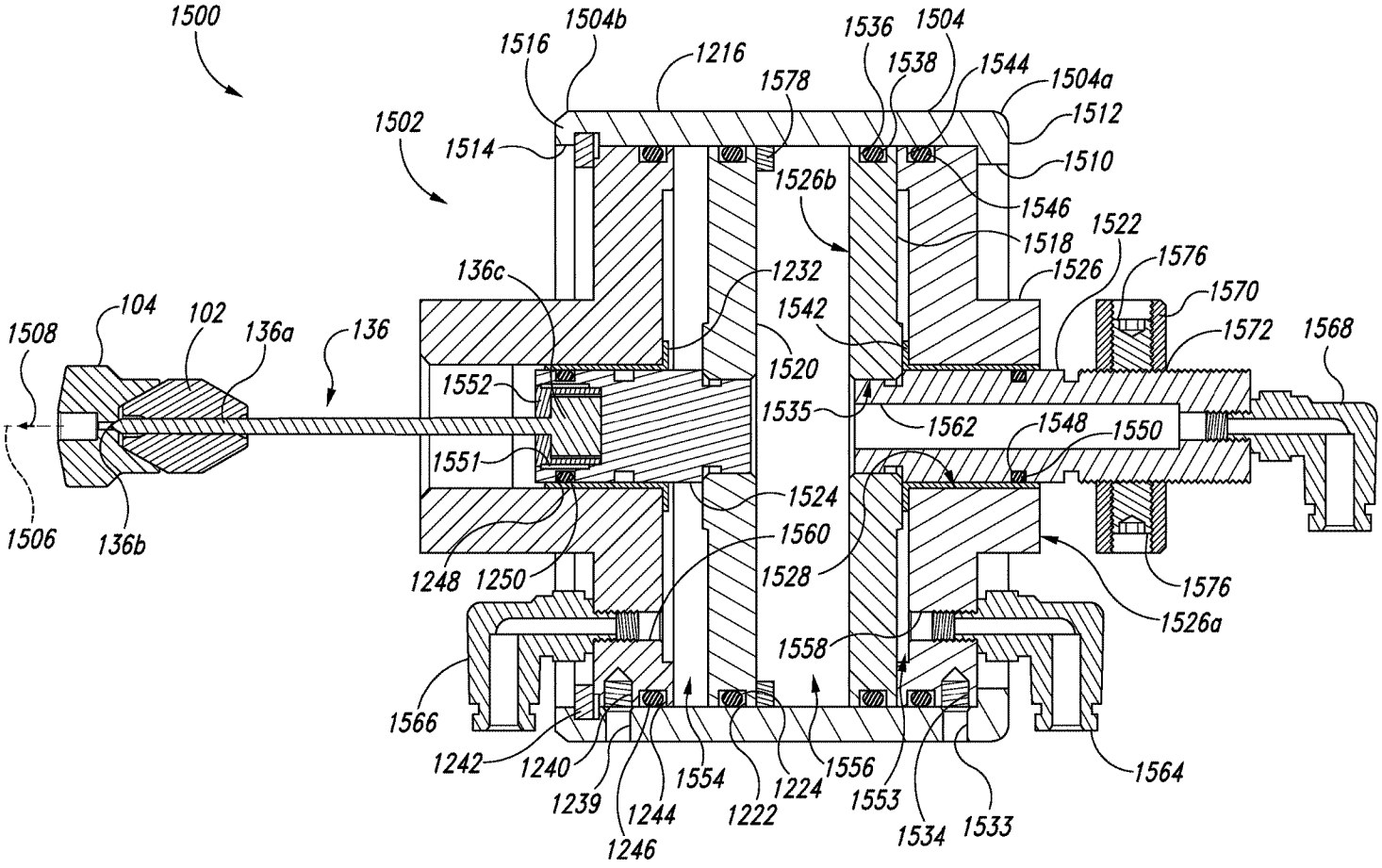
FIGS. 15A, 15B, and 15C are cross-sectional side views illustrating a portion of a control valve including an actuator and a pin, with the pin in a closed position, a throttling position, and an open position, respectively, configured in accordance with an embodiment of the present technology.
Figure 15B:
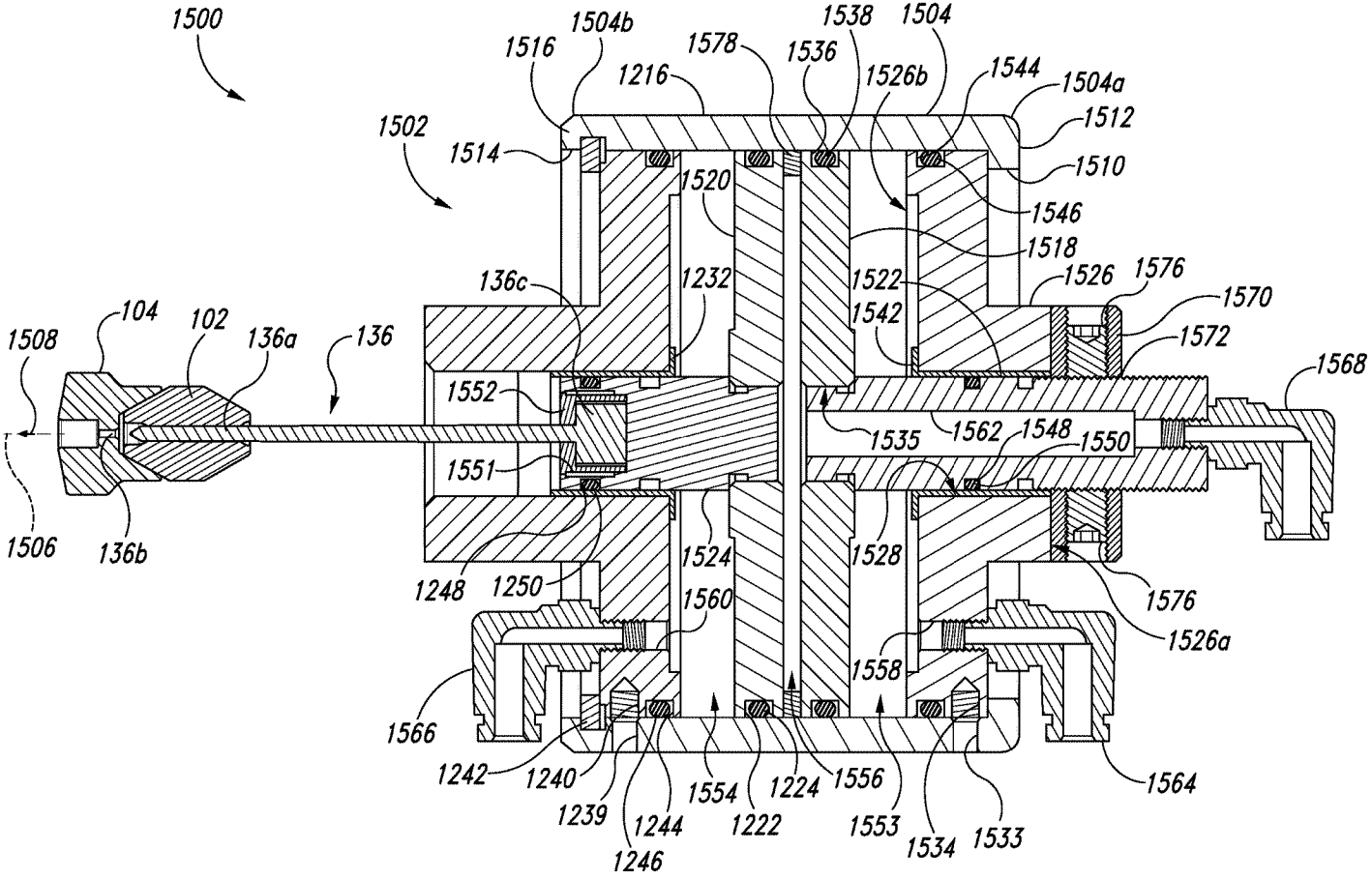
Figure 15C:
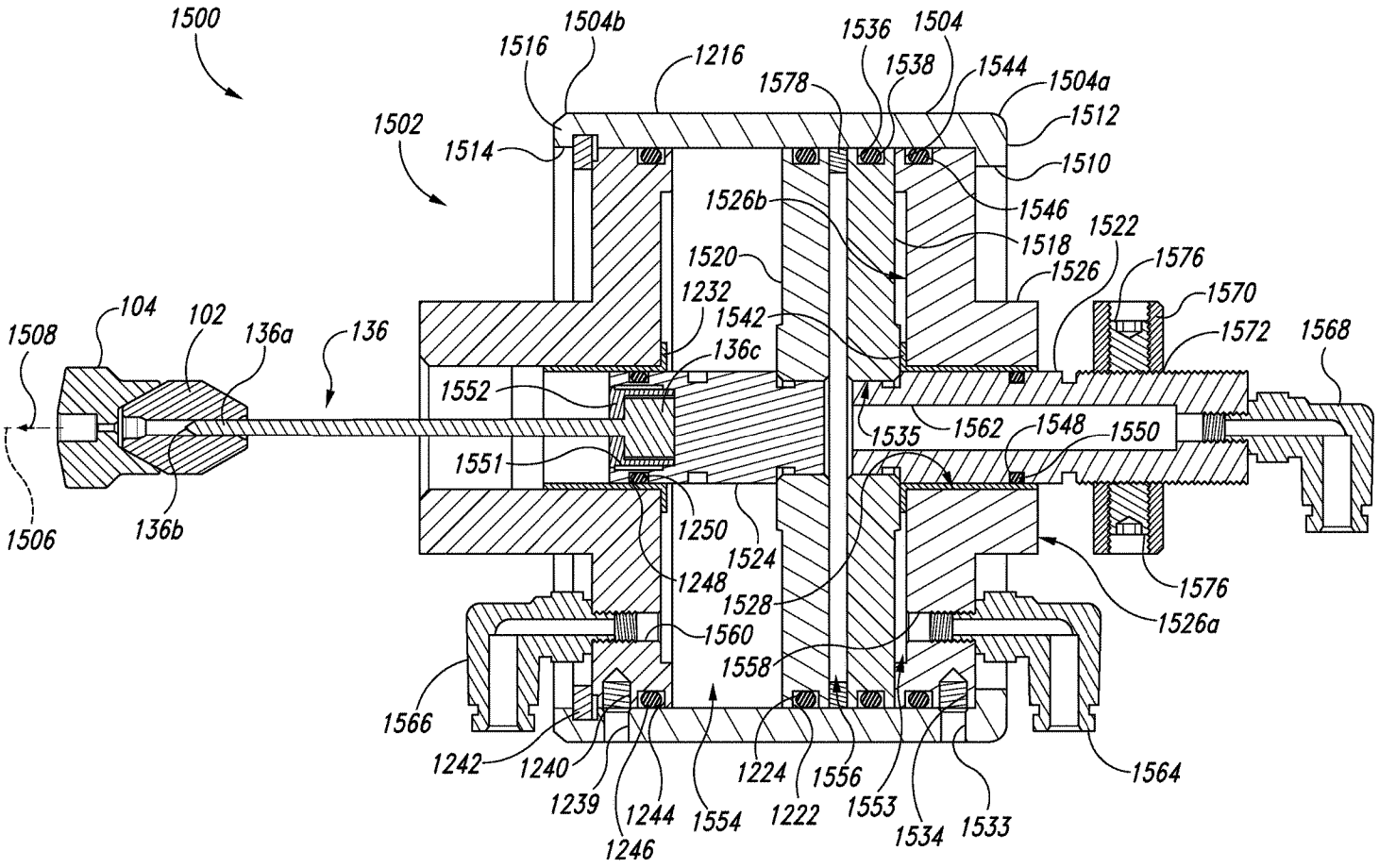

FIGS. 15A-15C are cross-sectional side views illustrating a portion of a control valve 1500 including an actuator 1502 configured in accordance with another embodiment of the present technology. The actuator 1502 can be configured to move the pin 136 relative to the first seat 102 and the second seat 104, with the pin 136 shown in a closed position, a throttling position, and an open position in FIGS. 15A, 15B and 15C, respectively. The actuator 1502 can include an actuator housing 1504 having a first end 1504*a* and a second end 1504*b* opposite to the first end 1504*a*. The actuator 1502 can be configured to exert force along a linear actuating axis 1506 (shown as a broken line in FIGS. 15A-15C) in an actuating direction 1508 (shown as an arrow in FIGS. 15A-15C). The first and second ends 1504*a*, 1504*b* can have different positions along the actuating axis 1506 such that the actuating direction 1508 extends from the first end 1504*a* toward the second end 1504*b*. The actuator housing 1504 can be at least generally cylindrical and can include a first major opening 1510 at the first end 1504*a*, a first lip 1512 around the first major opening 1510, a second major opening 1514 at the second end 1504*b*, and a second lip 1516 around the second major opening 1514.

The actuator 1502 can further include a first piston 1518 and a second piston 1520 both movably positioned within the actuator housing 1504. Furthermore, the actuator 1502 can include a first plunger 1522 coupled to the first piston 1518 and configured to move with the first piston 1518 in parallel with the actuating axis 1506, and a second plunger 1524 coupled to the second piston 1520 and configured to move with the second piston 1520 in parallel with the actuating axis 1506. For example, the actuator 1502 can include a first plunger guide 1526 having a first central channel 1528 configured to slidingly receive the first plunger 1522, and a second plunger guide 1530 having a second central channel 1532 configured to slidingly receive the second plunger 1524. The actuator 1502 can be assembled, for example, by inserting the first plunger guide 1526 into the actuator housing 1504 via the second major opening 1514, then inserting the first piston 1518 (e.g., with the first plunger 1522 secured to the first piston 1518) into the actuator housing 1504 via the second major opening 1514, then inserting the second piston 1520 (e.g., with the second plunger 1524 secured to the second piston 1520) into the actuator housing 1504 via the second major opening 1514, and then inserting the second plunger guide 1530 into the actuator housing 1504 via the second major opening 1514. Screws (not shown) (e.g., set screws) can be individually inserted through holes 1533 in the sidewall 1216 and into threaded recesses 1534 (one shown) distributed around the circumference of the first plunger guide 1526 to secure the first plunger guide 1526 in position within the actuator housing 1504.

The first piston 1518 can be cylindrical (e.g., disk-shaped) and can include a central bore 1535 and a fourth sealing member 1538 (e.g., an o-ring) inset within a fourth edge recess 1536. The fourth sealing member 1538 can be configured to slide along an inner surface of the sidewall 1216 to form a movable seal. The first plunger guide 1526 can be configured to slidingly receive a portion of the first plunger 1522 while another portion of the first plunger 1522 is secured to the first piston 1518 within the central bore 1535. In a particular embodiment, the first plunger 1522 is slidingly received within the smooth bushing 1232 inserted into the first central channel 1528. The first plunger guide 1526 can include a fifth edge recess 1544 and a fifth sealing member 1546 (e.g., an o-ring) operably positioned within the fifth edge recess 1544. Similarly, the first plunger 1522 can include a sixth sealing member 1550 (e.g., an o-ring) operably positioned within a sixth edge recess 1548. The fifth sealing member 1546 can be configured to engage the inner surface of the sidewall 1216 to form a fixed seal, and the sixth sealing member 1550 can be configured to slide along the inner surface of the bushing 1232 to form a movable seal.

The second piston 1520 and the second plunger guide 1530, respectively, can be similar to the movable member 1204 and the plunger guide 1206 discussed above with reference to FIGS. 12A-12C. The second plunger 1524 can include a recess 1551 configured to receive the base portion 136*c* of the pin 136 and a retaining member 1552 removably inserted (e.g., by complementary threads (not shown)) into the recess 1551 to hold the pin 136 in firm contact with the second plunger 1524 during movement of the second plunger 1524 in parallel with the actuating axis 1506 in the actuating direction 1508 and in a direction opposite to the actuating direction 1508.

The first piston 1518 and the second piston 1520 can be configured to move in parallel with the actuating axis 1506 in the actuating direction 1508 or in the direction opposite to the actuating direction 1508 in response to changes in one or more pressure equilibriums (e.g., pneumatic and/or hydraulic pressure differentials) between different chambers within the actuator housing 1504. In one embodiment, the actuator 1502 includes a first space 1553 within the actuator housing 1504 between the first plunger guide 1526 and the first piston 1518, a second space 1554 within the actuator housing 1504 between the second plunger guide 1530 and the second piston 1520, and a third space 1556 within the actuator housing 1504 between the first and second pistons 1518, 1520. Furthermore, the actuator 1502 can include a first fluidic port 1558, a second fluidic port 1560, and a third fluidic port 1562 opening into the first space 1553, the second space 1554, and the third space 1556, respectively. The first and second fluidic ports 1558, 1560 can extend through the first and second plunger guides 1526, 1530, respectively, and can be stationary during operation of the actuator 1502. In some embodiments, the third fluidic port 1562 is movable in parallel with the actuating axis 1506 during operation of the actuator 1502. For example, the third fluidic port 1562 can extend through the first plunger 1522. In other embodiments, the third fluidic port 1562 can extend through the second plunger 1524 or have another suitable position. As shown in FIGS. 15A-15C, first, second, and third elbow fittings 1564, 1566, 1568 can be connected, respectively, to the first, second, and third fluidic ports 1558, 1560, 1562. Other suitable fittings can be used in other embodiments.

The first piston 1518 can be movable from a fully retracted first position (FIGS. 15A and 15C) to a fully extended second position (FIG. 15B) and through a range of travel between the first and second positions. The second position can be adjustable. For example, the actuator 1502 can include a stop 1570 (e.g., a nut) adjustably connected to the first plunger 1522. The first plunger guide 1526 can have a first side 1526*a* facing toward the stop 1570 and an opposite second side 1526*b* facing toward the first piston 1518. When the first piston 1518 is in the second position, the stop 1570 can be in contact with the first side 1526*a*. When the first piston 1518 is in the second position, the first piston 1518 can be in contact with the second side 1526*b*. Adjusting a position of the stop 1570 relative to the first plunger 1522 in parallel with the actuating axis 1506 can move the second position (e.g., by changing the distance between the stop 1570 and the first piston 1518 in parallel with the actuating axis 1506 when the stop 1570 contacts the first plunger guide 1526). The first plunger 1522 and the stop 1570 can include complementary threads 1572 and rotating the stop 1570 relative to the first plunger 1522 can adjust the position of the stop 1570 relative to the first plunger 1522 in parallel with the actuating axis 1506. The density of the complementary threads 1572 in parallel with the actuating axis 1506 can be, for example, greater than about 20 threads-per-inch (e.g., from about 20 threads-per-inch to about 200 threads-per-inch), greater than about 40 threads-per-inch (e.g., from about 40 threads-per-inch to about 200 threads-per-inch), greater than about 60 threads-per-inch (e.g., from about 60 threads-per-inch to about 200 threads-per-inch), greater than another suitable threshold, or within another suitable range. As shown in FIGS. 15A-15C, the stop 1570 can include threaded channels 1574 and set screws 1576 individually positioned within the threaded channels 1574. The set screws 1576 can be used, for example, to lock the position of the stop 1570 relative to the first plunger 1522 in parallel with the actuating axis 1506 after adjustment.

The actuator 1502 can be controlled by, for example, changing fluidic inputs to the first, second, and/or third fluidic ports 1558, 1560, 1562. In an example of operation, when the pin 136 is in the closed position (FIG. 15A), the first and second fluidic ports 1558, 1560 can be dumped (e.g., open to the atmosphere) and the fluidic input to the third fluidic port 1562 can be set to a pneumatic input at a pressure that causes a level of contact force between the pin 136 and the second seat 104 suitable for shutting off flow through the control valve 1500. Alternatively, when the pin 136 is in the closed position (FIG. 15A), the fluidic input to the first fluidic port 1558 can be set to a pneumatic input sufficient to move the first piston 1518 to the fully extended position, the second fluidic port 1560 can be open to the atmosphere, and the fluidic input to the third fluidic port 1562 can be set to a pneumatic input that causes a level of contact force between the pin 136 and the second seat 104 suitable for shutting off flow through the control valve 1500. The fluidic input to the first fluidic port 1558 can be sufficient to at least generally prevent the first piston 1518 from moving out of the fully extended position in response to force exerted against the first piston 1518 due to the fluidic input to the third fluidic port 1562.

To move the pin 136 to the throttling position (FIG. 15B), the fluidic input to the first fluidic port 1558 can be set to a pneumatic input sufficient to move the first piston 1518 to the fully extended position, and the second and third fluidic ports 1560, 1562 can be dumped (e.g., open to the atmosphere). The fluidic input to the first fluidic port 1558 can be sufficient to counteract a hydraulic force from fluid within the first and second seats 102, 104 exerted against the first piston 1518 via the pin 136, the second plunger 1524, and the second piston 1520. When the second and third fluidic ports 1560, 1562 are dumped, the second piston 1520 can move into contact with the first piston 1518 in response to the hydraulic force. The second piston 1520 can include a spacer 1578 (e.g., an annular projection operably positioned toward the first piston 1518) configured to engage the first piston 1518 and to prevent the third space 1556 from becoming unduly restricted when the first and second pistons 1518, 1520 are in contact with one another. The spacer 1578 can be resilient (e.g., made of hard rubber) so as to reduce wear on the first and second pistons 1518, 1520 during operation of the actuator 1502. Dumping the fluidic input to the third fluidic port 1562 and changing the fluidic input to the first fluidic port 1558 can be synchronized (e.g., electronically synchronized using a controller (not shown)) so that first piston 1518 moves to the fully extended position at about the same time or before the second piston 1520 moves into contact with the first piston 1518. This can reduce or prevent flow through the control valve 1500 from briefly dipping or spiking when the pin 136 moves from closed position to the throttle position. Maintaining the first piston 1518 in the fully extended position when the pin 136 is in the closed position, as discussed above, also can be useful to reduce or prevent flow through the control valve 1500 from briefly dipping or spiking when the pin 136 moves from closed position to the throttle position.

To move the pin 136 to the open position (FIG. 15C), the first, second, and third fluidic ports 1558, 1560, 1562 can be dumped (e.g., open to the atmosphere). Other suitable permutations of the fluidic inputs to the first, second, and/or third fluidic ports 1558, 1560, 1562 for achieving and transitioning between the closed position, the throttling position, and the open position of the pin 136 are also possible. In at least some embodiments, the actuator 1502 facilitates rapid transitioning between two or more (e.g., three) precise actuating positions and repeatedly achieving at least generally consistent contact forces between the pin 136 and the second seat 104. Accordingly, the actuator 1502 can be well suited for use in operations that call for repeated cycling of a fluid jet through cycles that include shutoff, piercing, and cutting or combinations thereof. To calibrate the actuator 1502 for use in a particular operation, the piercing parameters can be empirically tested at different settings of the stop 1570. When suitable piercing parameters are achieved, the set screws 1576 can be tightened and the actuator 1502 can precisely achieve the piercing parameters over a large number of cycles (e.g., greater than 100 cycles, greater than 1,000 cycles, greater than 10,000 cycles, or another suitable number of cycles).

Selected Examples of Relief Valves

When a waterjet is slowed or stopped using a control valve configured in accordance with an embodiment of the present technology, it can be useful to at least generally prevent fluid pressure upstream from the control valve from increasing in response, even for a very short period of time. In some embodiments, a waterjet system including a control valve includes a pressure-compensated pump, such as a hydraulic intensifier that responds (e.g., goes off stroke) automatically when fluid pressure upstream from the control valve changes due to operation of the control valve. In other embodiments, a waterjet system including a control valve includes a pump that is not pressure-compensated, such as a positive-displacement pump (e.g., a direct-drive pump) that may not be capable of automatically responding to changes in fluid pressure upstream from the control valve due to operation of the control valve. For example, positive-displacement pumps may have relatively high inertia during operation that cannot be rapidly redirected. A waterjet system that includes a pump that is not pressure-compensated and a control valve configured in accordance with an embodiment of the present technology can include a relief valve configured to release fluid when a waterjet generated by the system is slowed or stopped using the control valve. As an example, the relief valve can be configured to open and/or close in response to one or more signals associated with operation of the control valve (e.g., generated in response to at least partially opening and/or closing the control valve). As another example, the relief valve can be configured to automatically open and/or close in response to a change in a balance of opposing forces acting on a portion of the relief valve, with the change being associated with operation of the control valve.

Figure 16A:
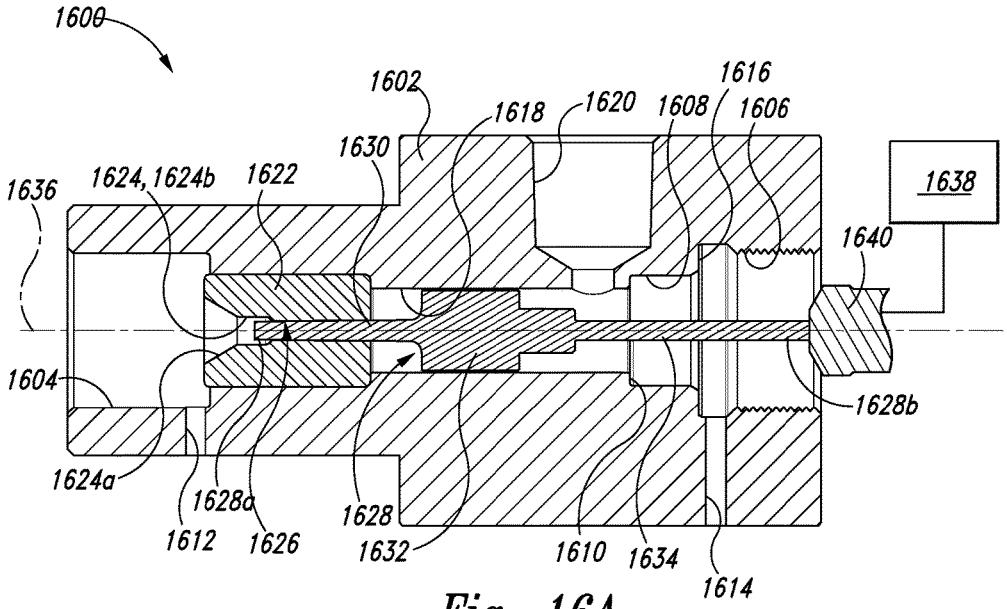
FIGS. 16A and 16B a cross-sectional side views illustrating a relief valve in a first operational state and a second operational state, respectively, configured in accordance with an embodiment of the present technology.
Figure 16B:
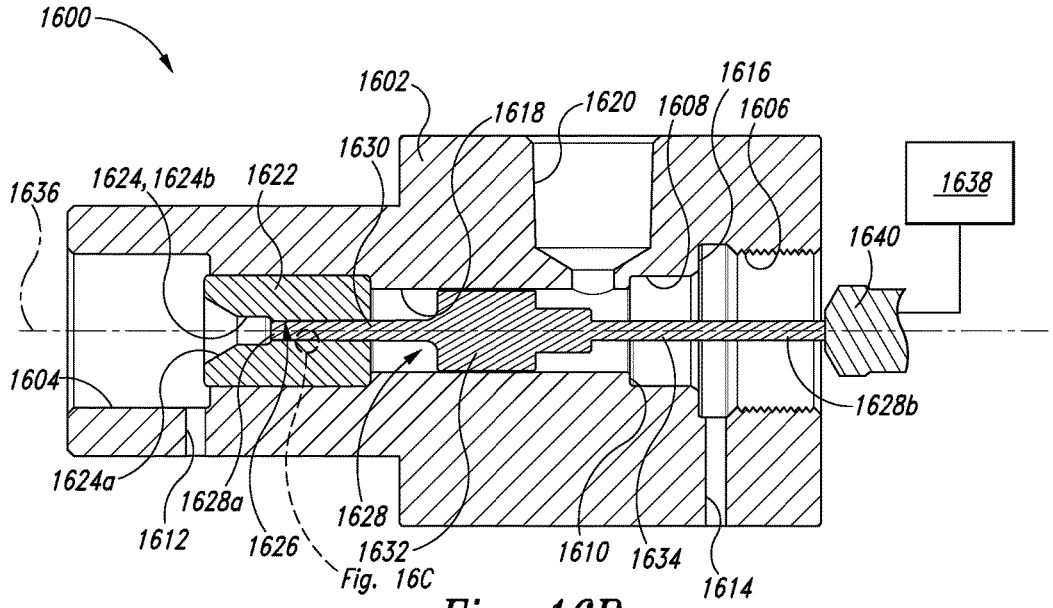
Figure 16C:
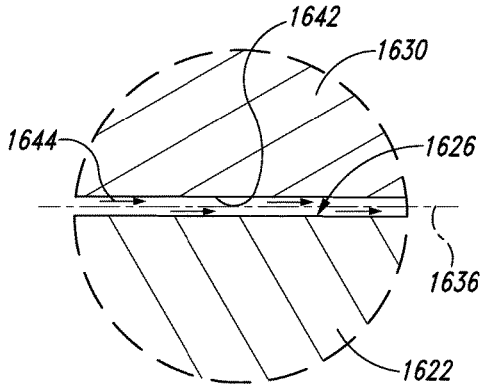
FIG. 16C is an enlarged view of a portion of FIG. 16B.
Figure 16D:
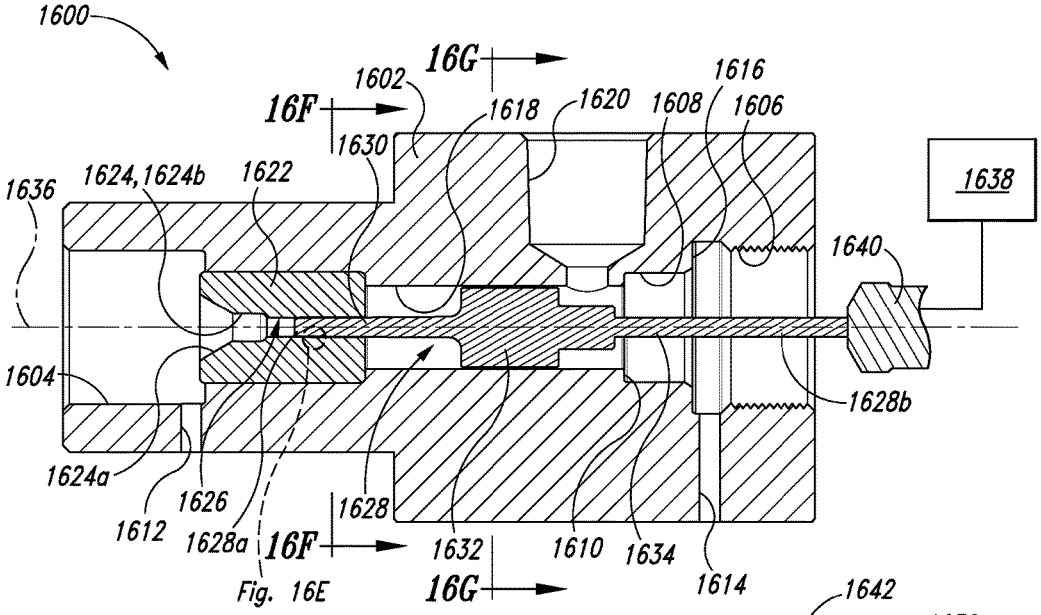
FIG. 16D is a cross-sectional side view illustrating the relief valve of FIG. 16A in a third operational state.

FIGS. 16A, 16B and 16D are cross-sectional side views illustrating a relief valve 1600 configured in accordance with an embodiment of the present technology in a first operational state, a second operational state, and a third operational state, respectively. The relief valve 1600 can be configured for use at high pressure. For example, in at least some embodiments, the relief valve 1600 has a pressure rating or is otherwise configured for use at pressures greater than about 20,000 psi (e.g., within a range from about 20,000 psi to about 120,000 psi), greater than about 40,000 psi (e.g., within a range from about 40,000 psi to about 120,000 psi), greater than about 50,000 psi (e.g., within a range from about 50,000 psi to about 120,000 psi), greater than another suitable threshold, or within another suitable range. In the illustrated embodiment, the relief valve 1600 includes a valve body 1602 (e.g., an at least generally cylindrical housing) having a fluid inlet 1604 at one end and a threaded opening 1606 at the opposite end. The fluid inlet 1604 and the threaded opening 1606 can be at least generally cylindrical and configured to receive an end portion of a tube (not shown) and a retainer screw (also not shown), respectively. The tube can be a relief conduit fluidly connected to other conduits, tanks, and/or other suitable components configured to hold high-pressure liquid within a waterjet system.

The valve body 1602 can include a cylindrical seal housing 1608 extending from an annular internal ledge 1610 toward the threaded opening 1606. The seal housing 1608 can be configured to hold a seal assembly (not shown) (e.g., a suitable high-pressure seal assembly including static and/or dynamic sealing components) with the retainer screw holding the seal assembly against the ledge 1610. The valve body 1602 can further include a first weep hole 1612 opening to the fluid inlet 1604, and a second weep hole 1614 opening to an annular groove 1616 operably positioned between the threaded opening 1606 and the seal housing 1608. The first weep hole 1612 and the second weep hole 1614 can be configured to allow any fluid leakage proximate the fluid inlet 1604 and the seal housing 1608, respectively, to exit the relief valve 1600.

In the illustrated embodiment, the relief valve 1600 includes a cylindrical chamber 1618 adjacent to the seal housing 1608, and a fluid outlet 1620 extending laterally (e.g., radially) outward from the chamber 1618. The relief valve 1600 can further include a seat 1622 operably positioned within the valve body 1602 between the fluid inlet 1604 and the chamber 1618. In some embodiments, the seat 1622 is fixedly attached (e.g., pressed, welded, or bolted) within the valve body 1602. In other embodiments, the seat 1622 can be releasably held in place within the valve body 1602 by a conduit or other component (e.g., as discussed above) connected to the valve body 1602 at the fluid inlet 1604. The seat 1622 can include a central channel 1624 (e.g., a bore) and a tapered inner surface 1626 along at least a portion of the channel 1624. For example, the channel 1624 can have a cross-sectional area that decreases along the tapered inner surface 1626 from the chamber 1618 toward the fluid inlet 1604. The channel 1624 can include a flared portion 1624*a* (e.g., a conical portion) proximate to the fluid inlet 1604, and an intermediate portion 1624*b* positioned between the flared portion 1624*a* and an end of the tapered inner surface 1626 closest to the fluid inlet 1604.

The relief valve 1600 can further include an elongated stem 1628 moveably positioned within the valve body 1602. The stem 1628 can include a pin portion 1630 operably positioned toward a first end portion 1628*a* of the stem 1628, a connector shaft 1634 operably positioned toward a second end portion 1628*b* of the stem 1628, and a flow restrictor 1632 positioned therebetween. The pin portion 1630 can have an outer surface tapered inwardly toward the first end portion 1628*a* relative to a longitudinal axis 1636 of the stem 1628. The taper of the outer surface of the pin portion 1630 can be at least generally complementary (e.g., parallel) to the taper of the seat 1622. In at least some embodiments, for example, the taper of the pin portion 1630 and the taper of the seat 1622 can be angled within a range from about 0.01 degree to about 2 degrees, within a range from about 0.1 degree to about 0.59 degree, within a range from about 0.1 degree to about 0.5 degree, or within another suitable range of angles relative to the longitudinal axis 1636 of the stem 1628. For example, the outer surface of the pin portion 1630 and the tapered inner surface 1626 of the seat 1622 can both be angled at about 0.5 degree relative to the longitudinal axis 1636 of the stem 1628.

In the illustrated embodiment, the relief valve 1600 includes a plunger 1640 operably coupling a linear actuator 1638 (shown schematically) to the connector shaft 1634. In operation, the linear actuator 1638 can exert a closing force against the stem 1628 via the plunger 1640 to drive (e.g., press) the stem 1628 toward the seat 1622 and/or move the stem 1628 away from the seat 1622. In some embodiments, the plunger 1640 is aligned with the connector shaft 1634, but not secured to the connector shaft 1634. In other embodiments, the connector shaft 1634 can be secured to the plunger 1640 (e.g., screwed into the end of the plunger 1640), which can allow the linear actuator 1638 to pull the stem 1628 away from the seat 1622 in addition to pushing the stem 1628 toward the seat 1622.

In use, pressurized fluid upstream from the pin portion 1630 can exert an opening force against the pin portion 1630. If the linear actuator 1638 exerts a constant closing force against the stem 1628, an increase in upstream fluid pressure acting against the pin portion 1630 (e.g., due to at least partially closing a control valve) can cause the relief valve 1600 to automatically open. Similarly, when the pressure of the upstream fluid decreases (e.g., due to at least partially opening a control valve), the opening force acting against the pin portion 1630 can decrease and the relief valve 1600 can automatically close. The linear actuator 1638 can be configured such that a maximum extension of the plunger 1640 and/or the maximum closing force acting on the stem 1628 is less than an extension and/or force, respectively, that would cause the pin portion 1630 to become jammed in the channel 1624 (e.g., that would cause static friction between the outer surface of the pin portion 1630 and the tapered inner surface 1626 of the seat 1622 to exceed the maximum opening force acting against the pin portion 1630 during normal operation). Furthermore, the linear actuator 1638 can be configured to release the closing force automatically when a fluid-pressurizing device (e.g., a pump) (not shown)

that pressurizes the upstream fluid is shut off. This feature can enable the upstream fluid to automatically depressurize via the relief valve 1600 upon shutdown of the fluid-pressurizing device. The linear actuator 1638, for example, can include an electrically actuated air valve configured to release pneumatic pressure when the associated fluid-pressurizing device is shutdown.

Conventional relief valves used in high-pressure systems typically open when an upstream fluid reaches a first (e.g., opening) pressure, and then equilibrate when the upstream fluid reaches a second (e.g., equilibrium) pressure greater than the opening pressure. For example, the equilibrium pressure can be from about 2% to about 8% greater than the opening pressure. Without wishing to be bound by theory, it is expected that the phenomenon that causes this observed difference between the opening pressure and the equilibrium pressure may be associated with fluid flowing through a conventional relief valve transitioning from laminar flow to turbulent flow as the flow rate of the fluid increases. This transition may decrease the drag exerted by the fluid against the stem of a conventional relief valve and thereby decrease the total opening force acting against the stem. Since a linear actuator of a conventional relief valve typically exerts a constant closing force against a stem, the upstream fluid pressure may increase after the laminar-to-turbulent flow transition until it reaches a pressure high enough to compensate for the decreased drag force acting on the stem. The position of the stem then equilibrates at this higher pressure. Decreasing drag force acting against a stem of a conventional relief valve is only one example of a possible mechanism to explain observed differences between opening pressures and equilibrium pressures. Other mechanisms instead of or in addition to this mechanism may account for the phenomenon and various mechanisms may apply to some sets of operational parameters (e.g., pressures and fluid flow rates) and not others. Other possible mechanisms include, for example, localized decreases in pressure proximate upstream portions of stems and static friction between stems and corresponding seats.

Operating a high-pressure system (e.g., to produce a waterjet) while a conventional relief valve is open typically is not desirable. The fluid in such a system, therefore, is effectively only useable at pressures lower than the opening pressure so that the conventional relief valve remains closed. Components (e.g., valves, seals, conduits, etc.) of the system, however, still typically must be rated for the higher equilibrium pressure since they are exposed to the equilibrium pressure when the conventional relief valve is open. Exposing these system components to pressure cycling and higher equilibrium pressures caused by operation of conventional relief valves can necessitate the use of more expensive components (e.g., having higher pressure ratings) without providing any operational advantage (e.g., greater waterjet velocity). Furthermore, even when higher equilibrium pressures do not necessitate using more expensive components, over time, exposure to these pressures and the accompanying pressure cycling can cause structural damage (e.g., fatigue-related structural damage) in the components, which can be detrimental to the operation of the components and/or cause the components to fail prematurely.

In contrast to conventional relief valves, relief valves configured in accordance with at least some embodiments of the present technology can reduce or eliminate the phenomenon of higher equilibrium pressure than opening pressure. With reference again to FIGS. 16A, 16B and 16D, when the closing force from the linear actuator 1638 acting against the stem 1628 exceeds the opening force from the upstream fluid acting against the stem 1628, the relief valve 1600 can be in the first (e.g., at least generally closed) operational state (FIG. 16A) and the stem 1628 can be in a first (e.g., at least generally closed) position. When the opening force exceeds the closing force, the relief valve 1600 can move from the first operational state through the second (e.g., intermediate) operational state (FIG. 16B) to the third (e.g., equilibrium open) operational state (FIG. 16D) and the stem 1628 can move downstream through a second (e.g., intermediate) position (FIG. 16B) to a third (e.g., equilibrium open) position (FIG. 16D). In some embodiments, the relief valve 1600 does not completely seal flow of the upstream fluid, even when the relief valve 1600 is in the first operational state. For example, a relatively small amount of the fluid can flow between the pin portion 1630 and the tapered inner surface 1626 of the seat 1622 when the relief valve 1600 is in the first operational state. In other embodiments, no or almost no fluid flows between the pin portion 1630 and the tapered inner surface 1626 of the seat 1622 when the relief valve 1600 is in the first operational state. From the first operational state to the third operational state, the flow rate of the fluid can increase until it reaches an equilibrium flow rate (e.g., a steady state flow rate) when the relief valve 1600 is in the third operational state. Accordingly, the relief valve 1600 can be configured to convey the fluid at the equilibrium flow rate when the relief valve 1600 is in the third operational state. The equilibrium flow rate can be a predetermined flow rate (e.g., a flow rate produced by an associated positive-displacement pump).

Figure 16E:
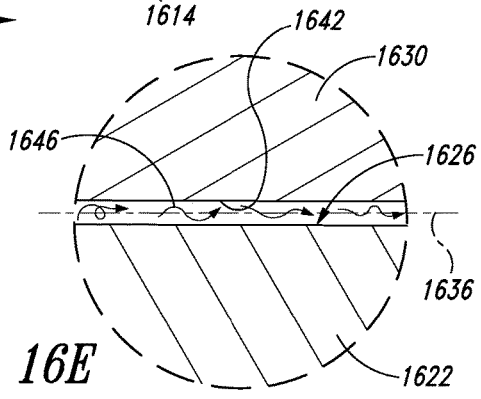
FIG. 16E is an enlarged view of a portion of FIG. 16D.
Figure 16F:
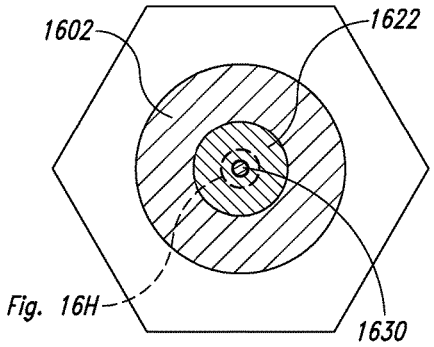
FIG. 16F is a cross-sectional end view taken along line 16F-16F in FIG. 16D.
Figure 16G:
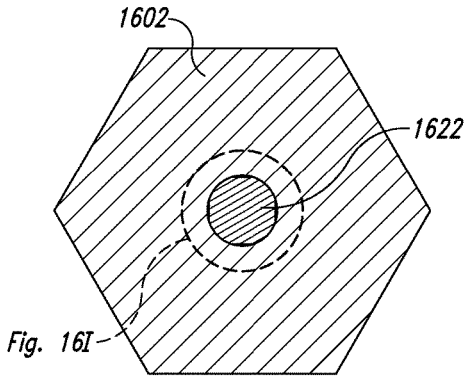
FIG. 16G is a cross-sectional end view taken along line 16E-16E in FIG. 16D.
Figure 16H:
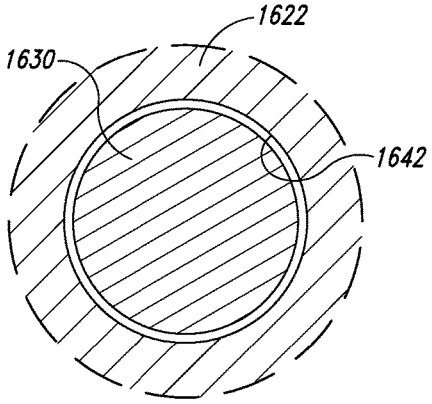
FIG. 16H is an enlarged view of a portion of FIG. 16F.
Figure 16I:
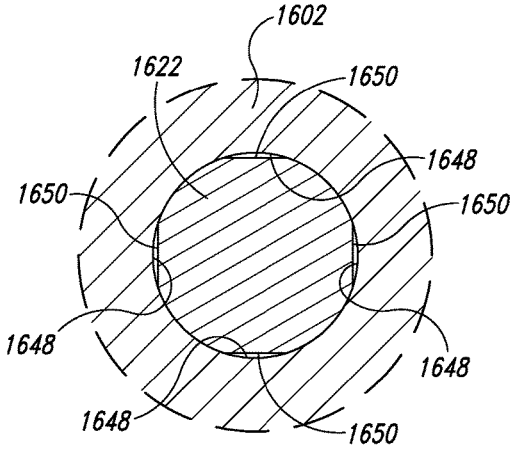
FIG. 16I is an enlarged view of a portion of FIG. 16G.

FIGS. 16C and 16E are enlarged views of portions of FIGS. 16B and 16D, respectively. FIGS. 16F and 16G are cross-sectional end views taken along the lines 16F-16F and 16G-16G, respectively, in FIG. 16D. FIGS. 16H and 16I are enlarged views of portions of FIGS. 16F and 16G, respectively. With reference to FIGS. 16C, 16E and 16H together, the tapered inner surface 1626 of the seat 1622 and the tapered outer surface of the pin portion 1630 can at least partially define a first passage 1642 (e.g., an annular gap) having a cross-sectional area perpendicular to the longitudinal axis 1636 of the stem 1628 that increases as the stem 1628 moves downstream from the first position toward the third position and the relief valve 1600 moves from the first operational state toward the third operational state. In some embodiments, fluid flow though the first passage 1642 can be laminar or relatively laminar (as indicated by arrows 1644 in FIG. 16C) when the relief valve 1600 is in the second operational state, and turbulent (as indicated by arrows 1646 in FIG. 16E) when the relief valve 1600 is in the third operational state. In other embodiments, fluid flow though the first passage 1642 can be consistently laminar, consistently turbulent, turbulent when the relief valve 1600 is in the second operational state and laminar when the relief valve 1600 is in the third operational state, or have other flow characteristics. The fluid flowing though the first passage 1642 may transition from laminar flow to turbulent flow abruptly. For example, when the upstream fluid reaches the opening pressure, the pin portion 1630 may begin to move away from the seat 1622, and the opening force may initially include the force from the fluid acting against the first end portion 1628*a* of the stem 1628 alone or together with the laminar drag force from the fluid acting against the tapered outer surface of the pin portion 1630. As the flow rate through the first passage 1642 increases, the flow of the fluid may become turbulent causing the drag force from the fluid acting against the tapered outer surface of the pin portion 1630 and, thus, the overall opening force against the stem 1628, to decrease.

With reference to FIGS. 16D, 16G and 16I, the flow restrictor 1632 can have a larger cross-sectional area than the pin portion 1630 perpendicular to the longitudinal axis 1636 of the stem 1628. In the illustrated embodiment, the flow restrictor 1632 is at least generally cylindrical with two or more flat portions 1650 circumferentially spaced apart around the perimeter of the flow restrictor 1632 perpendicular to the longitudinal axis 1636 of the stem 1628. The flow restrictor 1632 can be configured to restrict fluid flow within the chamber 1618 downstream from the seat 1622. For example, the flow restrictor 1632 alone or together with the valve body 1602 can define a second passage 1648 when the relief valve 1600 is in the second operational state and/or the third operational state. In the illustrated embodiment, the second passage 1648 is between the flat portions 1650 collectively and an inner surface of the valve body 1602 around the chamber 1618. The second passage 1648 can have a cross-sectional area perpendicular to the longitudinal axis 1636 of the stem 1628 that is at least generally consistent when the relief valve 1600 moves from the first operational state toward the third operational state.

In operation, flow restriction through the second passage 1648 can cause a pressure differential on opposite sides of the flow restrictor 1632. For example, a fluid pressure within a portion of the chamber 1618 upstream from the flow restrictor 1632 can be higher than a fluid pressure within a portion of the chamber 1618 downstream from the flow restrictor 1632. This pressure difference alone or in combination with other opening force acting against the flow restrictor 1632 (e.g., drag from the fluid) can at least partially compensate for a decrease in the opening force acting against the pin portion 1630 when the relief valve 1600 moves from the first operational state toward the third operational state and/or when the relief valve 1600 moves from the second operational state toward the third operational state. The cross-sectional area of the second passage 1648 perpendicular to the longitudinal axis 1636 of the stem 1628, alone or together with other suitable parameters, can be selected to partially compensate, fully compensate, or overcompensate for the a decrease in the opening force acting against the pin portion 1630 when the relief valve 1600 moves from the first operational state toward the third operational state and/or when the relief valve 1600 moves from the second operational state toward the third operational state. In at least some embodiments, the cross-sectional area of the second passage 1648 perpendicular to the longitudinal axis 1636 of the stem 1628 is within a range from about 3 times to about 50 times, within a range from about 5 times to about 30 times, within a range from about 160 times to about 25 times, or within another suitable range of multiples greater than the cross-sectional area of the first passage 1642 perpendicular to the longitudinal axis 1636 of the stem 1628 when the stem 1628 is in the third position and the relief valve 1600 is in the third operational state.

The opening force can include a first opening force acting against the pin portion 1630 and a second opening force acting against the flow restrictor 1632. The cross-sectional area of the second passage 1648 perpendicular to the longitudinal axis 1636 of the stem 1628, alone or together with other suitable parameters, can be selected such that a difference between the second opening force when the stem 1628 is in the second position and the second opening force when the stem 1628 is in the third position is about equal to or greater than a difference between the first opening force when the stem 1628 is in the second position and the first opening force when the stem 1628 is in the third position. Similarly, the cross-sectional area of the second passage 1648 perpendicular to the longitudinal axis 1636 of the stem 1628, alone or together with other suitable parameters, can be selected such that a difference between the second opening force when the stem 1628 is in the first position and the second opening force when the stem 1628 is in the third position is about equal to or greater than a difference between the first opening force when the stem 1628 is in the first position and the first opening force when the stem 1628 is in the third position.

Figure 17A:
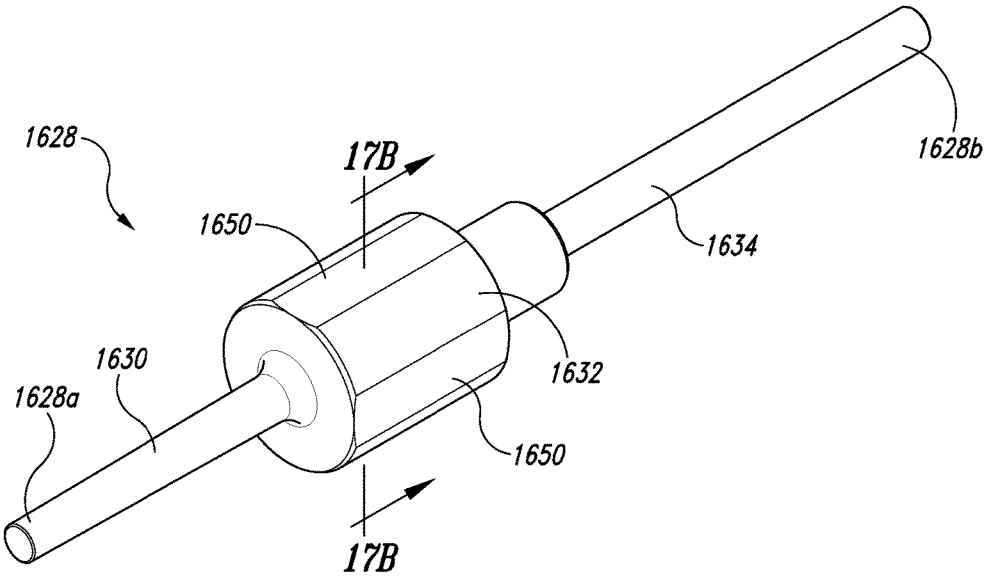
FIG. 17A is an enlarged isometric perspective view illustrating a relief valve stem of the relief valve of FIG. 16A.
Figure 17B:
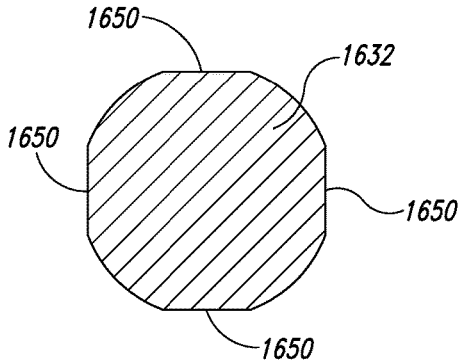
FIG. 17B is a cross-sectional end view taken along line 17B-17B in FIG. 17A.
Figure 18A:
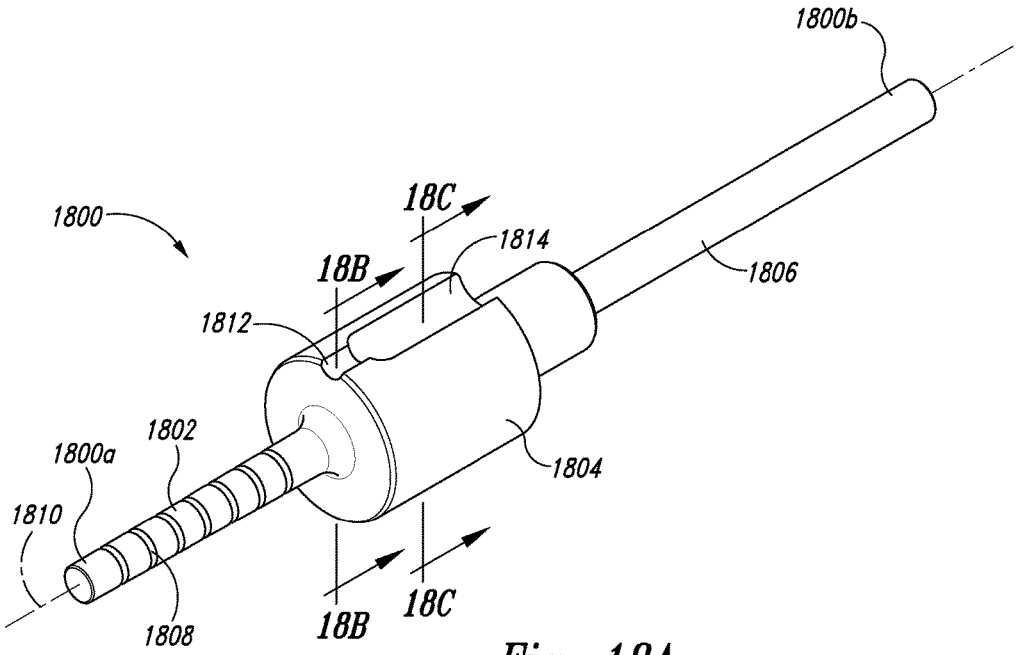
FIG. 18A is an enlarged isometric perspective view illustrating a relief valve stem configured in accordance with another embodiment of the present technology.
Figure 18B:
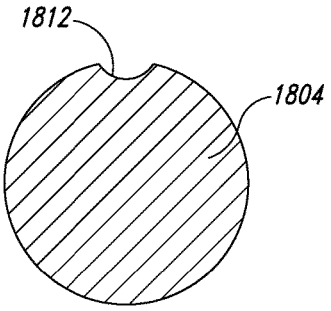
FIG. 18B is a cross-sectional end view taken along line 18B-18B in FIG. 18A.
Figure 18C:
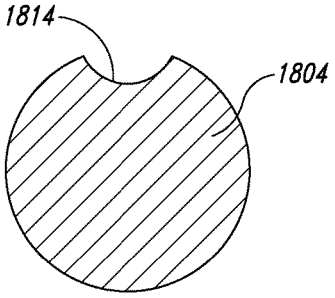
FIG. 18C is a cross-sectional end view taken along line 18C-18C in FIG. 18A.

FIGS. 17A-21B are enlarged isometric perspective views and corresponding cross-sectional end views illustrating relief valve stems configured in accordance with embodiments of the present technology. FIGS. 17A and 17B illustrate the stem 1628 of the relief valve 1600. With reference to FIGS. 18A-18C, a stem 1800 can include a pin portion 1802 operably positioned toward a first end portion 1800*a*, a connector shaft 1806 operably positioned toward a second end portion 1800*b*, and a flow restrictor 1804 positioned therebetween. The pin portion 1802 can have two or more annular grooves 1808 (one identified in FIG. 18A) extending around the circumference of the pin portion 1802 at spaced apart planes perpendicular to a longitudinal axis 1810 of the stem 1800. The annular grooves 1808 can facilitate turbulent flow adjacent to the pin portion 1802. The flow restrictor 1804 can include a first notch 1812 or other suitable channel beginning at a first end of the flow restrictor 1804 proximate the pin portion 1802, and a second notch 1814 or other suitable channel larger than the first notch 1812 in length and cross-sectional area, extending from the first notch 1812 toward a second end of the flow restrictor 1804 proximate the connector shaft 1806. The first notch 1812 can at least partially define a second passage downstream from a first passage at least partially defined by the pin portion 1802 when the stem 1800 is operably positioned within a valve body (not shown).

Figure 19A:
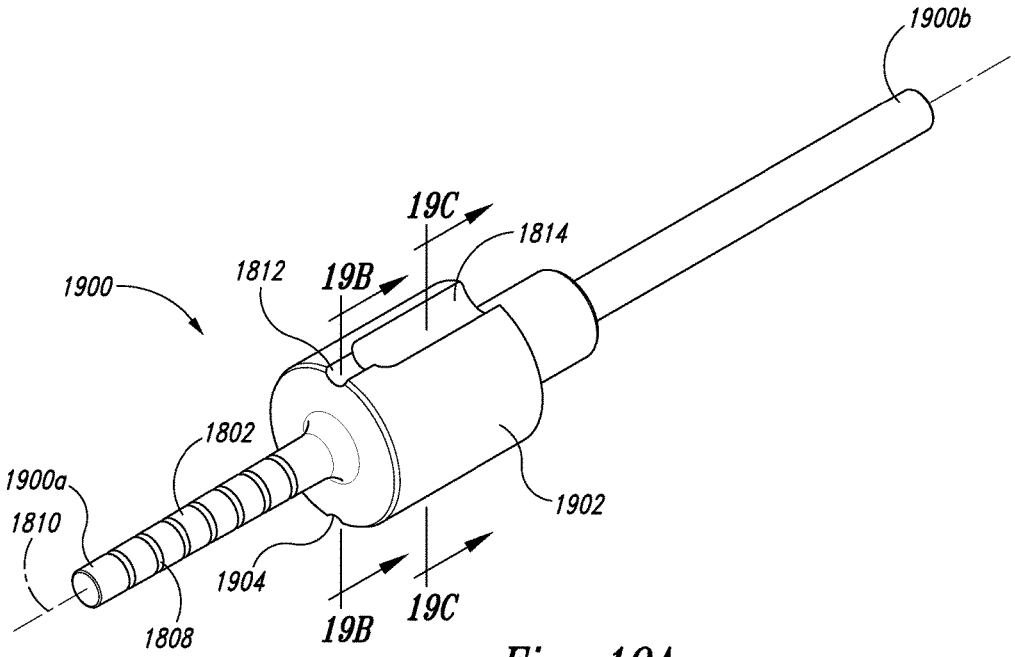
FIG. 19A is an enlarged isometric perspective view illustrating a relief valve stem configured in accordance with another embodiment of the present technology.
Figure 19B:
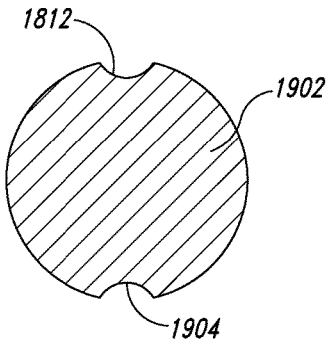
FIG. 19B is a cross-sectional end view taken along line 19B-19B in FIG. 19A.
Figure 19C:
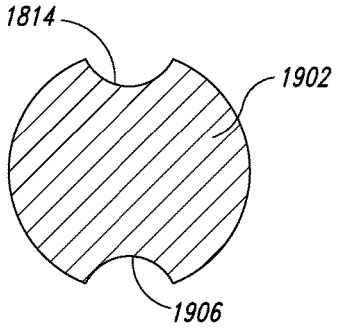
FIG. 19C is a cross-sectional end view taken along line 19C-19C in FIG. 19A.

With reference to FIGS. 19A-19C, a stem 1900 can include the pin portion 1802 operably positioned toward a first end portion 1900*a*, the connector shaft 1806 operably positioned toward a second end portion 1900*b*, and a flow restrictor 1902 positioned therebetween. The flow restrictor 1902 can include the first notch 1812 and the second notch 1814 as well as a third notch 1904 or other suitable channel and a fourth notch 1906 or other suitable channel circumferentially opposite to the first notch 1812 and the second notch 1814, respectively. The first and third notches 1812, 1904 collectively can at least partially define a second passage downstream from a first passage at least partially defined by the pin portion 1802 when the stem 1900 is operably positioned within a valve body (not shown).

With reference to FIGS. 20A and 20B, a stem 2000 can include the pin portion 1802 operably positioned toward a first end portion 2000*a*, a connector shaft 2004 operably positioned toward a second end portion 2000*b*, and a flow restrictor 2002 positioned therebetween. The flow restrictor 2002 can be cylindrical and configured to at least partially define an annular second passage downstream from a first passage at least partially defined by the pin portion 1802 when the stem 2000 is operably positioned within a valve body (not shown).

With reference to FIGS. 21A and 21B, a stem 2100 can include a pin portion 2101 operably positioned toward a first end portion 2100*a*, a connector shaft 2104 operably positioned toward a second end portion 2100*b*, and a flow restrictor 2102 positioned therebetween. The flow restrictor 2102 can include a hole 2106 offset relative to the longitudinal axis 1810 of the stem 2100 and extending from a first end of the flow restrictor 2102 proximate the pin portion 2101 toward a second end of the flow restrictor 2102 proximate the connector shaft 2104. The hole 2106 can define a second passage downstream from a first passage at least partially defined by the pin portion 2101 when the stem 2100 is operably positioned within a valve body (not shown). In some embodiments, the pin portion 2101 and the connector shaft 2104 are portions of a rod 2108 that can be inserted through a central bore 2110 in the flow restrictor 2102, which can then be fixedly attached (e.g., pressed, glued, or welded) to the rod 2108. The hole 2106 can be formed (e.g., drilled) in the flow restrictor 2102 prior to attaching the flow restrictor 2102 to the rod 2108 to facilitate manufacturing. In other embodiments, the pin portion 2101, the flow restrictor 2102, and the connector shaft 2104 can be integrally formed.

Table 2 (below) shows several examples of values for parameters of the stem 2100 (e.g., the minimum diameter of the pin portion 2101, the minimum cross-sectional area of the pin portion 2101, the diameter of the hole 2106, the diameter of the flow restrictor 2102, and the cross-sectional area of the flow restrictor 2102), examples of values for parameters of a system including a relief valve including the stem 2100 (e.g., the system pressure), examples of experimentally obtained values (e.g., the observed pressure increase without the flow restrictor 2102, the flow rate through the relief valve when relief valve is open), examples of values derived from parameters of the stem 2100, parameters of the system, and/or experimentally obtained values (e.g., the force due to the observed pressure increase, the pressure difference across the flow restrictor 2102, and the force due to the flow restrictor 2102). These examples of values are shown for a system including a 50 horsepower pump and for a system including a 100 horsepower pump. In other embodiments, the values shown in Table 2 can be different.

TABLE 2

| Variable | Unit | 50 HP Pump | Multiplier | 100 HP Pump |
|---|---|---|---|---|
| System Pressure | psi | 55000 | | 55000 |
| Observed Pressure Increase without Flow Restrictor | psi | 3000 | | 3000 |
| Pin Portion Minimum Diameter | in | 0.077 | ×1.414 | 0.108878 |
| Pin Portion Minimum Cross-Sectional Area | in^2 | 0.004656626 | ×2 | 0.009310439 |
| Force due to Observed Pressure Increase | lbs | 13.96987713 | ×2 | 27.93131646 |
| Flow Restrictor Hole Diameter | in | 0.077 | ×1.414 | 0.108878 |
| Flow Rate When Relief Valve is Open | gpm | 1.4 | ×2 | 2.8 |
| Pressure Difference Across Flow Restrictor | psi | 126.4312935 | | 126.5076926 |
| Flow Restrictor Diameter | in | 0.375 | ×1.414 | 0.53025 |
| Flow Restrictor Cross-Sectional Area | in^2 | 0.110446617 | ×2 | 0.220826524 |
| Force due to Flow Restrictor | lbs | 13.96390862 | ×2 | 27.93625398 |

Table 2 demonstrates that various parameters of the stem 2100 can be selected to cause the flow restrictor 2102 to about equally compensate for a particular increase in system pressure (e.g., an increase empirically determined by opening a relief valve without a flow restrictor). Variations of the values shown in Table 2 can be used to select suitable cross sectional areas of the second passages (or other suitable parameters) of the relief valves discussed above with reference to FIGS. 1A-21 to partially compensate, fully compensate, or overcompensate for various increases in system pressure in particular systems having particular sets of dimensions and features.

As discussed above with reference to FIGS. 16A, 16B, and 16D, in some embodiments, the relief valve 1600 is configured to balance a variable upstream fluid force against a consistent opposing force from the linear actuator 1638. In this way, the relief valve 1600 can automatically maintain upstream fluid pressure. In other embodiments, the relief valve 1600 can be configured to balance a variable upstream fluid force against a variable opposing force from the linear actuator 1638. For example, rather than setting the linear actuator 1638 to exert a consistent opposing force against the stem 1628, the linear actuator 1638 can be dynamically controlled within a feedback loop. A controller (not shown) can be configured to receive an input parameter (e.g., a detected pressure from a pressure sensor positioned upstream from the stem 1628, a operational state of an associated control valve, an operational state of an associated fluid-pressurizing device, or another suitable input parameter) and to control operation of the linear actuator 1638 based on the input parameter. For example, the linear actuator 1638 can be pneumatic, hydraulic, or electric and the controller can be configured to change, respectively, a pneumatic, hydraulic, or electric feed to the linear actuator 1638 based on the input parameter. Generating the input parameter, detecting the input parameter, and controlling the linear actuator 1638 in response to the input parameter can occur rapidly enough to maintain the pressure upstream from the stem 1628 at least generally constant.

In some embodiments, the flow restrictor 128 is configured to hydraulically compensate for a difference between an opening pressure of the relief valve 1600 and an equilibrium pressure of the relief valve 1600. In other embodiments, the flow restrictor 128 can be absent and dynamic control of the relief valve 1600 within a feedback loop can compensate for this difference. In still other embodiments, the flow restrictor 128 can be used as a backup to dynamic control of the relief valve 1600 within a feedback loop. For example, the cross-sectional area of the second passage 1648 perpendicular to the longitudinal axis 1636 of the stem 1628 can be increased such that the flow restrictor 128 partially compensates for a difference between an opening pressure of the relief valve 1600 and an equilibrium pressure of the relief valve 1600 when dynamic control of the relief valve 1600 within a feedback loop is not available.

Selected Examples of Waterjet Systems

Figure 22:
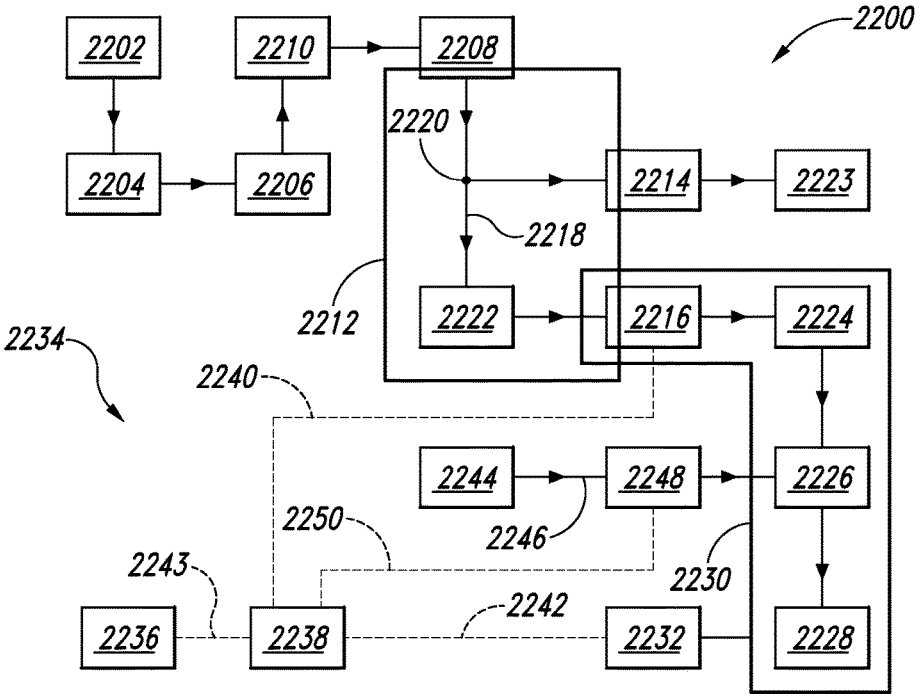
FIGS. 22 and 23 are schematic block diagrams illustrating waterjet systems including control valves configured in accordance with embodiments of the present technology.

FIG. 22 is a schematic block diagram illustrating a waterjet system 2200 configured in accordance with an embodiment of the present technology. The system 2200 can include a fluid inlet 2202, a conditioning unit 2204 downstream from the fluid inlet 2202, and a reservoir 2206 downstream from the conditioning unit 2204. The system 2200 can further include a main fluid-pressurizing device 2208 (e.g., a positive-displacement pump) and a charge fluid-pressurizing device 2210 configured to move fluid from the reservoir 2206 to the main fluid-pressurizing device 2208. The main fluid-pressurizing device 2208 can be configured to pressurize the fluid to a pressure suitable for waterjet processing. The pressure, for example, can be greater than about 20,000 psi (e.g., within a range from about 20,000 psi to about 120,000 psi), greater than about 40,000 psi (e.g., within a range from about 40,000 psi to about 120,000 psi), greater than about 50,000 psi (e.g., within a range from about 50,000 psi to about 120,000 psi), greater than another suitable threshold, or within another suitable range. In the illustrated embodiment, the system 2200 includes a fluid container 2212 operably connected to the main fluid-pressurizing device 2208 as well as to a relief valve 2214 and a control valve 2216 of the system 2200. The fluid container 2212 can include one or more conduits, fittings, housings, vessels, or other suitable components defining an internal volume and configured to hold the fluid at the pressure generated by the main fluid-pressurizing device 2208. For example, the fluid container 2212 can include a fluid conduit 2218 operably positioned between the main fluid-pressurizing device 2208 and the control valve 2216, as well as a junction 2220 and a movable joint 2222 (e.g., a swivel joint) along the fluid conduit 2218. A first portion of a fluid volume within the fluid container 2212 can flow through the junction 2220 to the control valve 2216, and a second portion of the fluid volume can flow through the junction 2220 to a relief outlet 2223 of the system 2200 via the relief valve 2214.

The fluid container 2212 can extend between components of the system 2200 that are typically stationary during operation (e.g., the main fluid-pressurizing device 2208) and components of the system 2200 that typically move during operation (e.g., relative to a workpiece to execute a cut). In at least some embodiments, the fluid container 2212 can span a distance greater than about 20 feet (e.g., within a range from about 20 feet to about 200 feet), greater than about 40 feet (e.g., within a range from about 40 feet to about 200 feet), greater than another suitable threshold, or within another suitable range. To withstand high pressures, components of the fluid container 2212 can be relatively rigid. For example, the fluid conduit 2218 can be a metal pipe with an outer diameter of ⅜ inch and an inner diameter of ⅛ inch. The movable joint 2222 can facilitate a transition from stationary components to movable components in addition to or instead of any flexibility (e.g., play) in the fluid container 2212. Accordingly, the movable joint 2222 can include a high-pressure seal (not shown) that is prone to fatigue-related structural damage due to pressure cycling.

The control valve 2216 can be at least generally similar in structure and/or function to the control valves described above with reference to FIGS. 1A-14B. Similarly, the relief valve 2214 can be at least generally similar in structure and/or function to the relief valves described above with reference to FIGS. 16A-21B. In some embodiments, the control valve 2216 is configured for shutting off flow of the fluid and throttling flow of the fluid. In other embodiments, the control valve 2216 can be configured for throttling flow of the fluid without completely shutting of flow of the fluid. In these embodiments, for example, the control valve 2216 can be used with a separate shutoff valve upstream or downstream from the control valve 2216.

The relief valve 2214 can be at least generally similar in structure and function to one or more of the relief valves described above with reference to FIGS. 16A-21B. The relief valve 2214 can be configured to automatically vary a flow rate of the second portion of the fluid volume in response to the control valve 2216 varying the flow rate of the first portion of the fluid volume. For example, when the control valve 2216 reduces the flow rate of the first portion of the fluid volume, the relief valve 2214 can be configured to proportionally increase the flow rate of the second portion of the fluid volume such that the pressure of the fluid volume within the fluid container 2212 remains generally constant or decreases. Alternatively, the relief valve 2214 can be eliminated (e.g., when the main fluid-pressurizing device 2208 is a pressure-compensated pump). Together, the control valve 2216 and the relief valve 2214 or the main fluid-pressurizing device 2208 (e.g., when the main fluid-pressurizing device 2208 is a pressure-compensated pump) can cause the pressure within the fluid container 2212 to remain at least generally constant during operation of the system 2200, which can improve the operation and/or prolong the lifespan of the movable joint 2222. In many cases, the system 2200 can include multiple movable joints 2222 or other components adversely affected by pressure cycling. Accordingly, reducing pressure cycling within the fluid container 2212 can significantly reduce the cost-of-ownership the system 2200 by reducing maintenance and/or replacement of these components, among other potential advantages.

The system 2200 can further include an orifice element 2224, a mixing chamber 2226, and a waterjet outlet 2228, which can be included with the control valve 2216 in a waterjet assembly 2230. The orifice element 2224 and the mixing chamber 2226 can be parts of a cutting head that includes the waterjet outlet 2228. The system 2200 can include a second actuator 2232 operably connected to the waterjet assembly 2230 and configured to move the waterjet assembly 2230 relative to a workpiece (not shown) during operation of the system 2200. The control valve 2216 can have various suitable positions within the system 2200. In the illustrated embodiment, the control valve 2216 is downstream from the movable joint 2222 and within the movable waterjet assembly 2230. The second actuator 2232 can be configured to move the waterjet assembly 2230 over an area greater than about 10 square feet (e.g., from about 10 square feet to about 5000 square feet), greater than about 20 square feet (e.g., from about 20 square feet to about 5000 square feet), greater than about 50 square feet (e.g., from about 50 square feet to about 5000 square feet), greater than about 100 square feet (e.g., from about 100 square feet to about 5000 square feet), greater than another suitable threshold area, or within another suitable range of areas. Furthermore, the control valve 2216 can be less than about 50 inches (e.g., within a range from about 0.5 inch to about 50 inches), less than about 25 inches (e.g., within a range from about 0.5 inch to about 25 inches), less than about 20 inches (e.g., within a range from about 0.5 inch to about 20 inches), less than about 15 inches (e.g., within a range from about 0.5 inch to about 15 inches), less than about 10 inches (e.g., within a range from about 0.5 inch to about 10 inches), less than about 5 inches (e.g., within a range from about 0.5 inch to about 5 inches), less than about 2 inches (e.g., within a range from about 0.5 inch to about 2 inches), less than about 1 inch (e.g., within a range from about 0.5 inch to about 1 inch), less than another suitable threshold distance, or within another suitable range of distances from the waterjet outlet 2228 and/or the workpiece.

The second actuator 2232 can be configured to move the waterjet assembly 2230 along a processing path (e.g., cutting path) in two or three dimensions and, in at least some cases, to tilt the waterjet assembly 2230 relative to the workpiece. The processing path can be predetermined, and operation of the second actuator 2232 can be automated. For example, the system 2200 can include a control assembly 2234 having a user interface 2236 (e.g., a touch screen) and a controller 2238 with a processor (not shown) and memory (also not shown). The control assembly 2234 can be operably connected to the control valve 2216 and the second actuator 2232 (e.g., via the controller 2238). The control valve 2216 can be configured to receive a first signal 2240 (e.g., including multiple individual signals) from the control assembly 2234 and to vary the flow rate of the fluid passing through the control valve 2216 in response to the first signal 2240 to change the pressure of the fluid upstream from the orifice element 724 and thereby change the velocity of the fluid exiting the waterjet outlet 2228. Similarly, the second actuator 2232 can be configured to receive a second signal 2242 (e.g., including multiple individual signals) from the control assembly 2234 and to move the waterjet assembly 2230 along the processing path in response to the second signal 2242. Furthermore, the control assembly 2234 can include one or more of the control features described above with reference to FIGS. 14A and 14B.

The user interface 2236 can be configured to receive input from a user and to send data 2243 based on the input to the controller 2238. The input can include, for example, one or more specifications (e.g., coordinates or dimensions) of the processing path and/or one or more specifications (e.g., material type or thickness) of the workpiece. The control assembly 2234 can be configured to generate the first and second signals 2240, 2242 at least partially based on the data 2243. For example, the control assembly 2234 can be configured to generate the first signal 2240 at least partially based on a remaining portion of the workpiece after processing is complete (e.g., an inverse of the processing path). In some cases, the remaining portion includes one or more narrow portions (e.g., bridging portions between closely spaced cuts). The control assembly 2234 can be configured to identify the narrow portions and to instruct the control valve 2216 via the first signal 2240 to reduce the flow rate of the fluid passing through the control valve 2216 and thereby reduce the pressure of the fluid upstream from the orifice element 724 and the velocity of the fluid exiting the waterjet outlet 2228 at portions of the processing path adjacent to the narrow portions. This can be useful, for example, to reduce the likelihood of the narrow portions breaking due to the impact force of the fluid during the cuts.

The control assembly 2234 can also be configured to instruct the second actuator 2232 via the second signal 2242 to reduce the rate of movement of the waterjet assembly 2230 along the portions of the processing path adjacent to the narrow portions to compensate for a slower cutting velocity of the waterjet when the flow rate of the fluid flowing through the control valve 2216 is lowered. Accordingly, the rate of movement of the waterjet assembly 2230 and the flow rate of the fluid flowing through the control valve 2216 can be suitably coordinated to cause an at least generally consistent eroding power along at least a portion of the processing path. Furthermore, the control assembly 2234 can be configured to instruct the second actuator 2232 via the second signal 2242 to tilt the waterjet assembly 2230 along the portions of the processing path adjacent to the narrow portions (e.g., to reduce taper). Further information concerning using tilt to reduce taper can be found in U.S. Pat. No. 7,035,708, which is incorporated herein by reference in its entirety.

In addition to portions of the processing path adjacent to the narrow portions, other portions of processing paths also may benefit from reduced-velocity waterjets. For example, some three-dimensional etching applications can include rasterizing a three-dimensional image and cutting a workpiece to different depths as the waterjet assembly 2230 traverses back and forth relative to the workpiece. One approach to controlling the depth is to change the speed of the waterjet assembly 2230 and thereby changing the waterjet exposure time at different portions of the workpiece. In addition or alternatively, the control assembly 2234 can be configured to instruct the control valve 2216 via the first signal 2240 to change the flow rate of the fluid passing through the control valve 2216 and thereby change the pressure of the fluid upstream from the orifice element 724 and the velocity of the fluid exiting the waterjet outlet 2228 to achieve suitable changes in cutting depth for shaping the work piece. Further information concerning three-dimensional etching can be found in U.S. Patent Application Publication No. 2009/0311944, which is incorporated herein by reference in its entirety.

In some cases, the processing path includes two or more spaced-apart cuts individually having a starting point and an ending point. The control assembly 2234 can be configured to instruct the control valve 2216 via the first signal 2240 to increase the flow rate of the fluid passing through the control valve 2216 and thereby increase the pressure of the fluid upstream from the orifice element 724 and the velocity of the fluid exiting the waterjet outlet 2228 at the starting points (e.g., in a throttled-piercing operation). Similarly, the control assembly 2234 can be configured to instruct the control valve 2216 via the first signal 2240 to reduce the flow rate of the fluid passing through the control valve 2216 and thereby reduce the pressure of the fluid upstream from the orifice element 724 and the velocity of the fluid exiting the waterjet outlet 2228 at the ending points (e.g., in a shutoff operation). Gradually increasing the flow rate of the fluid passing through the control valve 2216 at the starting points can be useful, for example, to reduce the possibility of damaging (e.g., cracking or spalling) the workpiece (e.g., when the workpiece is brittle). In some cases, the starting and ending points for one or more of the spaced-apart cuts individually are at least generally the same (e.g., have at least generally the same coordinates). This can be the case, for example, when the spaced-apart cuts are perimeters of cut-away regions of the workpiece. When many spaced-apart cuts are included in a processing path, and in other cases, it can be useful to shutoff a waterjet rapidly at the end of each cut to improve efficiency. In contrast, as discussed above, it can also be useful to initiate the waterjet gradually at the beginning of the cut to reduce the possibility of damaging to the workpiece. Accordingly, the control assembly 2234 can be configured to instruct the control valve 2216 via the first signal 2240 to increase the flow rate of the fluid passing through the control valve 2216 at the starting point at a first rate of change and to decrease the flow rate of the fluid passing through the control valve 2216 at the ending point at a second rate of change greater than the first rate of change. The control assembly 2234 can be configured to instruct the control valve 2216 via the first signal 2240 to rapidly pulse the flow rate of the fluid passing through the control valve 2216 during piercing, which can also be useful to reduce damage to a workpiece (e.g., workpieces made of brittle and/or composite materials).

The system 2200 can further include an abrasive supply 2244 (e.g., a hopper), an abrasive conduit 2246 operably connecting the abrasive supply 2244 to the mixing chamber 2226, and an abrasive metering valve 2248 along the abrasive conduit 2246. The abrasive conduit 2246 can be flexible or otherwise configured to maintain the connection between the abrasive supply 2244 and the mixing chamber 2226 when the abrasive supply 2244 is stationary and the mixing chamber 2226 is movable with the waterjet assembly 2230. Alternatively, the abrasive supply 2244 can be part of the waterjet assembly 2230. The abrasive metering valve 2248 can be configured to vary the flow rate of abrasive material (e.g., particulate abrasive material) entering the mixing chamber 2226 by a suitable modality (e.g., a supplied vacuum that draws the abrasive material in the mixing chamber 2226, a pressurized feed that pushes the abrasive material into the mixing chamber 2226, or an adjustable abrasive flow passage) alone or in combination with the Venturi effect. Further information concerning abrasive metering valves can be found in U.S. Patent Application Publication No. 2012/0252325 and U.S. Patent Application Publication No. 2012/0252326, which are incorporated herein by reference in their entireties. Alternatively, the abrasive metering valve 2248 can be eliminated. For example, the abrasive material can be drawn into the mixing chamber 2226 by the Venturi effect alone.

The abrasive metering valve 2248 can be operably connected to the control assembly 2234 (e.g., via the controller 2238). The abrasive supply 2244 can be configured to receive a third signal 2250 (e.g., including multiple individual signals) from the control assembly 2234 and to vary the flow rate of abrasive material entering the mixing chamber 2226 in response to the third signal 2250. When the workpiece is brittle, and in other cases, it can be useful to avoid impacting the workpiece with a waterjet not having entrained abrasive material. A lack of abrasive material at the beginning of a cut, for example, can increase the possibility of damaging the workpiece during piercing. Similarly, a lack of abrasive material at the end of a cut, for example, can increase the possibility of producing an incomplete cut. Accordingly, the control assembly 2234 can be configured to begin a flow of the abrasive material from the abrasive supply 2244 toward the mixing chamber 2226 a suitable period of time (e.g., about 1 second, a period of time within a range from about 0.05 to about 5 seconds, or a period of time within another suitable range) before the control valve 2216 initiates a throttled-piercing operation and/or to end the flow of the abrasive material from the abrasive supply 2244 toward the mixing chamber 2226 a suitable period of time (e.g., about 1 second, a period of time within a range from about 0.05 to about 5 seconds, or a period of time within another suitable range) after the control valve 2216 completes a shutoff operation. Furthermore, the control assembly 2234 can be configured to instruct the abrasive metering valve 2248 via the third signal 2250 to change the flow rate of abrasive material entering the mixing chamber 2226 in concert with instructing the control valve 2216 via the first signal 2240 to vary the flow rate of the fluid passing through the control valve 2216 and/or with instructing the second actuator 2232 via the second signal 2242 to reduce the rate of movement of the waterjet assembly 2230 so as to cause an at least generally consistent eroding power along at least a portion of the processing path.

The first, second, and third signals 2240, 2242, 2250 can be accompanied by electronic communication to the control assembly 2234 (e.g., via the controller 2238) from the control valve 2216, the second actuator 2232, and the abrasive metering valve 2248, respectively. Similarly, the data 2243 can include two-way communication between the user interface 2236 and the controller 2238. When the control valve 2216 includes an actuator having an electric motor (e.g., a stepper motor), the control valve 2216 can be configured to transmit information regarding operation of the motor to the control assembly 2234. With reference to FIGS. 1A, 1B, and 22 together, as the end portion 136*b* of the pin 136 approaches the contact surface 148, the force on the pin 136 typically decreases gradually and predictably. When the pin 136 reaches the shutoff position, the end portion 136*b* of the pin 136 presses against the contact surface 148 and the force on the pin 136 typically increases abruptly. These changes in the force on the pin 136 can cause corresponding changes in the current drawn by the electric motor. Therefore, by monitoring the current drawn by the electric motor, the control assembly 2234 can verify that the pin 136 is in the shutoff position. Furthermore, in at least some cases, the relationship between the pressure of the fluid downstream from the pin 136 and the current drawn by the electric motor can have a mathematical correspondence. The control assembly 2234 can be configured to use this correspondence to determine the pressure of the fluid upstream from the orifice element 724 and the velocity of the fluid exiting the waterjet outlet 2228 based on the current drawn by the electric motor and to report the results via the user interface 2236.

Figure 23:
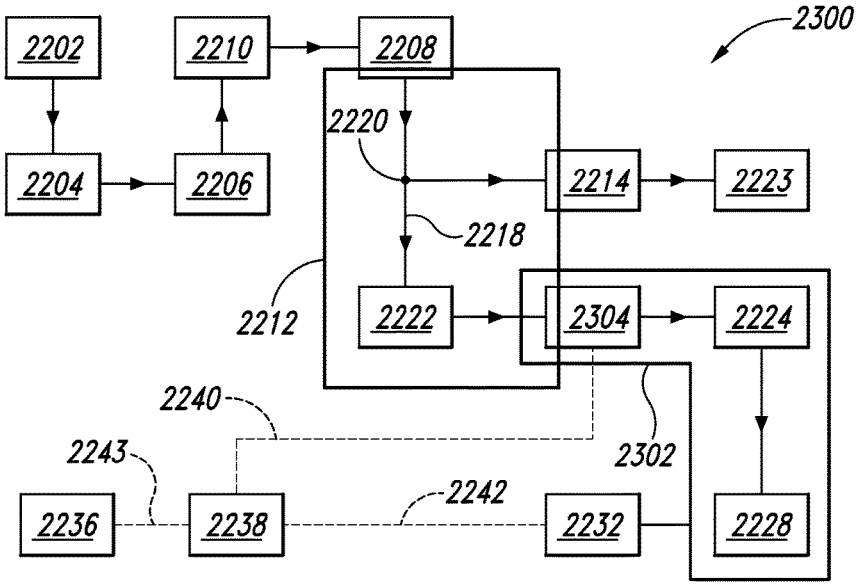

FIG. 23 is a schematic block diagram illustrating a waterjet system 2300 configured in accordance with another embodiment of the present technology. The system 2300 can be similar to the system 2200 shown in FIG. 22, but without the abrasive supply 2244, the abrasive conduit 2246, and the abrasive metering valve 2248. The system 2300 can also include a waterjet assembly 2302 having a control valve 2304 different than the control valve 2216 of the system 2200 shown in FIG. 22. The control valve 2304 can be configured for throttling without complete shutoff. For example, the control valve 2304 can include the seat 200 shown in FIG. 2. In some cases, complete shutoff of fluid exiting the waterjet outlet 2228 may be unnecessary. For example, with reference to FIG. 22, it can be undesirable to allow low-pressure fluid to pass through the mixing chamber 2226, because it can wet abrasive material within the abrasive conduit 2246 and cause clogging. With reference again to FIG. 23, when the system 2300 is not configured for use of abrasive material, this advantage of complete shutoff may not apply. Accordingly, fluid may trickle from the waterjet outlet 2228 at a velocity insufficient to erode the workpiece when the system 2300 is on standby or between cutting portions of a processing path.

Figure 24:
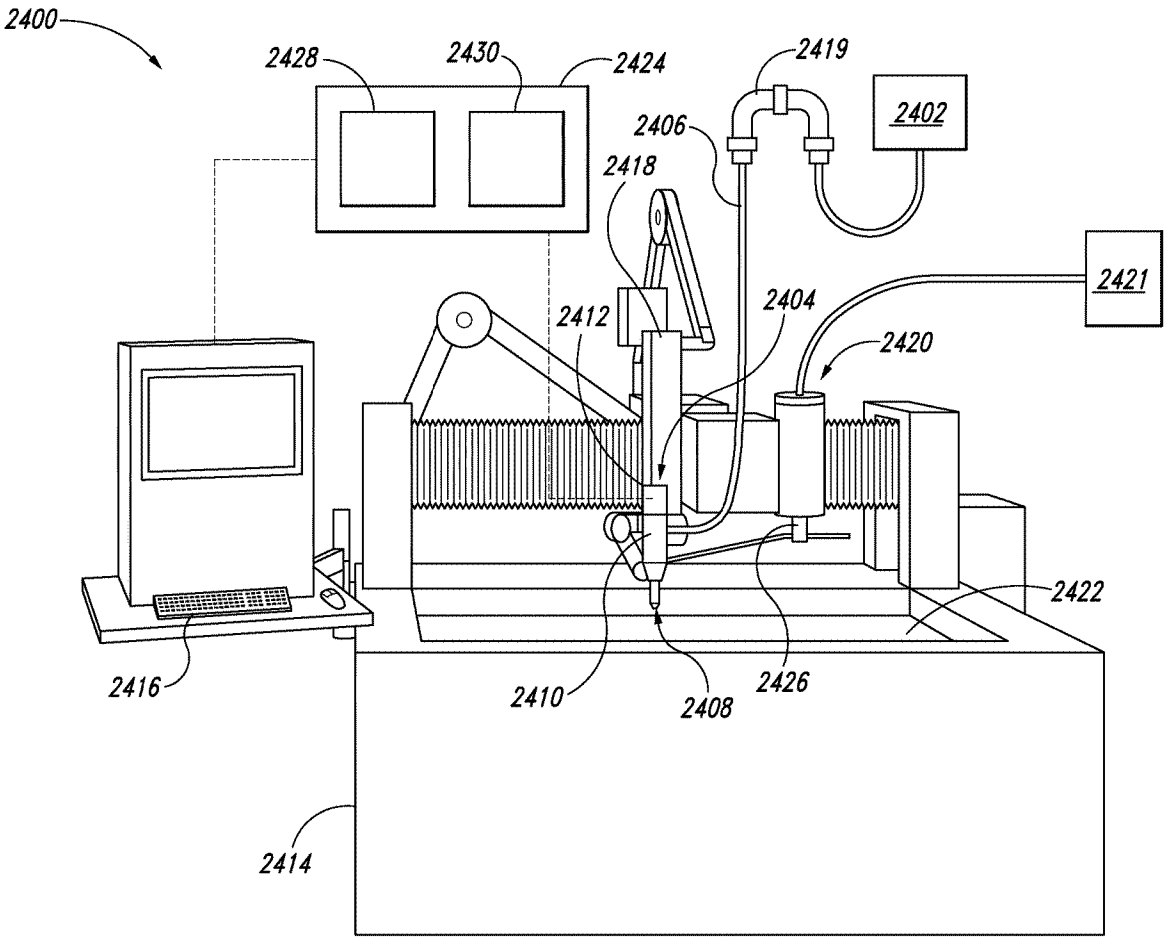
FIG. 24 is a perspective view illustrating a waterjet system including a control valve configured in accordance with another embodiment of the present technology.

FIG. 24 is a perspective view illustrating a waterjet system 2400 configured in accordance with another embodiment of the present technology. The system 2400 can include a fluid-pressurizing device 2402 (shown schematically) (e.g., a pump) configured to pressurize a fluid to a pressure suitable for waterjet processing, and a waterjet assembly 2404 operably connected to the fluid-pressurizing device 2402 via a conduit 2406 extending between the fluid-pressurizing device 2402 and the waterjet assembly 2404. The waterjet assembly 2404 can include a waterjet outlet 2408 and a control valve 2410 upstream from the waterjet outlet 2408. The control valve 2410 can be at least generally similar in structure and/or function to the control valves described above with reference to FIGS. 1A-14B. For example, the control valve 2410 can be configured to receive fluid from the fluid-pressurizing device 2402 via the conduit 2406 at a pressure suitable for waterjet processing (e.g., a pressure greater than about 30,000 psi) and to selectively reduce the pressure of the fluid (e.g., to two or more different steady-state pressures within a range from about 1,000 psi to about 25,000 psi) as the fluid flows through the control valve 2410 toward the waterjet outlet 2408. For example, the control valve 2410 can include a first actuator 2412 configured to control the position of a pin (not shown) within the control valve 2410 and thereby selectively reduce the pressure of the fluid.

The system 2400 can further include a base 2414, a user interface 2416 supported by the base 2414, and a second actuator 2418 configured to move the waterjet assembly 2404 relative to the base 2414 and other stationary components of the system (e.g., the fluid-pressurizing device 2402). For example, the second actuator 2418 can be configured to move the waterjet assembly 2404 along a processing path (e.g., cutting path) in two or three dimensions and, in at least some cases, to tilt the waterjet assembly 2404 relative to the base 2414. The conduit 2406 can include a joint 2419 (e.g., a swivel joint or another suitable joint having two or more degrees of freedom) configured to facilitate movement of the waterjet assembly 2404 relative to the base 2414. Thus, the waterjet assembly 2404 can be configured to direct a waterjet including the fluid toward a workpiece (not shown) supported by the base 2414 (e.g., held in a jig supported by the base 2414) and to move relative to the base 2414 while directing the waterjet toward the workpiece.

The system 2400 can further include an abrasive-delivery apparatus 2420 configured to feed particulate abrasive material from an abrasive material source 2421 to the waterjet assembly 2404 (e.g., partially or entirely in response to a Venturi effect associated with a fluid jet passing through the waterjet assembly 2404). Within the waterjet assembly 2404, the particulate abrasive material can accelerate with the waterjet before being directed toward the workpiece. In some embodiments the abrasive-delivery apparatus 2420 is configured to move with the waterjet assembly 2404 relative to the base 2414. In other embodiments, the abrasive-delivery apparatus 2420 can be configured to be stationary while the waterjet assembly 2404 moves relative to the base 2414. The base 2414 can include a diffusing tray 2422 configured to hold a pool of fluid positioned relative to the jig so as to diffuse kinetic energy of the waterjet from the waterjet assembly 2404 after the waterjet passes through the workpiece. The system 2400 can also include a controller 2424 (shown schematically) operably connected to the user interface 2416, the first actuator 2412, and the second actuator 2418. In some embodiments, the controller 2424 is also operably connected to an abrasive-metering valve 2426 (shown schematically) of the abrasive-delivery apparatus 2420. In other embodiments, the abrasive-delivery apparatus 2420 can be without the abrasive-metering valve 2426 or the abrasive-metering valve 2426 can be configured for use without being operably connected to the controller 2424. The controller 2424 can include a processor 2428 and memory 2430 and can be programmed with instructions (e.g., non-transitory instructions contained on a computer-readable medium) that, when executed, control operation of the system 2400.

CONCLUSION

This disclosure is not intended to be exhaustive or to limit the present technology to the precise forms disclosed herein. Although specific embodiments are disclosed herein for illustrative purposes, various equivalent modifications are possible without deviating from the present technology, as those of ordinary skill in the relevant art will recognize. For example, in the control valves discussed above with reference to FIGS. 1A-17, the pins can be stationary and the associated seat or seats can be movable to change the flow rate of fluid passing through the control valves. In some cases, well-known structures and functions have not been shown or described in detail to avoid unnecessarily obscuring the description of the embodiments of the present technology. Although steps of methods may be presented herein in a particular order, in alternative embodiments the steps may have another suitable order. Similarly, certain aspects of the present technology disclosed in the context of particular embodiments can be combined or eliminated in other embodiments. Furthermore, while advantages associated with certain embodiments may have been disclosed in the context of those embodiments, other embodiments can also exhibit such advantages, and not all embodiments need necessarily exhibit such advantages or other advantages disclosed herein to fall within the scope of the present technology. Accordingly, this disclosure and associated technology can encompass other embodiments not expressly shown or described herein.

Certain aspects of the present technology may take the form of computer-executable instructions, including routines executed by a controller or other data processor. In at least some embodiments, a controller or other data processor is specifically programmed, configured, and/or constructed to perform one or more of these computer-executable instructions. Furthermore, some aspects of the present technology may take the form of data (e.g., non-transitory data) stored or distributed on computer-readable media, including magnetic or optically readable and/or removable computer discs as well as media distributed electronically over networks. Accordingly, data structures and transmissions of data particular to aspects of the present technology are encompassed within the scope of the present technology. The present technology also encompasses methods of both programming computer-readable media to perform particular steps and executing the steps.

The methods disclosed herein include and encompass, in addition to methods of practicing the present technology (e.g., methods of making and using the disclosed devices and systems), methods of instructing others to practice the present technology. For example, a method in accordance with a particular embodiment includes pressurizing a fluid within an internal volume of a fluid container to a pressure greater than about 25,000 psi, directing the pressurized fluid through a control valve operably connected to the fluid container, varying a flow rate of the fluid by throttling the fluid between a shaft portion of a pin and a tapered inner surface of a seat, and impacting the fluid against a workpiece after varying the flow rate of the fluid. A method in accordance with another embodiment includes instructing such a method.

Throughout this disclosure, the singular terms "a," "an," and "the" include plural referents unless the context clearly indicates otherwise. Similarly, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the terms "comprising" and the like are used throughout this disclosure to mean including at least the recited feature(s) such that any greater number of the same feature(s) and/or one or more additional types of features are not precluded. Directional terms, such as "upper," "lower," "front," "back," "vertical," and "horizontal," may be used herein to express and clarify the relationship between various elements. It should be understood that such terms do not denote absolute orientation. Reference herein to "one embodiment," "an embodiment," or similar formulations means that a particular feature, structure, operation, or characteristic described in connection with the embodiment can be included in at least one embodiment of the present technology. Thus, the appearances of such phrases or formulations herein are not necessarily all referring to the same embodiment. Furthermore, various particular features, structures, operations, or characteristics may be combined in any suitable manner in one or more embodiments.

We claim:

1. A waterjet system, comprising:

a fluid container;

a control valve positioned to receive fluid from the fluid container, wherein the control valve includes a seat, a pin, and an actuator including a piston movable to change a spacing between the seat and the pin;

a cutting head including a waterjet outlet downstream from the control valve;

a load cell configured to detect a hydraulic force from the fluid within the control valve acting against the piston in a first direction, wherein force acting against the piston in the first direction tends to increase the spacing, and force acting against the piston in a second direction opposite to the first direction tends to decrease the spacing; and a controller operably connected to the load cell and the actuator, wherein the controller is programmed with instructions that, when executed, cause a change in a pneumatic input to the actuator based at least in part on the detected hydraulic force, wherein the change in the pneumatic input changes a pneumatic force acting against the piston in the second direction.

2. The waterjet system of claim 1, further comprising a pressure sensor configured to detect a pressure of the fluid downstream from the control valve, wherein the instructions, when executed, cause a change in the pneumatic input to the actuator based at least in part on the detected pressure.

3. The waterjet system of claim 1, further comprising a pump configured to pressurize the fluid upstream from the control valve, wherein the instructions, when executed, cause a change in the pneumatic input to the actuator based at least in part on an operating parameter of the pump.

4. The waterjet system of claim 1 wherein the control valve is configured to selectively reduce a pressure of the fluid downstream from the control valve to a steady-state pressure within a range from 1,000 psi to 25,000 psi as the fluid flows through the control valve toward the waterjet outlet.

5. The waterjet system of claim 1 wherein the control valve is configured to selectively reduce a pressure of the fluid downstream from the control valve to two or more different steady-state pressures within a range from 1,000 psi to 25,000 psi as the fluid flows through the control valve toward the waterjet outlet.

6. The waterjet system of claim 1, further comprising a fluid-pressurizing device configured to supply the fluid to the fluid container, wherein the control value and the cutting head are movable relative to the fluid-pressurizing device.

7. The waterjet system of claim 6, wherein:

the fluid container includes a conduit extending between the fluid-pressurizing device and the control valve;

the conduit includes a joint configured to facilitate movement of the control valve and the cutting head relative to the fluid-pressurizing device; and the control valve is downstream from the joint.

8. The waterjet system of claim 7 wherein the joint has two or more degrees of freedom.

9. The waterjet system of claim 7 wherein the joint is a swivel joint including a seal with a pressure rating greater than 30,000 psi.

10. The waterjet system of claim 1 wherein:

the seat has a passage and a tapered inner surface extending around the passage;

the pin has an end portion and a shaft portion upstream from the end portion; and the control valve is configured to throttle the fluid between the tapered inner surface of the seat and the shaft portion of the pin.

* * * * *